US006116728A

United States Patent [19]

Miyake et al.

[11] Patent Number: 6,116,728

[45] Date of Patent: Sep. 12, 2000

[54] INK JET RECORDING METHOD AND APPARATUS AND RECORDED MATTER

[75] Inventors: Hiroyuki Miyake, Kawasaki; Tomohiro Aoki, Yokohama; Kazuyoshi Takahashi, Kawasaki; Akio Suzuki, Yokohama; Mitsuru Kurata, Kawasaki; Tokihide Ebata, Yokohama; Yoshihiro Takada, Kawasaki; Kunihiko Matsuzawa, Kawasaki; Hideyuki Tanaami, Yokohama; Yutaka Udagawa, Machida; Masatoshi Ikkatai, Kawasaki; Keiju Kuboki, Yokohama; Yasushi Miura, Kawasaki; Masahiro Nishio, Higashi Yamato; Yasuyuki Takanaka, Yokohama; Eiichi Takagi, Yokohama; Yoshio Komaki, Yokohama; Nobuhiko Ogata, Tokyo, all of Japan

[73] Assignee: Canon Kabushiki Kaisha, Tokyo, Japan

[21] Appl. No.: 08/022,565

[22] Filed: Feb. 25, 1993

[30] Foreign Application Priority Data

| | | | |
|---|---|---|---|
| Feb. 26, 1992 | [JP] | Japan | 4-039489 |
| Feb. 26, 1992 | [JP] | Japan | 4-039492 |
| Apr. 27, 1992 | [JP] | Japan | 4-107670 |
| Jul. 21, 1992 | [JP] | Japan | 4-193934 |
| Feb. 18, 1993 | [EP] | European Pat. Off. | 93301199 |
| Feb. 19, 1993 | [JP] | Japan | 5-030658 |
| Feb. 19, 1993 | [JP] | Japan | 5-030659 |

[51] Int. Cl.[7] ..... B41J 2/01

[52] U.S. Cl. ..... 347/102

[58] Field of Search ..... 347/101, 102, 347/105, 106, 41, 15, 43

[56] References Cited

U.S. PATENT DOCUMENTS

| | | | |
|---|---|---|---|
| 3,564,120 | 2/1971 | Taylor . | |
| 3,604,846 | 9/1971 | Behane | 347/15 X |
| 4,170,883 | 10/1979 | Varner . | |
| 4,216,591 | 8/1980 | Bubley . | |
| 4,313,124 | 1/1982 | Hara . | |
| 4,345,262 | 8/1982 | Shirato et al. . | |
| 4,401,024 | 8/1983 | Frentress | 347/102 X |

(List continued on next page.)

FOREIGN PATENT DOCUMENTS

| | | |
|---|---|---|
| 0 212 655 | 3/1987 | European Pat. Off. . |
| 0 291 738 | 11/1988 | European Pat. Off. . |
| 0332787 | 9/1989 | European Pat. Off. . |
| 0 376 345 | 7/1990 | European Pat. Off. . |
| 0 442 711 | 8/1991 | European Pat. Off. . |
| 0 447 262 | 9/1991 | European Pat. Off. . |
| 0 450 287 | 10/1991 | European Pat. Off. . |
| 0 461 759 | 12/1991 | European Pat. Off. . |
| 0490835 | 6/1992 | European Pat. Off. . |
| 0500281 | 8/1992 | European Pat. Off. . |
| 0 513 372 | 11/1992 | European Pat. Off. . |
| 54-56847 | 5/1979 | Japan . |
| 56-105967 | 8/1981 | Japan . |
| 59-123670 | 7/1984 | Japan . |

(List continued on next page.)

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet textile printing apparatus for performing printing by reading an original image created by a designer, converting the original image into original data represented by an electric signal, retrieving the original data for processing to be output as image data, and recording data on cloth based on the image data. The ink jet textile printing apparatus has a first ink jet recording head provided upstream of a recording position, and a second ink jet recording head provided downstream thereof, and is provided with a drying unit located between the recording heads, whereby high-quality recorded images with less bleeding can be obtained by recording on a recording area again with the second ink jet recording head after drying the recording area on the cloth recorded by the first ink jet recording head with the drying unit.

26 Claims, 39 Drawing Sheets

U.S. PATENT DOCUMENTS

| | | | |
|---|---|---|---|
| 4,459,600 | 7/1984 | Sato et al. . | |
| 4,463,359 | 7/1984 | Ayata et al. . | |
| 4,469,026 | 9/1984 | Irwin | 101/484 |
| 4,481,244 | 11/1984 | Haruta et al. | 346/135.1 X |
| 4,558,333 | 12/1985 | Sugitani et al. . | |
| 4,593,295 | 6/1986 | Matsufuji et al. | 347/41 |
| 4,721,968 | 1/1988 | Arai et al. | 347/105 X |
| 4,723,129 | 2/1988 | Endo et al. . | |
| 4,725,849 | 2/1988 | Koike et al. | 347/105 |
| 4,740,796 | 4/1988 | Endo et al. . | |
| 4,748,453 | 5/1988 | Lin et al. | 347/41 |
| 4,797,687 | 1/1989 | Holder et al. | 347/107 X |
| 4,832,984 | 5/1989 | Hasegawa et al. | 347/101 X |
| 4,975,780 | 12/1990 | Kuboki | 358/296 |
| 4,982,207 | 1/1991 | Tunmore et al. . | |
| 5,005,025 | 4/1991 | Miyakawa et al. . | |
| 5,055,861 | 10/1991 | Murayama et al. . | |
| 5,371,531 | 12/1994 | Rezanka et al. | 347/43 |
| 5,528,271 | 6/1996 | Ebisawa | 347/102 X |

FOREIGN PATENT DOCUMENTS

| | | | |
|---|---|---|---|
| 59-138461 | 8/1984 | Japan . | |
| 59-212271 | 12/1984 | Japan . | |
| 60-71260 | 4/1985 | Japan . | |
| 60-105546 | 6/1985 | Japan . | |
| 61-032758 | 2/1986 | Japan | 347/102 |
| 62-33647 | 2/1987 | Japan . | |
| 62-53492 | 3/1987 | Japan . | |
| 1095053 | 4/1989 | Japan . | |
| 2047377 | 2/1990 | Japan . | |
| 0346589 | 7/1991 | Japan . | |
| 3-247450 | 11/1991 | Japan | 347/102 |

INK JET RECORDING METHOD AND APPARATUS AND RECORDED MATTER

BACKGROUND OF THE INVENTION

1. Field of the Invention

The present invention relates to an ink jet recording method and apparatus and recorded matter therefor, for recording an image onto a recording medium such as cloth made of materials such as cotton and silk, and others by scanning a recording head relative to the recording medium.

2. Related Background Art

Typical of the conventional textile printing apparatus for recording onto the cloths as a recording medium is a screen textile printing apparatus for directly printing onto the cloths using a silk screen plate. In making the textile printing using such a screen textile printing apparatus, first, for an original image to be printed, a silk screen plate is prepared for each color used in that original image, and attached to the screen textile printing apparatus, and the ink is directly transferred through the meshes of the silk screen plate onto the cloths.

The above-described screen textile printing apparatus has a problem associated therewith that a great number of processes and days are required to prepare silk screen plates, and the operations such as the proportion of color inks, and the alignment of silk screen plates for each color, are necessary. Moreover, the apparatus ha an additional problem that the mechanism becomes larger in proportion to the number of colors used, requiring a large installation space, and storage space for the silk screen plates is necessary.

On the other hand, ink jet recording has a quite higher resolution than the conventional screen textile printing, allowing for the printing of high quality designs with gradations. And it has a feature that considerably high productivity can be expected by using a multi-nozzle head having several hundreds to thousands of nozzles.

However, because of its nature of recording with the ink discharged through minute ink jet nozzles, the use of low viscous (thin) ink is requisite. Accordingly, dark designs cannot be recorded. If a large amount of ink is jetted, the design becomes darker, but the ink may blot on cloths, so that excellent designs cannot be created.

Also, due to a great number of nozzles used in parallel, it is difficult to form images without defects, because unevenness, deviation, and white streaks produced by capricious non-discharge may be contained in recording, depending on the characteristic peculiar to its nozzle. This is a serious problem for industrial machines which produce several tens to hundreds of meters of printing at a time in the continuous operation.

Also, light color is represented by applying ink droplets sparsely, which often leads to the roughness of an image. In particular, if the diameter of a nozzle, or ink droplet, is tired to be made larger to avoid the above drawback, it is meant that the resolution is reduced, resulting in more evident roughness.

Some treatment agents are effectively applied immediately before recording, because they are unstable on the cloths, but such agents cannot be used in the convention process.

On the other hand, an ink jet recording apparatus is one for performing the dot recording by discharging ink droplets from recording head nozzles to a recording medium, and is effective in the respects of apparatus constituting and running costs. One example of such recording apparatus is one in which the recording or printing is performed by sequentially scanning a recording head having a row of nozzles arranged in a predetermined width (about 16 mm) longitudinally and transversely relative to the recording medium.

However, there is some dispersion in the amount or direction of ink to be discharged from each nozzle of the ink jet recording head, so that this dispersion may produce streaks apparently. For this reason, there was a problem that periodic streaks or blurs arose on recorded image in a width of a recording head to degrade the image quality. Also, there was a problem that those blurs might vary with time over a long period of recording.

Moreover, there was a problem that if contaminants such as dirt or inks adhere to the nozzle surface of a recording head to prevent normal ink discharge through nozzles (hereinafter referred to as undischarged), line defects may appear on the image, thereby degrading the image quality.

To solve those problems, it is conceived that a predetermined pattern is printed and confirmed visually or with a reader to correct for unevenness with the head based on the information obtained.

However, if the execution of correction operation is entrusted to the judgement of the operator, the correction operation may sometimes give rise to inappropriate effect. Further, in this case, no measure is taken against the undischarged.

Further, it is necessary that the phenomenon of causing such degradation of image quality is checked at all times, and the correction is appropriately made, but when a long roll of recording sheet is used, the printing may be performed on a very long recording sheet (e.g., 100 m or greater) at a time, so that undischarge unevenness during the printing gives rise to a great problem, and the correction is a very difficult task. Also, there is a further problem that when the long roll of recording sheet is made of a woven fabric, fine fluffy fibers stick around the nozzles of a recording head, so that the probability of causing undischarge is significantly higher than if the recording sheet is paper or the like.

In addition, when the recording medium was cloths made of materials such as cotton and silk, and others, there was a serious problem that even if a predetermined pattern was recorded on the recording medium, and confirmed visually or with a reader to correct for unevenness with the head based on the information obtained, the bleeding of ink might occur, and due to non-uniformity on the surface of a recording medium produced by texture of fibers, the predetermined pattern recorded could not be read correctly, so that the correct grasping of the discharge condition with the recording head was difficult.

Conventionally, an ink jet printer with a plurality of multi-nozzle heads for recording the image onto a recording medium with those ink jet heads is well known. In such a printer, in order to make alignment (registration) or recording position with a plurality of heads, an image in a predetermined pattern such as checkered is printed on a recording sheet using the plurality of ink jet heads, its printed result is watched visually, or read using reader means such as a scanner, whereby the deviation of a recorded pattern is calculated to determine the deviation of each ink jet head. Based on the deviation thus obtained, the adjustment of recording position is performed in accordance with a mounting position of the ink jet head by changing the read timing from each memory for storage of image data to be recorded by each ink jet head.

However, the conventional registration method as above described was an adjustment method when a plurality of ink jet heads were arranged transversely to the scanning direction of a carriage, but when a plurality of recording heads were arranged vertically, or orthogonally to the scanning direction of the carriage, the positional deviation was only mechanically adjusted.

SUMMARY OF THE INVENTION

In view of the aforementioned problems of the related arts, the present invention has been achieved based on new aspects which were conventionally not foreseen.

A first invention aims to provide an ink jet recording apparatus which does not need the creation of screen plates or the mixing of each color ink, when the recording is performed on the cloths made of materials such as cotton and silk, for example, and can be realized on a smaller size.

Another object of the first invention is to provide an ink jet recording method comprising the steps of reading an original image for conversion into an image signal, creating recording data from said image signal, jetting the ink onto a recording medium by the use of a recording device having a recording head for discharging the ink based on said recording data, and fixing the ink jetted onto said recording medium.

A second invention aims to provide an ink jet recording apparatus which can make the effective use of textile printing with high definition and gradations in the ink jet recording, and further enables the recording with less bleeding and excellent sharpness, and wherein unevenness, white streaks, joints and roughness are reduced.

Another object of the second invention is to provide an ink jet recording apparatus for performing the recording by scanning a recording head for discharging the ink relative to a recording medium, comprising a first ink jet recording unit located on the upstream side of the recording, and second ink jet recording unit locate on the downstream side of the recording, drying means for drying the ink in a recording area containing a recorded part recorded on the recording medium by said first ink jet recording unit, which is provided between said first ink jet recording unit and said second ink jet recording unit, and recording control means for controlling said second ink jet recording unit to further perform the recording on said recording area dried by said drying means.

A third invention aims to provide a recording apparatus which can provide a stable image recorded at all times by correctly grasping the discharge condition of a recording head, even when recording onto a recording medium enabling less correct reading of test image recorded, as may occur on the recording medium such as cloths made of materials such as cotton and silk or blotty papers.

Another object of the third invention is to provide an ink jet recording apparatus for recording an image by scanning a recording head for discharging the ink relative to a first recording medium comprising test image recording means for recording a predetermined test image onto a second recording medium, which is more suitable for the recording of a test image than said first recording medium, by said recording head, reading mens for reading said test image recorded by said test image recording means, judgment means for judging the recording state of said recording head based on said test image read by said reading means, and control means for controlling said recording head based on a judgment result of said judgment means.

A fourth invention aims to provide a recording method and apparatus which allows a correct and simple adjustment for the recording position to be recorded by a plurality of recording heads.

Another object of fourth invention is to provide a recording apparatus for recording onto a recording medium based on image data stored in a memory by scanning a plurality of recording heads relative to said recording medium, comprising first recording means for recording a predetermined pattern with a first recording head, movement means for moving an image portion of said recording medium recorded by said first recording means to a position of a second recording head located away from said first recording head in a direction of an array of recording elements in said first recording head, second recording means for recording said predetermined pattern with said second recording head, after movement by said movement means, reading means for reading an image recorded by said first recording means and said second recording means in a direction of the array of recording elements in said first recording head, calculating means for calculating the positional deviation of said first recording head and said second recording head based on data read by said recording means, and alteration means for altering the reading position of image data from said memory in accordance with said positional deviation.

It should be noted that the term "recording" used in the present specification and claims includes a meaning of "printing" and signifies in a broad sense providing an image on a recording medium such as cloths made of materials such as cotton, silk or others and paper. It should be also noted that the language "recording" does not limit the scope of the invention.

DETAILED DESCRIPTION OF THE PREFERRED EMBODIMENTS

The preferred embodiments of the present invention will be described below with reference to the drawings.

(First Embodiment)

Figure 1:
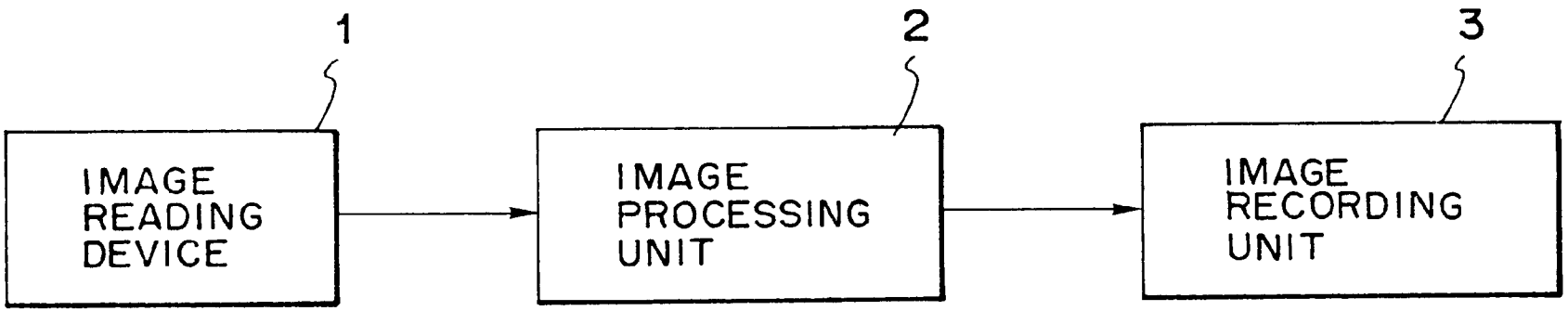
FIG. 1 is a bock diagram showing a configuration of an ink jet textile printing apparatus according to the present invention.

FIG. 1 is a block diagram showing a configuration of an ink jet textile printing apparatus in one embodiment of the present invention. This ink jet textile printing apparatus is constituted as a system, principally consisting of an image reading device 1 for reading an original image created by a designer and converting the original image into original data represented by an electrical signal, an image processing unit 2 for processing original data from the image reading apparatus 1 to be output as image data, and an image recording unit 3 for recording onto the cloths on the basis of image data created by the image processing unit 2. The image reading device 1 reads an original image from a CCD image sensor. The image processing unit 2 creates data for driving an ink jet driving unit A-2 (FIG. 2) for discharging four color inks of magenta (code M), cyan (code C), yellow (code Y) and black (code Bk) as will be described later from input original data. The creation of data involves an image processing for reproducing original image in ink dots, coloration for determining tone, alteration of layout, processing or selection for the design size such as enlargement or reduction. The ink jet recording unit A-2 performs the recording in such a way as to jet fine ink droplets toward a recording medium (cloths in this embodiment) to attach onto the recording medium.

Figure 2:
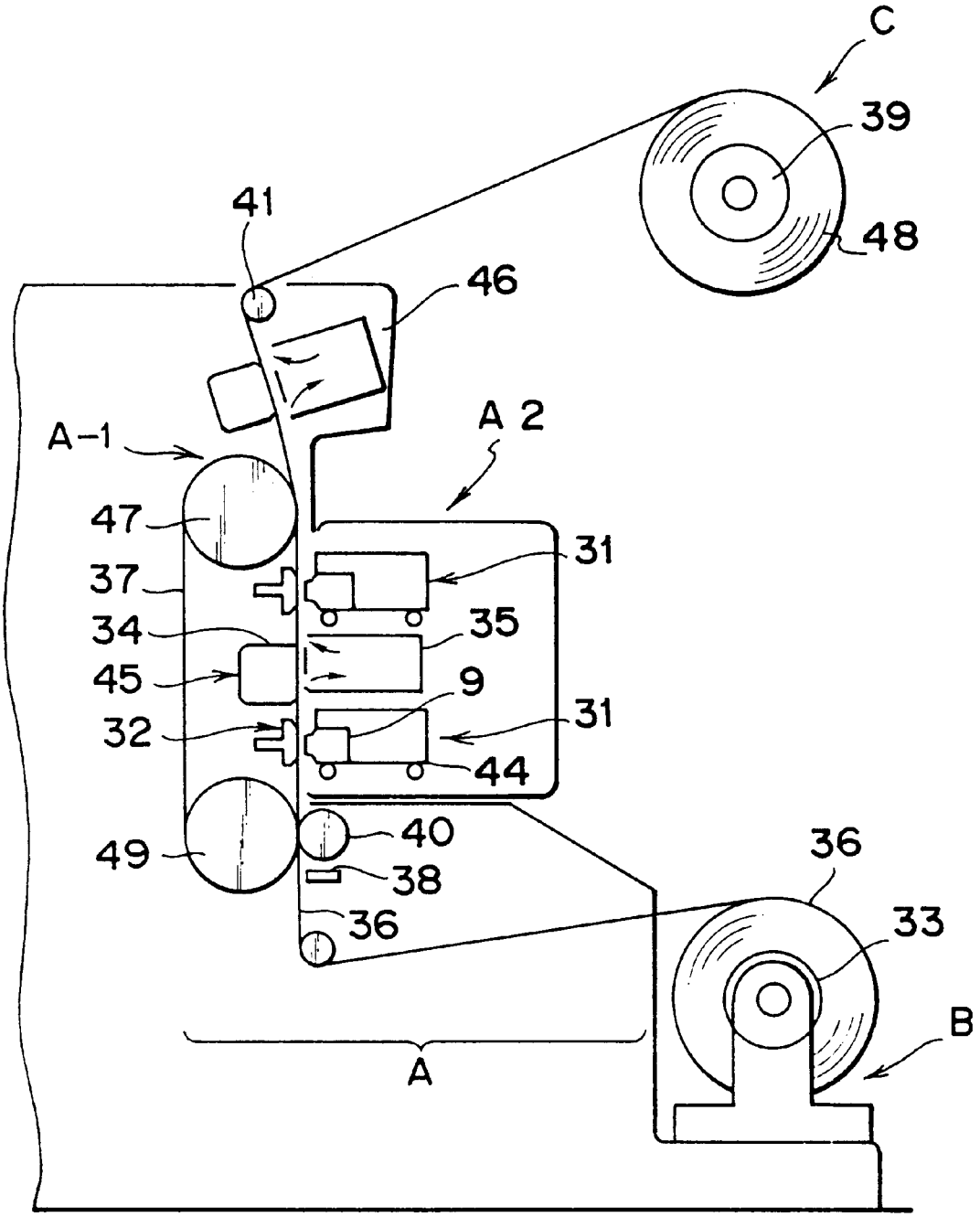
FIG. 2 is a cross-sectional view showing a configuration of an image recording unit.
Figure 3:
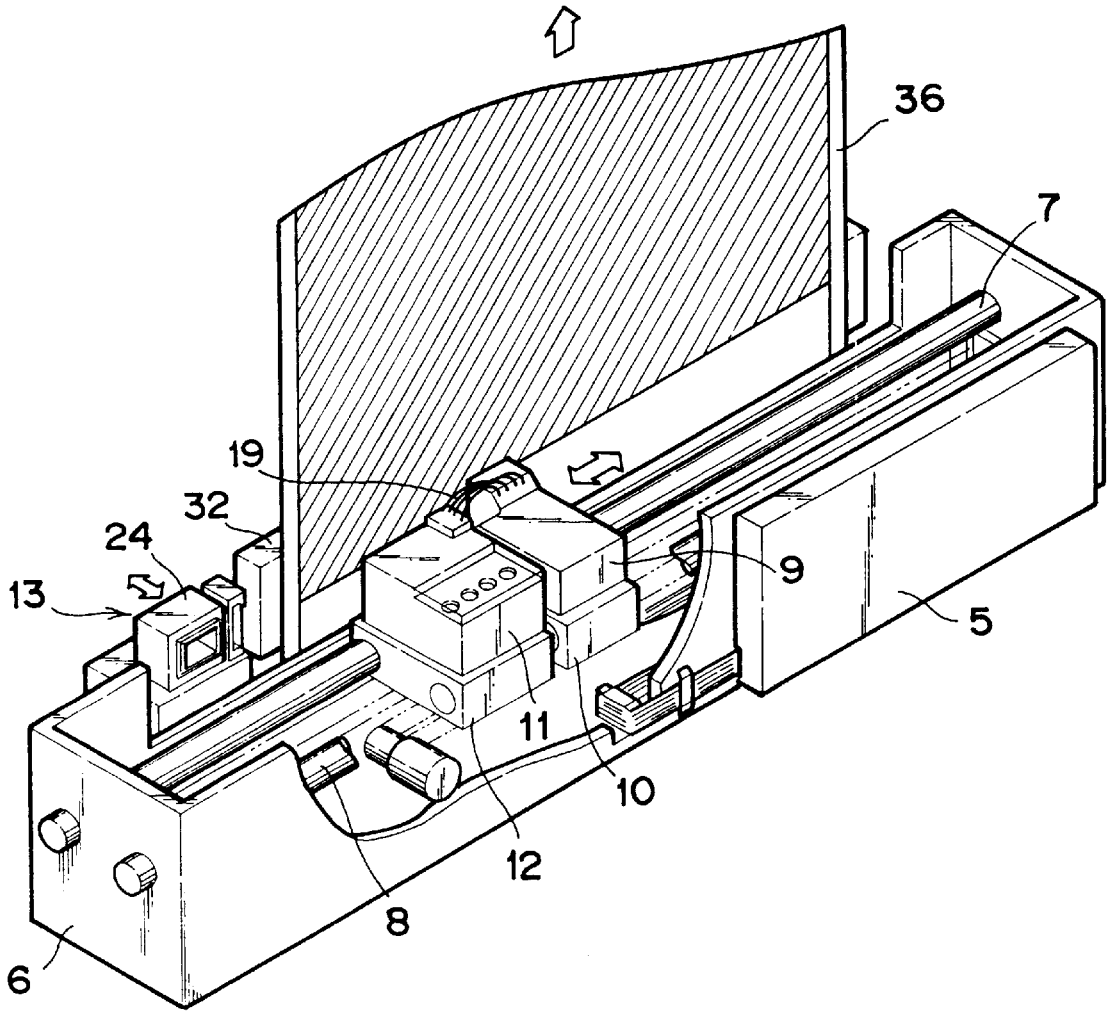
FIG. 3 is a perspective view showing in detail a configuration of an ink jet recording unit.
Figure 4:
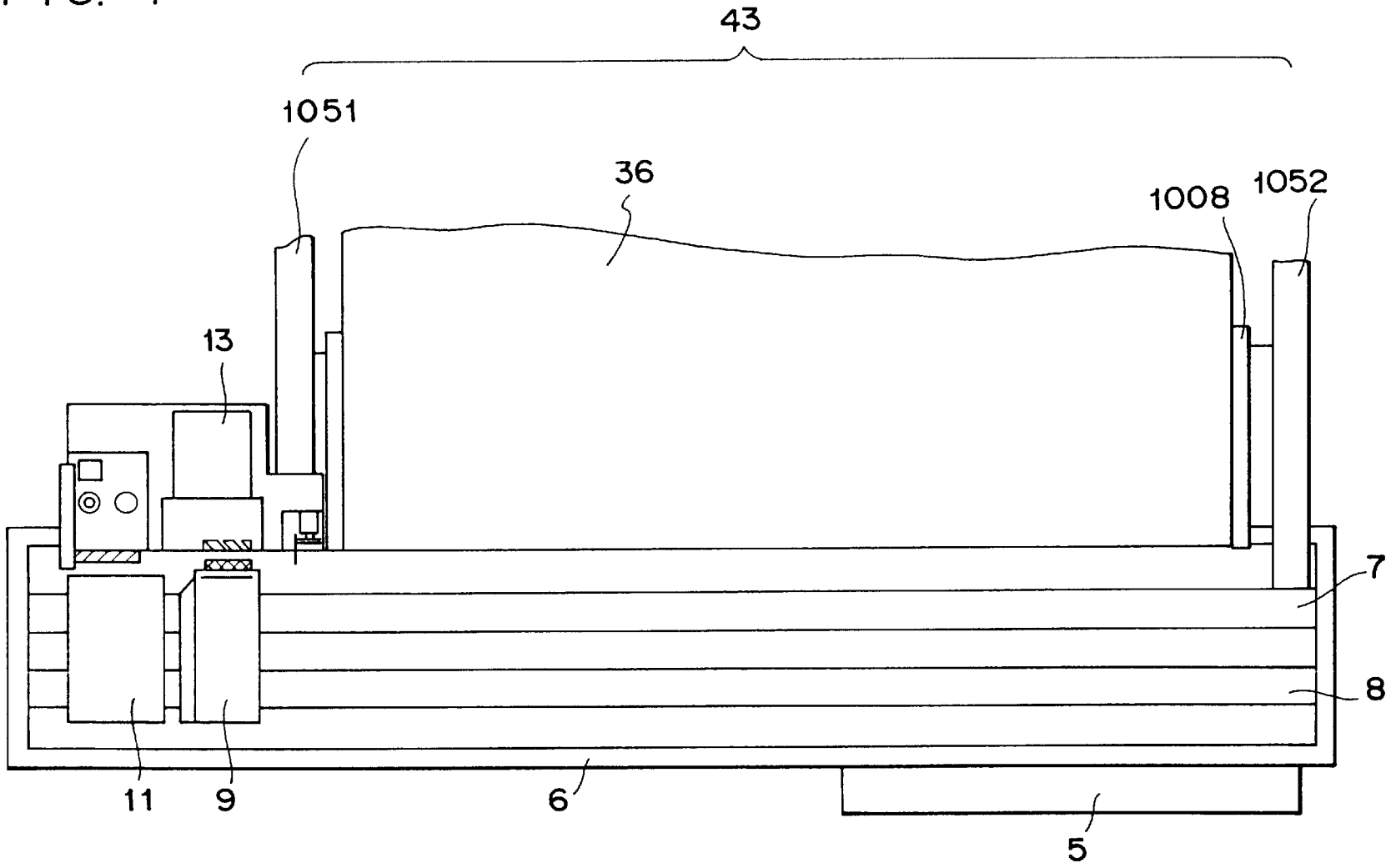
FIG. 4 is a plan view showing the positional relation between the ink jet recording unit and a cloth conveying unit.

First, the configuration of the image recording unit 3 will be described below. FIG. 2 is a cross-sectional view showing a configuration of image recording unit 3, FIG. 3 is a perspective view showing in detail a configuration of ink jet recording unit A-2 contained in the image recording unit 3, and FIG. 4 is a plan view showing the positional relation between ink jet recording unit A-2 and cloth conveying unit.

The textile printing apparatus (printer) of this embodiment is largely comprised of a cloth supply unit B for delivering the cloths wound around the roll pretreated for the textile printing, a main unit for printing with an ink jet head while feeding the cloths delivered accurately, and a winding unit C for winding the printed cloth after being dried. And the main unit A consists of a precision cloth feeding unit A-1 containing a platen and a print unit A-2.

Pretreated roll cloth 36 is delivered to the cloth supply unit, and supplied to the main unit A. In the main unit, a thin endless belt 37 which is precisely driven stepwise is looped around a drive roller 47 and an idler roller 49. The drive roller 47 is directly driven stepwise by a stepping motor (not shown) of high resolution to feed the belt stepwise by the amount of a step. The delivered cloth 36 is pressed on the surface of belt 37 backed up with the idler roller 49 by a presser roller 40, and adhered thereto.

The cloth 16 fed stepwise by the belt is positioned in a first print unit 31 by means of a platen 32 on the back side of the belt, and printed by an ink jet head 9 on the front side thereof. Every time one line of print is terminated, the cloth is fed at the predetermined step, and then dried through heating by a heating plate 34 on the back side of the belt, and hot air supplied to its surface by a hot air duct 35. Subsequently, in a second print unit 31', overlap printing is performed in the same way as in the first print unit.

The printed cloth is peeled off and dried again by a post drying unit 46 similar to the heating plate and the hot air duct as previously described, and guided by a guide roll 41 to be wound around a winding roll 48. And wound cloth is removed from the main apparatus, and subjected to post-treatment such as coloring, cleaning, and drying in batch processing to provide products.

FIG. 3 shows one of the print units in the ink jet recording unit A-2 for convenience sake.

The ink jet recording unit A-2 is largely comprised of a frame 6, two parallel guide rails 7, 8 attached to the frame 6, an ink jet head 9, a head carriage 10 on which the ink jet head 9 is mounted, an ink supply device 11, an ink carriage 12 on which the ink supply device 11 is mounted, a head recovery device 13, and an electrical system 5.

The ink jet head 9 comprises a plurality of nozzle rows and a conversion device for converting an electrical signal into ink discharge energy, and has a mechanism for selectively discharging the ink through nozzle rows in accordance with a driving image signal from the image processing unit 2. Herein, a method for discharging the ink in the ink jet head 9 is not different from that of the ink jet head for use in the conventional ink jet recording apparatus which uses papers as the recording medium. In this embodiment, to reproduce arbitrary color, four color inks of magenta (M), cyan (C), yellow (Y) and black (Bk) are discharge from the ink jet head 9, as above described. These four color inks are discharged through recording heads 117 to 120 (FIG. 7), respectively, provided within the ink jet head 9. Each recording head 117 to 120 is provided with a plurality of nozzles (e.g., 256 lines) for the discharge of ink to discharge a respective color ink through those nozzles.

The ink supply device 11 is to reserve four color inks of M, C, Y and Bk, and supply necessary amounts of inks to the ink jet head 9, comprising an ink tank and an ink pump (not shown). The ink supply device 11 and the ink jet head 9 are connected via an ink supply tube 19, whereby normally owing to capillary action, the amount of ink to be discharged from the ink jet head 9 is automatically supplied to the ink jet head 9. In the head recovery operation as hereafter described, the ink is compulsorily supplied to the ink jet head 9 by using an ink pump (not shown). The ink jet head 9 and ink supply device 11 are mounted on the head carriage 10 and the ink carriage 12, respectively, for reciprocating movement along the guide rails 7, 8 by a driving device, not shown.

The head recovery device 13 is provided opposed to the ink jet head 9 at a home position to maintain the stability of the ink jet head 9, and specifically performs the following operations. That is, when not operated, to prevent the ink from evaporating from within the nozzles of the ink jet head 9, it allows a capping unit 24 to perform the capping for the ink jet head 9 at the home position (capping operation). Before starting the image recording, an operation of compulsorily discharging the ink through the nozzles by pressurizing the ink channels within the ink jet head 9 using the ink pump (pressure recovery operation) is required to remove bubbles or dirt from within the nozzles, wherein the head recovery device 13 serves to withdraw the discharged ink.

The electrical system 5 comprises a control unit for performing the sequence control of the whole ink jet recording unit 1 and a power supply unit, and is attached to the frame 6.

While the configuration of the ink jet recording unit A-2 has been described, it will be understood that the ink jet recording unit 1 is supported via a rail (not shown) on the frames 1051, 1052 of cloth conveying unit 43, as shown in FIG. 4, so as to be movable in a direction away from the platen 32 by releasing securing means (not shown). To this end, there is provided a working space between the conveying belt 37 of cloth conveying unit 43 and the ink jet recording unit A-2 to facilitate the handling of cloths 36 on the conveying belt 37 when the abnormal condition occurs. As shown in FIG. 4, the cap position of the ink jet head 9 lies outside a frame 1051 of cloth conveying unit 43 to facilitate the maintenance of ink jet head 9 and the refilling of ink by the operator.

Figure 5:
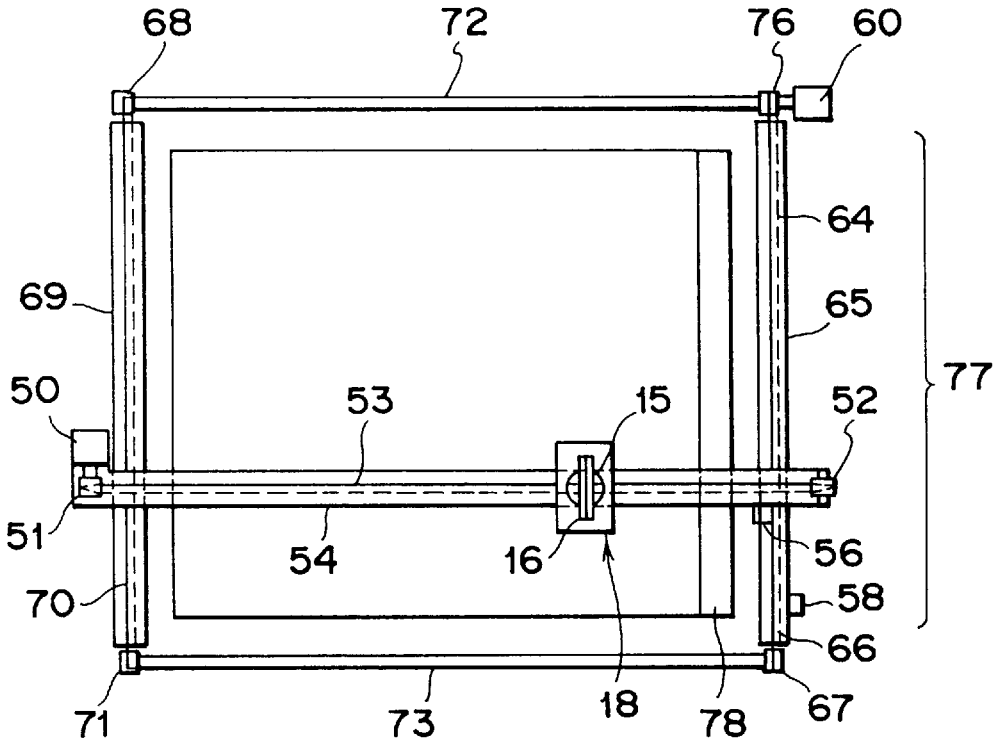
FIG. 5 is a plan view showing a configuration of an image reading device.

The image reading device 1 will be described below. FIG. 5 is a plan view showing a configuration of the image reading device 1. The image reading device 1 belongs to a type of so-called image scanner, in which an original image is converted into an electrical signal (original data) by a CCD unit 18.

The CCD unit 18 is comprised of a CCD 16 and a lens 15 for forming images on the CCD 16 and is freely movable on a main direction rail 54. At one end of the main direction rail 54 are mounted a pulley 51 and a main scan motor 50 connected to the pulley 51. At the other end of the main direction rail 54 is mounted another pulley 52, wherein there is provided a wire 53 strung between both pulleys 51, 52 and connected to the CCD unit 18. The main scan motor 50, pulleys 51, 52 and wire 53 constitute a driving system in a main scan direction, by which the CCD unit 18 is driven to move to any position on the main direction rail 54.

The main direction rail 54 is slidably mounted at both ends thereof to two sub-direction rails 65, 69 provided at right angles to the main direction rail 54. Two sub-direction rails 65, 69 are parallel to each other, and have the same length, wherein the section between two sub-direction rails 65, 69 is a reading area 77. Each sub-direction rail 65, 69 is provided with a pulley 76, 68 at one end thereof, and a pulley 67, 71 at the other end thereof. And for each sub-direction rail 65, 69, there is provided a wire 66, 70 for stretching around the pulleys 76, 67 and 68, 71 at both ends thereof, each wire 66,70 connected to a respective end portion of the main direction rail 54. The pulleys 76, 68 provided at one end of sub-direction rails 65, 69 are secured to a shaft 72 while the pulleys 67, 71 at the other ends thereof are secured to another shaft 73. These two shafts 72, 73 are parallel to each other and to the main direction rail 54, and rotatable therearound. At an end portion of one shaft is attached a sub-scan motor 60. These shafts 72, 73, sub-direction rails 65, 67, pulleys 76, 67, 68, 71, and sub-scan motor 60 constitute a driving system in a sub-scan direction, wherein the main direction rail 54 can be moved in a direction along the sub-direction rails 65, 69 by driving the sub-scan motor 60.

Substantially over an entire area of the reading area 77 is provided an original plate glass 17 which is place opposed to the CCD unit 18. The end section of the reading area 77 is correction area 78.

With such a constitution, the image reading device 1 can move the CCD unit 18 to any position in the reading area 77 by driving the main scan motor 50 and the sub-scan motor 60. In this case, to detect the CCD unit coming to the home position (an origin position of the coordinates for reading) in the reading area 77, home position sensors 56, 58 are provided at the other ends of the main direction rail 54 and one sub-direction rail 65, respectively. In the embodiment as shown in FIG. 5, the home position is provided corresponding to the correction area 78.

Figure 6:
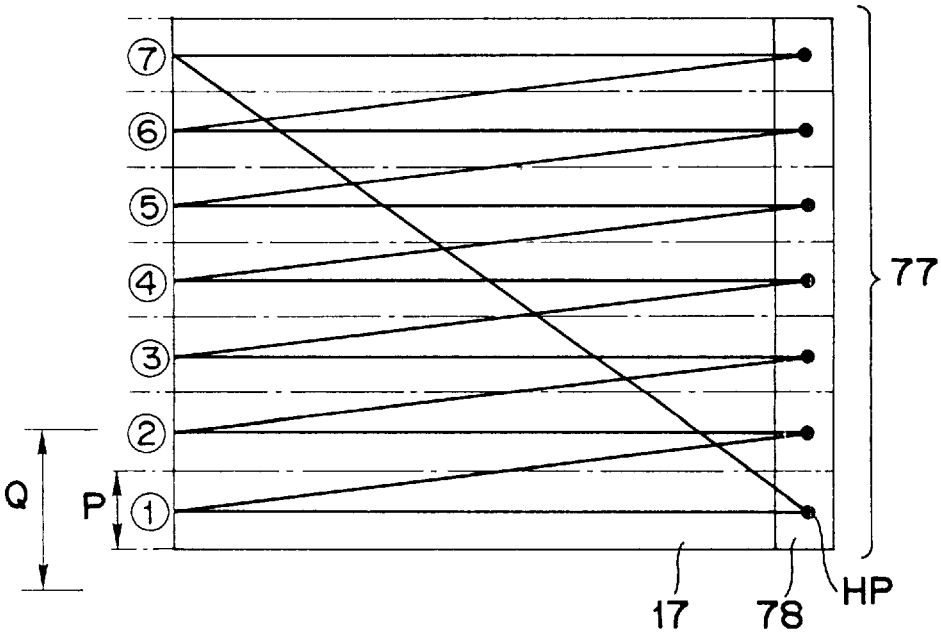
FIG. 6 is a view for explaining the image reacting operation in the image reading device.

Referring now to FIG. 6, the image reading operation of the image reading device will be described.

The image reading operation is first to move the CCD unit 18 to the home position HP in the correction area 78, and to start the operation of reading a whole original placed on the original plate glass 17.

Before scanning the original, the settings of data necessary for processing such as shading correction, black level correction, and color correction are performed in the correction area 78. Thereafter, the scanning of the CCD unit 18 in a main scan direction (a transverse direction as shown) thereof is started by the main scan motor 50 along a direction as indicated by the arrow in the figure. If the reading operation for a first area as indicated by (1) is terminated, the movement of the CCD unit is a sub-scan direction to the correction area 78 for an area as indicated by (2) adjacent the area as indicated by (1) is performed by reversing the rotation of the main scan motor 50 as well as driving the sub-scan motor 60. Subsequently, likewise the area of (1), the processings such as shading correction, black level correction, and color correction are performed as necessary, and the original is read while the CCD unit 18 is moved in the main scan direction. Note that in FIG. 6, P indicates an area to be read by one scanning, and Q indicates an area practically readable by one scanning.

By repeating the above scanning, the reading operation for the whole area, or (1) to (7) areas in an example of FIG. 6, is performed, and after the reading operation for the final area or area (7) is terminated, the CCD unit 18 is returned again to the home position HP. From the relation between the size of a typical original and the width readable by the CCD unit 18 with one scan, more scannings may be actually performed in this embodiment, but in this example, the operation was simplified to facilitate the understanding.

If the reading operation as above described is performed at equal magnification, the area readable by the CCD unit 18 with one scanning is wider than that actually read, as shown in FIG. 6. This is because this image reading device 1 contains a variable magnification feature of enlargement and reduction. For example, if the area recordable by the ink jet head 9 at one time is as large as 256 dots, image information of the area of 512 dots which is equal to twice 256 dots is required to make a 50% reduction operation. Accordingly, the image reading device 1 contains a feature of reading and outputting image information for an arbitrary image area by one reading operation in the main scan direction.

Figure 7:
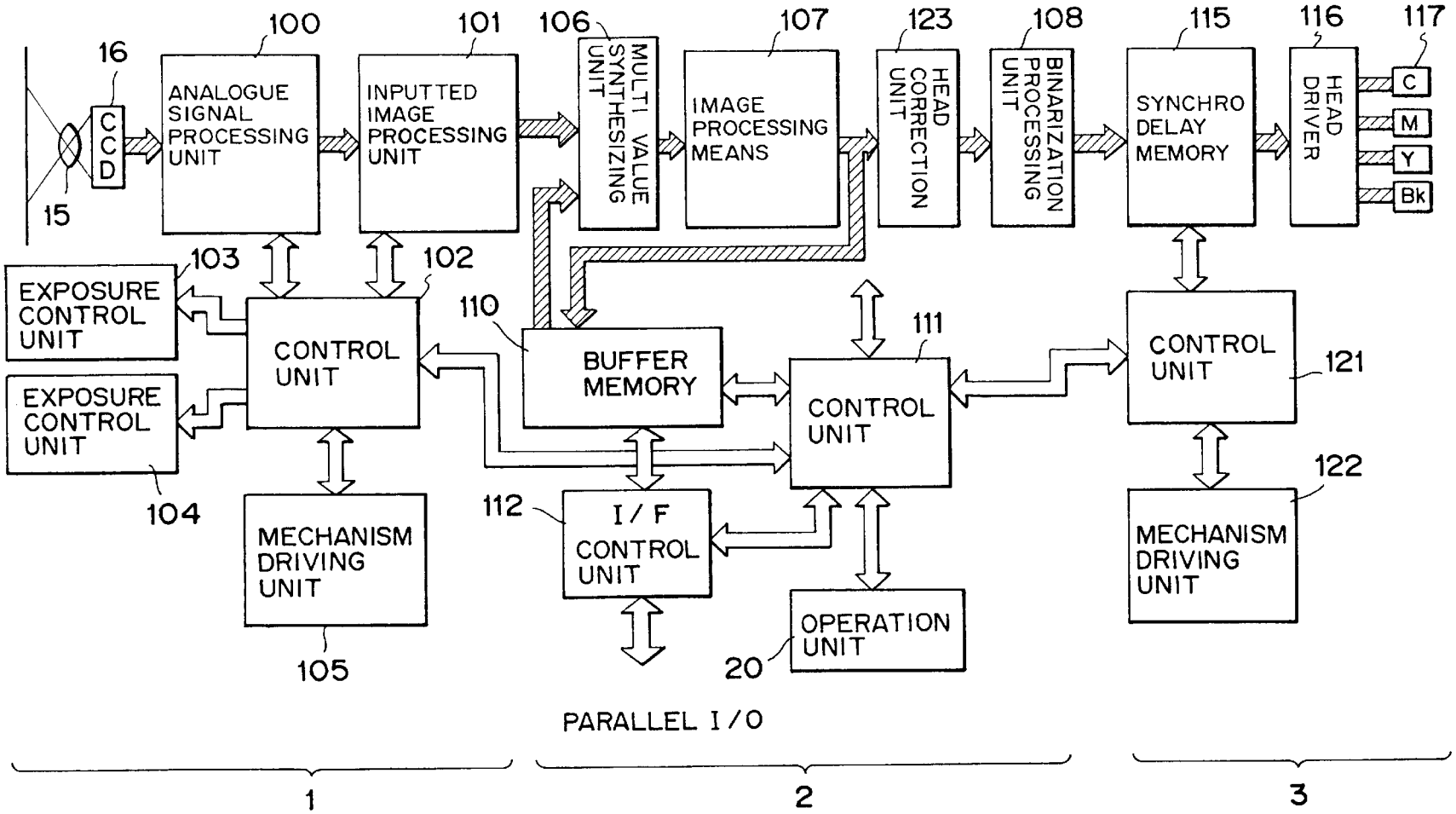
FIG. 7 is a block diagram showing a configuration of a control system in an ink jet textile printing apparatus.

Referring now to FIG. 7, the configuration of the image processing unit 2 will be described below. Since the image processing unit 2 operates integrally with respective control systems of the image reading device 1 and the image recording unit 3, the control systems of the image reading unit 1 and the image recording unit 3 will be also described herein.

The image processing unit 2 is provided with a control circuit 111 which is a control circuit for data transmission and reception with a host system (not shown) such as a computer. And the image reading device 1 and the image recording unit 3 are provided with control units 102, 121 or control circuits, respectively, for controlling them. Each of these control units 102, 111 and 121 is constituted of a microprocessor, a program ROM, a data memory, and a communication circuit. The control unit 102 and the control unit 111, as well as the control unit 111 and the control 121 are connected via a communication line, the control form of a so-called master slave is adopted in which each of the control units 102, 121 of the image reading device 1 and the image recording unit 3 performs the operation upon an instruction from the control unit 111 in the image processing unit 2.

In addition to the control unit 111, the image processing unit 2 comprises an I/F control unit 112 which is a general-purpose parallel interface control circuit such as IEEE488 interface or so-called GPIB interface, a multi-value synthesizing unit 106 for carrying out a variety of processings on the image, image processing means 107 as hereafter described, a head correction unit 123 for correcting for density unevenness, a binarization processing unit 108 for performing binarization processing for image data, and a buffer memory 110 for storing image data, and has a control unit 20 connected thereto. The control unit 111 operates upon an instruction from the operation unit 20 and the computer (not shown). The operation unit 20 offers selection instructions as to the designation for the color or edit in reading the original, or the designation of operation. Also, it offers an instruction for the density unevenness correction when forming the image as hereafter described. This control unit 111 has a feature of governing over the I/F control unit 112, thus enabling the input or output of image data from or to an external computer, or the remote control with an external apparatus, via an interface connected to the I/F control unit 112. Further, the control unit 111 performs the control over the multi-value synthesizing unit 106, the image processing means 107, the head correction unit 123, the binarization processing unit 108, and the buffer memory 110.

In addition to the control unit 102, the control system of the image reading apparatus 1 comprises a mechanism driving unit 105 for driving a mechanical portion of the image reading apparatus 1, exposure control units 103, 104 for performing exposure control of a lamp (not shown) when reading the original, an analog signal processing unit 100 having a CCD 16 connected thereto for performing a variety of processings on the image, and an input image processing unit 101. The control unit 102 performs the control over the mechanism driving unit 105, the exposure control units 103, 104, the analog signal processing unit 100, and the input image processing unit 101.

The control system of the image recording unit 3 comprises, in addition to the control unit 121, a mechanism driving unit 122 for driving a mechanical portion of image recording unit 3, a head driver 116 for driving each of recording heads 117 to 120 for each color, and a synchronization delay memory for correcting for a delay caused by the mechanical arrangement of recording heads 117 to 120 by absorbing the temporal dispersion in the operation of the mechanical portion in the image recording unit 3. The synchronization delay memory 115 also comprises a circuit for generating the timing necessary for the driving of recording heads 117 to 120. The control unit 121 controls the synchronization delay memory 115 and the mechanism driving unit 122.

The image processing flow in this embodiment will be described below with reference to FIG. 7.

In the image reading unit 1, an image formed on the CCD 16 of the CCD unit 18 (FIG. 5) is converted into analog electrical signal by the CCD 16. An analog electrical signal converted (image information) is serially processed as in the order of R (red), G (green) and B (blue) to be input to the analog signal processing unit 100. The analog signal processing unit 100 performs the sample & hold for each color of R, G and B, correction for the dark level, and control of the dynamic range, and makes an analog/digital (A/D) conversion into a digital image signal of serial multi-value (8-bits in length for each color in this embodiment) to be output to the input image processing unit 101. The input image processing unit 101 performs correction processing necessary for the reading system such as CCD correction and gamma correction by directly acting on a digital image signal of serial multi-value, wherein its result is output to the image processing unit 2 as original image data.

In the image processing unit 2, the multi-value synthesizing unit 106 performs selection and synthesization of a digital image signal (original data) of serial multi-value sent from the image reading device 301 and digital image signal sent via parallel I/F from the external computer (not Shown). Selected and synthesized image data is sent to the image processing means 107 in the digital image signal of serial multi-value as it is. The image processing means 107 is a circuit for carrying out the smoothing processing, edge processing, black extraction, and masking processing for the color correction of recording ink for use in the recording units 117 to 120. A digital image signal of serial multi-value is caused to undergo the above-cited processings in the image processing means 107. And the output of the image processing means 107 is passed into both the head correction unit 123 and the buffer memory 110. The output of the head correction unit 123 is passed into the binarization processing unit 108, although the head correction unit 123 will be described later.

The binarization processing unit 108 is a circuit for converting a digital image signal of serial multi-value into binary value, wherein either of simple binarization at a fixed slice level, and pseudo half tone processing with a dither method, can be selected. The digital image signal of serial multi-value is converted into a binary parallel image signal of four values to be output as the image data to the image recording unit 3.

In the image recording unit 3, a binary parallel image signal (image data) from the image processing unit 2 is passed into the synchronization delay memory 115, on the basis of which the head driver 116 driver each of the recording heads 117 to 120 which discharge the inks of cyan, magenta, yellow and black, respectively, so that an image is printed on the cloth.

Subsequently, the interface (I/F) with the external computer and the like will be described.

Original image data of multi-value read by the image reading device 1 is temporarily stored in buffer memory 110. This image data is transferred via a parallel interface such as GPIB to the computer (not shown), while being synchronized by the I/F control unit 112. The image data transferred to the computer is edited and color converted by making use of a CRT display, and stored as an image file in a flexible disk, a fixed disk, or an optical disk. It is of course needless to say that image data can be simply stored without any special processing. Also, it will be appreciated that an image such as computer graphics (CG) made up directly on the computer without the use of image reading device 1 can be dealt with in the same way as that read by the image reading device 1.

Image data in the image file thus created and stored is transferred via the parallel interface such as GPIB to the buffer memory 110, as previously described, and then passed from the buffer memory 110 through the image multi-value synthesizing unit 106, the image processing means 107, the head correction unit 123, the binarization processing unit 108, the synchronization delay memory 115 to the head driver 116, so that its image data is printed by the recording heads 117 to 120.

Figure 8:
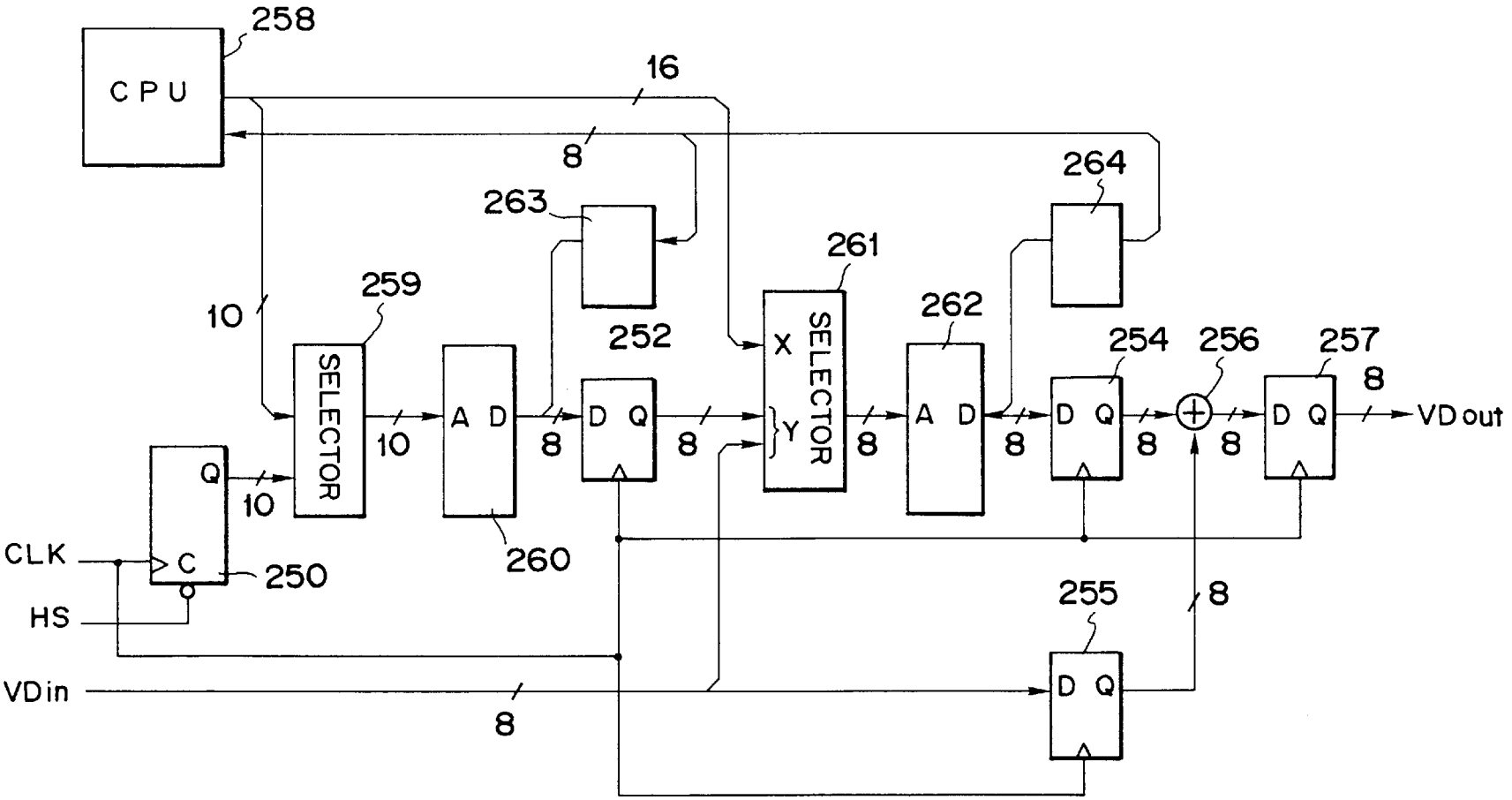
FIG. 8 is a block diagram showing a configuration of a head correction unit.

Referring now to FIG. 8, the details of the head correction unit 123 will be described below.

Each nozzle of the recording heads 117 to 120 provided in the image recording unit 1 is fabricated evenly, but the nozzle diameter may be slightly different, the ink discharge direction from each nozzle may be deviated even slightly due to influence of ink adhering to the nozzle neighborhood, or the amount of discharge may be different. For this reason, even when image data having certain density is printed, there may occur some unevenness consisting of streaks in the main scan direction. In order to correct for such unevenness to attain even printing at certain density, the density of image data corresponding to a nozzle portion having a lower density (or higher density) in increase for decreased) in accordance with its print density so as to render the print density even. The head correction unit 123 serves to perform such a correction. Suppose herein that each of the recording heads 117 to 120 is provided with 256 nozzles.

In the head correction unit 123, characteristic information of density unevenness for each of the 256 nozzles of the recording heads 117 to 120 corresponding to C, M, Y and Bk (selection information for selecting which of a plurality of correction data written in a correction RAM 262 as hereafter described to correct for) is written in a selection RAM 260 by CPU 256. The selection RAM 260 is capable of writing characteristic information corresponding to the number of nozzles or 1024 (=256×4) nozzles. Image input data VDin is digital image data of serial multi-value from the image processing means 107, which is of an 8-bit width in this embodiment, wherein color component image data (8 bits) per pixel is sequentially input for pixel points in the order of Y, M, C, Bk, Y, M. C, Bk and so on. From the selection RAM 260, data is retrieved in accordance with the order of image data for input by incrementing the address in sequence. Also, there is a bidirectional buffer 263 for writing selective data into the selection RAM 260, and further a selector 259 for selecting either of lower-order 10 bits of an address in a 16-bit address bus output from CPU 258 and 10 bits output from counter 250. The counter 250 is such that a hold signal HS and a clock CLK are input from the outside, and the clock CLK is counted and output as 10-bit data. This 10-bit data or data input as the address of selection RAM 260 is used to designate a specific nozzle among the above-mentioned 1024 nozzles. As above described, the image input data VDin consists of color component image data per pixel to be input in sequence for pixels, whereby the output of a 10-bit width from the counter 250 can indicate the pixel corresponding to current image input data VDin with the clock input into the counter 250. The selector 259 selects the output of the CPU 253 when writing data into the selection RAM 260, and the output of the counter 250 when reading data from the selection RAM 260. Note that flip-flop 252 for latching data is provided on the output side of the selection RAM 260.

Figure 9:
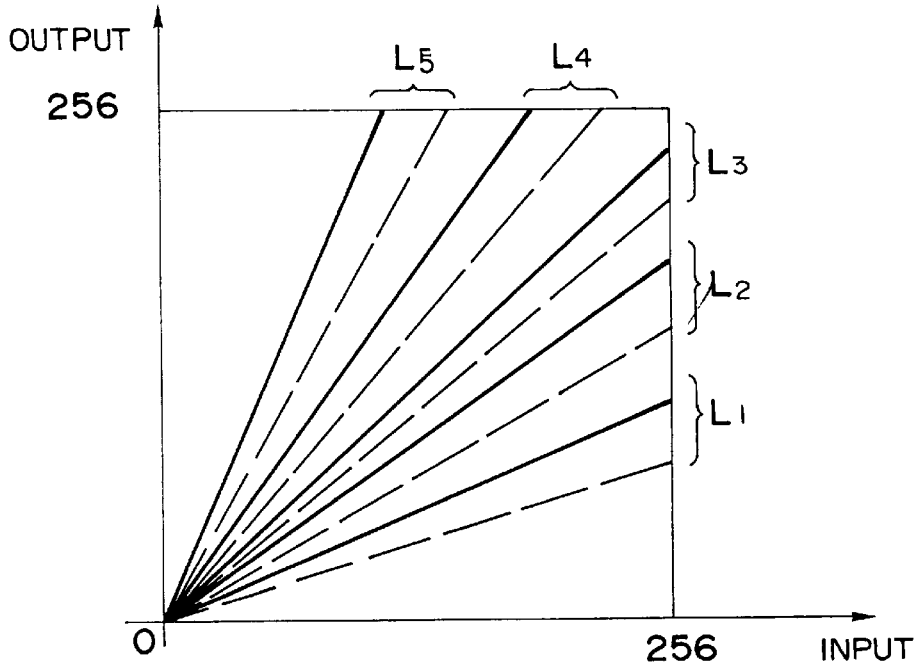
FIG. 9 is a diagram for explaining a correction table for use in head correction.

The correction RAM 262 has a correction table written from the CPU 258, and is connected via a bidirectional buffer 254 to a data bus of the CPU 258. The correction table consists of data as indicated by the solid lines or dotted lines L1 to L5 in FIG. 9, for example. Herein, the correction table containing five pieces of data as represented by the solid lines or dotted lines L1 to L5 is shown, but in practice, greater pieces of correction data are contained in the correction table. For example, if the output data from the selection RAM 260 is 8-bits long, 256 kinds of correction data can be prepared. The selector 216 selects either of a 16-bit address from the CPU and 16 bits of the summation of an 8-bit output from the flip-flop 252 and 8-bit data of image data input VDin for the input into the correction RAM 262.

The correction data represented by the solid lines or dotted lines L1 to L5 as previously described are selected in accordance with the input address for the correction RAM 262. That is, when the selector 261 selects the B side as shown, 8-bit data of image data input VDin and 8-bit data output from the selection RAM 260 are input as the address A into the correction RAM 262. In particular, the 8-bit output data from the selection RAM 260 is used to select any of the solid lines or dotted lines L1 to L5, as previously described. Note that of these solid lines or dotted lines L1 to L5, the solid line is intended for equal magnification, and the dotted line is for variable magnification. Because the range of nozzles for use in the recording heads 117 to 120 is different depending on the magnification, correction data indicated by the solid or dotted line in accordance with the range of nozzles used in the recording heads 117 to 120 is written into the correction RAM 262 by the CPU. Also, the correction table written into the correction RAM 262 is to output correction data ΔA for the address input A, wherein such correction data ΔA is once latched by the flip-flop 254, added to image input data VDin by an adder 256, and output as corrected data or image output data VDout via a flip-flop 257 for the data latch.

That is, a correction table is designated for each pixel in the selection RAM 260, the value of correction data corresponding to image input data VDin is read from the correction RAM 262, and read correction data is added to image input data VDin by the adder 256 and output as image output data VDout. A flip-flop 255 is provided to latch image input data VDin to be input to the adder 256. While correction data is represented by lines in FIG. 9, it will be appreciated that correction data may be represented by curves rather than lines.

A creation method of characteristic information as to density unevenness to be written into the selection RAM 260 will be described below.

Figure 10:
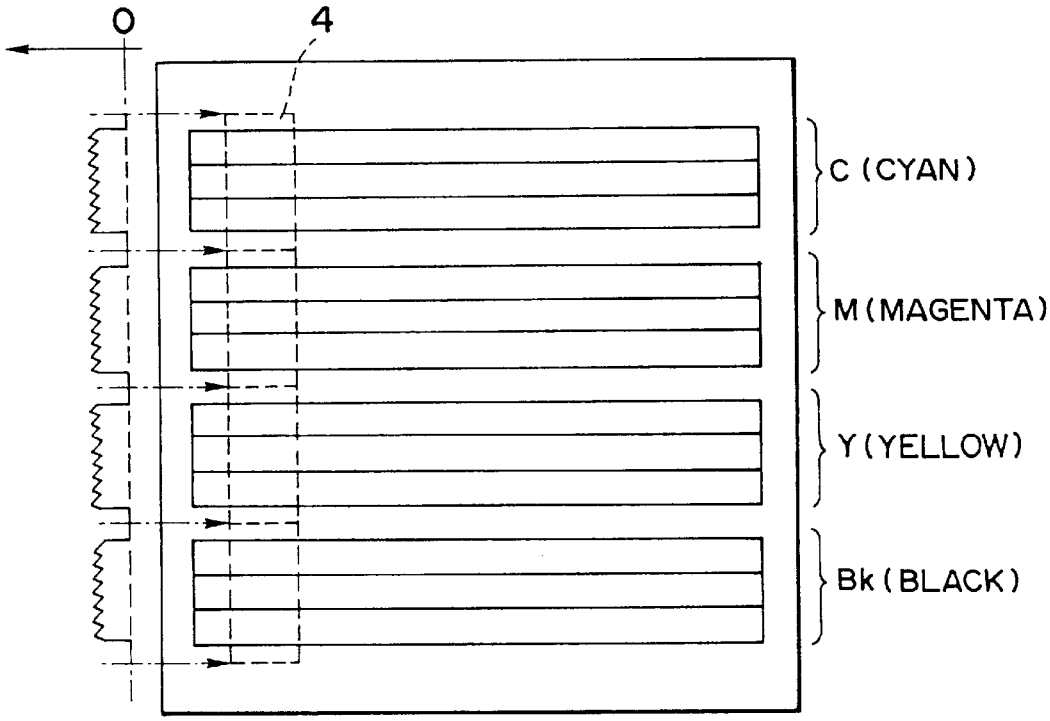
FIG. 10 is a diagram for explaining a method of correcting density unevenness.

If the correction for density unevenness is directed from the operation unit 20 connected to the image processing unit 2, characteristic information is created in the order of C, M, Y and Bk. First of all, as shown in FIG. 10, a monochromatic stripe-like gradation pattern for each of C, M, Y and Bk having arbitrary density is generated for each of three lines by a pattern generator, not shown (one line in a width recordable at a time by ink jet head 9), and printed by the image recording unit 3. The pattern generator is contained in the multi-value synthesizing unit 106, as shown in FIG. 7, to generate 8-bit data of fixed value, instead of image data from the buffer memory 110 and the input image processing until 101. Density data to be generated is 50% herein, although it can be selected from, for example, 33% , 50% and 100%. Naturally, the head correction until 123 is set to inhibit the correction, so that a bare characteristic of the recording heads 117 to 120 is directly printed.

A correction pattern for density unevenness thus output is set to the image reading device 1 to read image reading area 4 for this correction pattern, and obtain the amount of density unevenness for each nozzle in the recording heads 117 to 120, thereby creating characteristic information. The above procedure is repeated for all the recording heads 117 to 120 in the order of C, M, Y and Bk to create characteristic information which is then written into the selection RAM 260. In this way, the setting for density unevenness correction data in the head correction unit 123 is completed. After this, when outputting an actual image, correction for density unevenness is performed using that correction data in real time at all times before executing the printing.

The operation of ink jet recording unit A-2 will be described below with reference to FIG. 3.

Upon receiving a recording start signal, the operation of ink jet recording unit 1 is started. First, a pressure recovery operation is carried out with the ink jet head 9 capped. Then, a capping unit 24 of the head recovery device 13 is separated away from the ink jet head 9, and the ink jet head 9 is moved form the home position to the start position. After waiting for a while at the start position, the ink jet head 9 and the ink supply device 11 move in reciprocating motion along the guide rails 7, 8 in synchronism with an operation signal or image signal transmitted from the image processing unit 2 (hereinafter referred to as the main scan movement or simply main scan). In doing so, the ink is discharged from each of the recording heads 117 to 120 within the ink jet head 9 toward the cloths 36 held on the opposite side in accordance with an image signal, so that an image is formed on the cloths 36. If the ink jet head 9 reciprocates one time on the guide rails 7, 8, the cloth 36 is conveyed by the width of an image (i.e., a width of the cloths 36 in a conveying direction recordable by one scanning of the ink jet head 9), and then the next main scan movement is performed. If the image recording is completed after repeating the above operation, the ink jet head 9 is moved to the home position, and capped by the head recovery device 13.

By repeating the above operation over a specified length, the recording is made on the roll cloths 36. Though the length of one roll cloth is limited, it is possible to record continuously by suturing the trailing end of the roll cloth 36 with the leading end of the next roll cloth, at the time when the roll cloth 36 is about to get out of winding core 33. For such a purpose, a color string is used for the suturing, and a density detection sensor 38 is provided upstream of the presser roller 40, whereby if such a sutured part is detected by the density detection sensor 38, the recording is temporarily stopped, after one cycle of recording (one operation of the ink jet head 9 in a main scan direction) is terminated, when the sutured part is conveyed immediately before the ink jet head 9. Thereafter, the cloth 36 is further fed by fixed amounts until the sutured part reaches a position immediately downstream of the ink jet head 9, so that the recording can be restarted. By doing so, when the ink jet head 9 scans and records the sutured part being generally thickened, the ink jet head 9 is prevented from sliding on the sutured part, thereby causing stains on the cloth or damaging the ink jet head 9.

The recorded cloth 36 passes through a position opposed to the drying unit 46, whereby solvent and water content contained in the ink are removed in passing therethrough, so that it is possible to prevent the color of an image from changing due to the effect of solvent or water content when winding the cloth.

Figure 11:
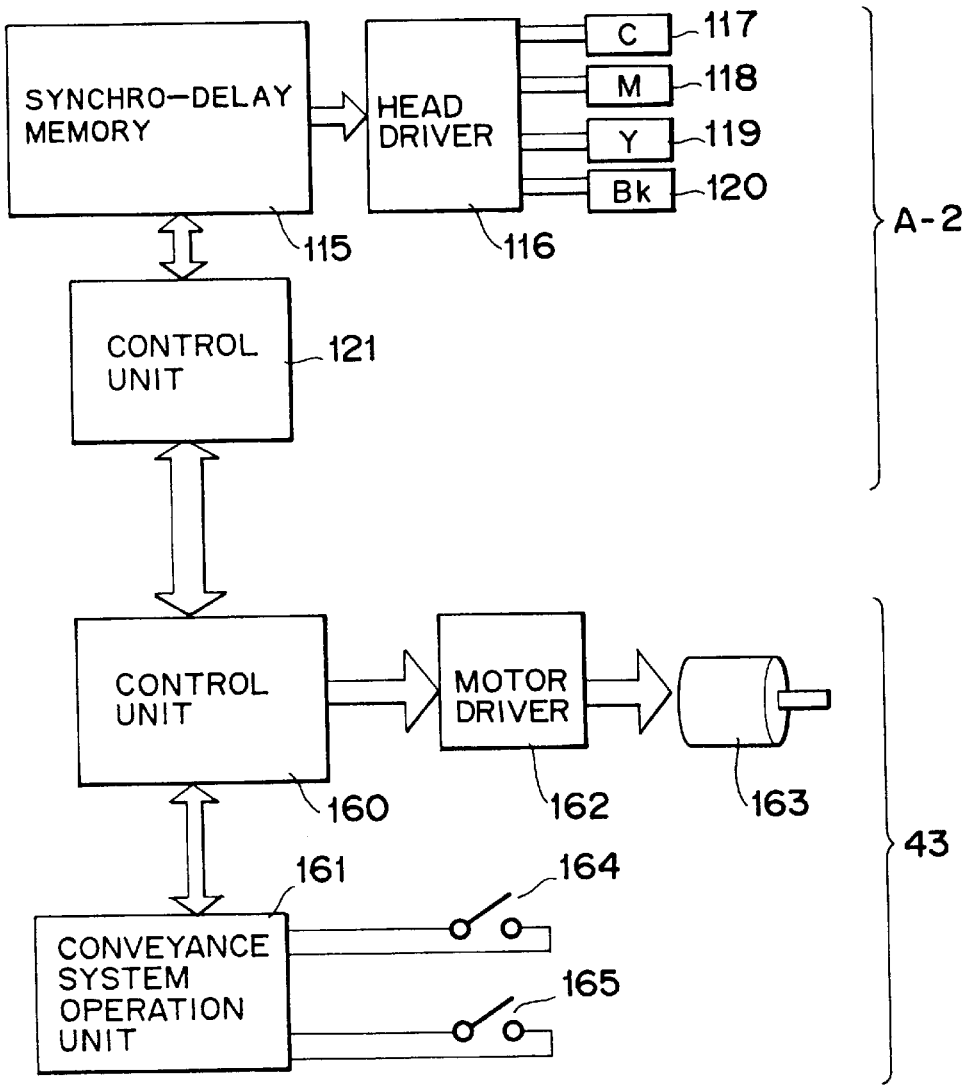
FIG. 11 is a block diagram showing a circuit configuration of an ink jet recording unit and a cloth conveying unit.

Referring now to FIG. 11, the operation of a control system for controlling the conveying operation of cloth 36 in the image recording unit 3 will be described below. FIG. 11 is a block diagram showing a circuit configuration of ink jet recording unit A-2 and cloth conveying unit 43 in the image recording unit 3.

Control unit 160 is a control circuit for controlling a cloth conveying unit 43. The control unit 160 and the control unit 121 of ink jet recording unit A-2 are connected via the communication line.

The control unit 160 is to drive a driving motor 163 via a motor driver 162, and the driving motor 162 is to drive a conveying belt 37 (FIG. 2). A conveyance system operation unit 161 connected to the control unit 160 is to operate the cloth conveying unit 43 from the outside, whereby the initialization for initiating the recording and the conveyance after recording are performed upon an instruction from the conveyance system operation unit 161.

Halt switch 164 connected to the conveyance system operation unit 161 is a switch for use in interrupting the print operation temporarily, wherein if this switch is turned on, a signal is transmitted from the control unit 160 to the control unit 121. Upon detecting this signal, the control unit 121 inhibits the print operation until this switch is turned off. The halt operation takes place when a recoverable abnormality such as no ink or sutured part with cloths joined is detected during printing. If there is no ink, the ink is refilled, or if the sutured part is encountered, the cloth is conveyed until the sutured part is located immediately downstream of the ink jet head, whereby in the normal state, the print operation is restarted by turning the halt switch 164 off. Likewise, emergency stop switch 165 connected to the conveyance system operation unit 161 is a switch to be used when the print operation is stopped at once, wherein if this switch is turned on, a signal is transmitted from the control unit 160 to the control unit 121. Upon detecting this signal, the control unit 121 stops the scanning of the ink jet head 9 (FIG. 2) at once, and terminates the print operation. Herein, instead of providing the halt switch 164 and the emergency stop switch 165, an abnormal detection signal indicating abnormality such as no ink may be transmitted directly to the control unit 121.

Figure 12:
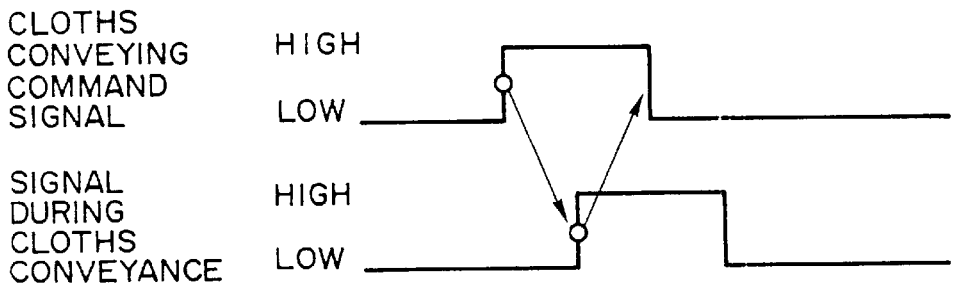
FIG. 12 is a timing chart showing the interrelation between each signal in a control unit.

The conveyance of the cloth 36 during recording is performed in accordance with a signal from the control unit 121 in the ink jet recording unit A-2. FIG. 12 shows a timing chart of the communication for conveyance between the control unit 121 and the control unit 160. Cloths conveying command signal is a signal transmitted form the control unit 121 on the ink jet recording unit 1 to the control unit 160 on the cloths conveying unit 43, wherein it is LOW in the normal operation, an becomes HIGH upon termination of one line of printing by the ink jet head 9. The control unit 160 is the cloths conveying unit 43 drives the conveying motor 63 to start the conveyance of the cloths 300, if the cloths conveying command signal becomes HIGH. Cloths in-conveyance signal is a signal transmitted from the control unit 160 of the cloths conveying unit 43 to the control unit 121 of the ink jet recording unit 1, wherein it is LOW in the normal operation, and becomes HIGH during conveyance of cloths. Upon detecting the cloths in-conveyance signal to be HIGH, the control unit 121 of the ink jet recording unit 1 determines that the cloths conveying command signal has been accepted, and turns the cloths conveying command signal LOW.

When the cloths in-conveyance signal does not become HIGH even a certain time after the cloths conveying command signal is turned HIGH, or the cloths in-conveyance signal being once turned HIGH does not become LOW even after the elapse of a certain time, the control unit 121 of the image recording unit 3 judges that an abnormality has occurred in the cloths conveying unit 43 to interrupt the recording operation, and indicate the abnormality in the operation unit 20 connected to the image processing unit 2. In this way, by interchanging the cloths conveying command signal and the cloths in-conveyance signal, the recording/printing with the ink jet head 9 and the conveyance of the cloths 36 can be alternately performed.

As above described, in this embodiment, an image signal of an original image read by the image reading unit 1 is processed in the image processing unit 2, and the ink jet recording is performed on cloths 36 in the image recording unit 3, base on a processed result of image processing unit 2, to achieve textile printing.

As above described, according to the present invention, the image is directly formed on the cloths by the use of the ink jet recording, without need of any screen plate required in the conventional textile printing, so that the processes and days taken for the printing on the cloths can be greatly reduced, and the apparatus can be made smaller. Naturally, image information for printing can be stored in the medium such as a tape, a flexible disk and an optical disk, with excellent capability of storing and preserving image information. Further, processing of original images such as coloration change, layout alteration, and enlargement or reduction can be readily made.

The ink jet textile printing apparatus of the present invention is given greater efficiency in terms of the system configuration; for example, the image reading device for reading an original image for the conversion into an image signal can be connected to the image processing unit. Also, in this invention, by enabling the image processing unit to communicate with the external computer to exchange image data, a variety of images can be recorded on the cloths.

In the ink jet textile printing apparatus for the present invention, the image recording unit for performing the recording onto the cloths can he constituted of, in addition to an ink jet recording unit, a cloths supply unit for supplying the cloths to a position corresponding to the ink jet recording unit, a cloths conveying unit for conveying the cloths to the ink jet recording unit precisely at a site opposed to the ink jet recording unit, and a post-processing unit for post-processing the recorded cloths. In this case in order to facilitate the maintenance, it is desirable that the ink jet recording unit is opposed to and separated away from the cloths conveying unit. Further, to cope with exhaustion of ink or the sutured part between cloths, it is preferable that the ink jet textile printing apparatus of the present invention is further provided with control means for halting image recording onto the cloths, and restarting image recording from image data immediately before the halted image data upon releasing of the halt.

The ink jet recording unit for use in the ink jet textile printing apparatus is not specifically limited a long as it performs the recording by jetting fine ink droplets, but in particular, by having electricity-heat converters for generating the heat energy for the ink discharge, more excellent effects can be exhibited. In this case, the ink jet recording unit may be configured to discharge or jet the ink through discharge orifices toward the cloths by the use of film boiling arising due to the heat energy applied by the electricity-heat converters.

The effects of the present invention are as follows.

(1) Because of no necessity of a textile printing plate such as silk screen plate, 1. processes and labor time for recording an original image can be greatly reduced, 2. mixing of a number of color inks corresponding to an image is unnecessary, 3. small lot production is possible, 4. preservation of recording information is easy, 5. small apparatus and installation space, 6. processing of the original image such as layout alteration, coloration change, and enlargement or reduction are easily made. (2) Owing to the use of ink jet recording, representation of image is enhanced, 1. high definition, 2. excellent color reproducibility.

(Second Embodiment)

The main configuration of an ink jet recording apparatus is the same as that shown in FIG. 2 of the first embodiment, and the explanation is omitted.

Figure 13:
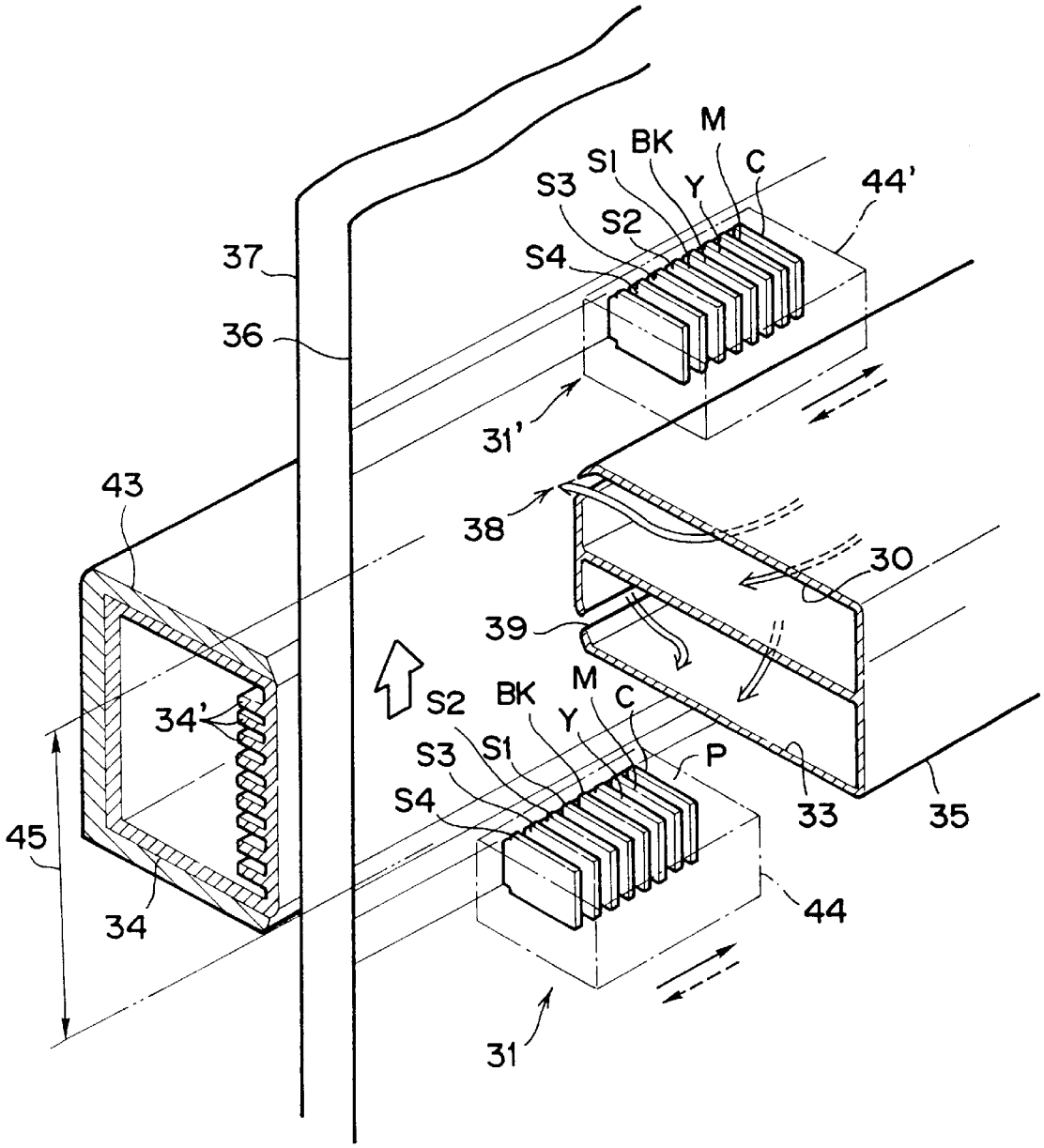
FIG. 13 is a perspective view showing the essence of a recording unit in larger scale.

Referring now to FIG. 2 and FIG. 13 which is a. perspective view showing the essence of a recording unit, this embodiment will be described below.

In FIG. 13, the cloths 36 of a recording medium are adhered to a belt 37 and fed stepwise in an upper direction as shown. In a first print unit 31 provided downward in the figure, there is provided a first carriage 44 having mounted ink jet heads of specific colors S1 to S4, as well as Y, M, C and Bk. The ink jet head (recording head) in this embodiment has elements for generating the heat energy causing film boiling in the ink as the energy used to discharge the ink, and has 128 discharge orifices arranged with a density of 400DPI (dots/inch).

Downstream of the first print unit is provided a drying unit 45 comprised of a heating plate 34 for heating from the back side of the belt, and a hot air duct 35 for drying from the front side. A heat transfer surface of the heating plate 34 is placed in contact against an endless belt 37 which is strongly tensioned to apply heat from the back side of the conveying belt 37 due to vapor of high temperature and high pressure passing through a hollow inside. The cloths 36 on the conveying belt 37 are effectively heated with the heat transfer. On the inner face of the heating plate, fins 34' for the collection of heat are provided to collect the heat on the back side of the belt effectively. The sides not in contact with the belt are covered with heat insulating material 43 to prevent the occurrence of damage due to heat radiation.

On the front side, the effect of drying the cloths is further raised by applying air of lower humidity to the drying cloths which have been subjected to dry hot air blown from a supply duct 30 on the downstream side. And the air containing sufficient moisture and flowing in the opposite direction to a conveying direction of the cloths is sucked in a greater amount than a blowing amount from a suction duct 33 on the upstream side, so that evaporated water content is prevented from harming surrounding mechanical components. A supply source of hot air is provided on the rear side, and the suction is preformed on the fore side, so that the pressure difference between a blow-off opening 38 and a suction opening 39 placed opposed to the cloths is rendered even over an entire area in a longitudinal direction. An air blowing/suction unit is offset downstream with respect to a center of the heating plate provided on the back side, so that the air may be blown to a sufficiently heated portion. Thereby, it is possible to strongly dry a quantity of water content in the ink including a reducer which the first print unit 31 has applied to the cloths.

On the downstream (upper) side thereof, thee is provided a second print unit 31' which is comprised of a second carriage 44' of the same constitution as the first carriage.

Herein, the site where the reducer head was located is used for special color (e.g., gold ink having gold fine grains suspended), for example, as a site for spare head (S). Also, a post-processing head P' which has no effects except immediately after the recording is placed at a final position as shown. This second recording unit is to record dark and sharp patterns overlapped mainly for modulation.

In FIG. 13, the cloths 36 of the recording medium are adhered to a belt 37 to be fed stepwise in an upper direction. The first recording unit 31 on the lower side is provided with a first carriage 44 having mounted ink jet heads {a total of eight heads for a head for special processing performed immediately before the recording depending on the material of the cloths or the kind of preprocessing: P, black: Bk, reducer (pre-jetted to spread the ink as jetted later): D, magenta: M1, special color of magenta type: M2, cyan: C1, special color of cyan type: C2, yellow: y (M, C, Y is in the order of causing more bleeding)} in this order. The first recording unit records mainly light image portions in a recording process (indicated by the arrow of solid line) using a reducer (transparent ink not containing dye). The recording with transparent ink is performed in such a way that for a discrete color dot, transparent ink is applied, with less transparent ink in higher density, to four to nine dots at adjacent positions around one dot of color ink including that pixel position so as to cover the dot of color ink, with less roughness on the light portions and no excessive wetting of cloths.

The recorded cloths are peeled off, dried again in a drying unit 46 comprised of a heating plate and a hot air duct, guided along a guide roll 41, and wound around a winding roll 39. The wound cloths are taken off from the main device, colored, cleaned and dried in a batch processing to provide products.

Figure 14:
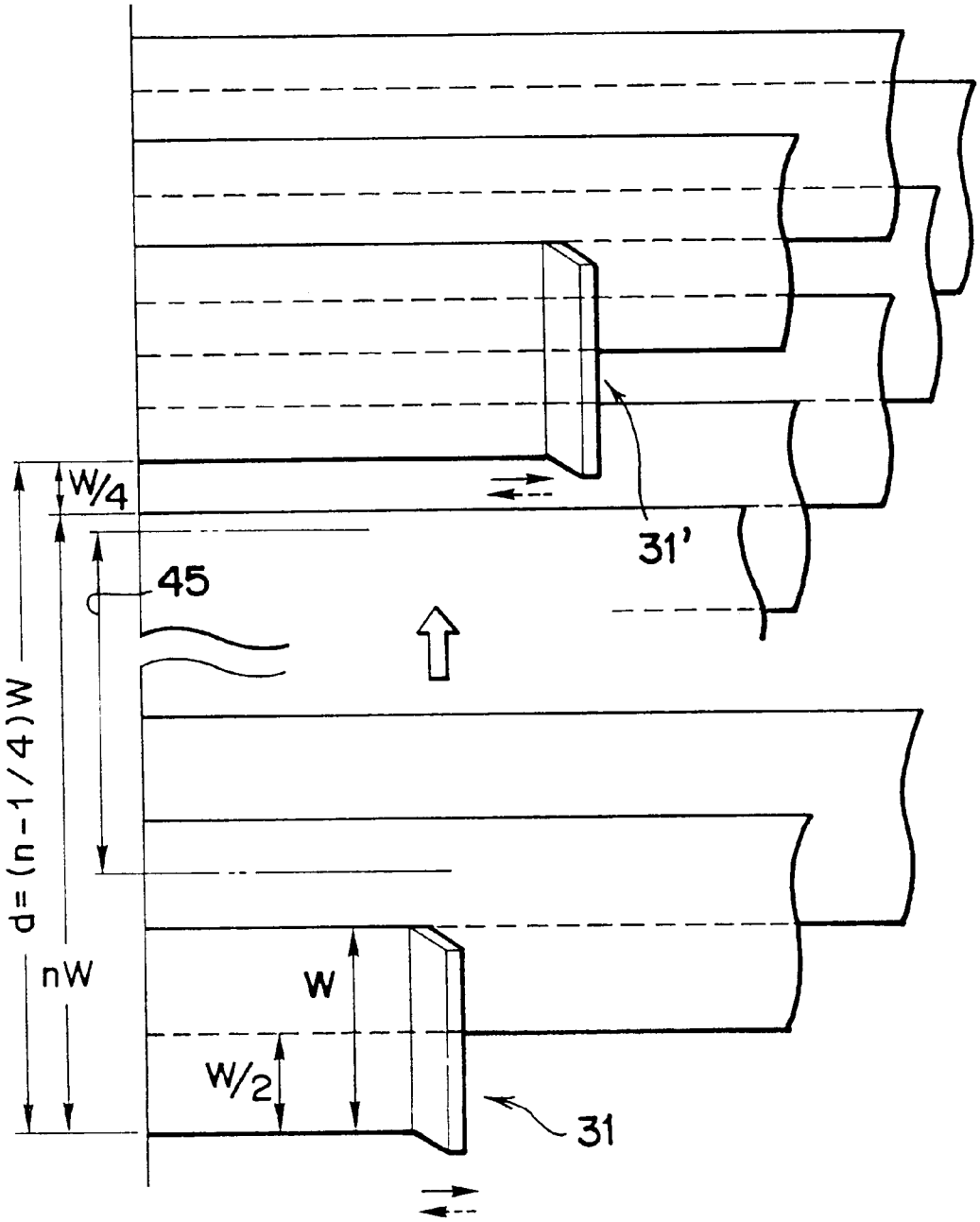
FIG. 14 is a diagram for explaining the overlap recording.

Referring to FIG. 14, an over-recording method will be described below.

As above described, eight heads are integrally formed in each recording unit, but in this figure, each head column in the recording unit is represented by only one head, for simplicity.

In this embodiment, the serial recording is first performed by the first recording unit 31 located upstream at one-fourth the predetermined final recording density (discharge amount per unit area), then the feeding of cloths is performed by a distance of half the recording width w, and the serial recording is further performed at one-fourth the final density. Thus, the overlapped area is recorded at half the final recording density. By repeating this operation, an image is recorded at half the final recording density in the first recording unit. Subsequently, the cloths are dried sequentially as above described while passing through the drying unit 45. Then, the second recording unit 31' located downstream thereof performs the over-recording, as in the first recording unit. In synthesis, a quarter the density×four times of over-recording=1, that is, recording is achieved at a predetermined recording density. Accordingly, the first recording unit intermittently records a portion of the image data and the second recording unit records any remaining image data not recorded by the first recording unit.

It is noteworthy herein that owning to the provision of the drying unit 45 between the first and second recording units, recording can be achieved at a "predetermined recording density" substantially equal to twice the conventional density (somewhat offset due to the use of thinner ink), or at a sufficient density.

The positional relation between the juncture or border in scanning in the first recording unit 31 and that in the second recording unit 31' is as follows. Though the juncture takes place at half the recording head pitch in both the first and second recording units, the juncture of the second recording part is placed directly midway between junctures of the first. recording so that junctures may not be overlapped, in this embodiment. The distance d between the first recording unit and the second recording unit and the head width w has a relation of {d=(n+¼)w n: natural number}.

Herein, there is a noteworthy problem of juncture streaks between scans.

In the serial scan for performing the recording at 100% density at a time, white streaks at 0% density or dark streaks at 200% density, but not at 100% density may arise owing to gaps or overlaps caused by various errors associated with the feed amount of cloths or ink stains, producing image defects. However, according to this embodiment of the present invention, the recording is achieved only a quarter=25% with one scanning, and covered three-folds thereon at correct density (not at juncture), so that the recording may be performed at 100% density, or at worst, to be faintly thinner at 75% density or slightly denser at 125% density. And the width of this streak is rendered roughly half because the amount of error is distributed by half. With these two effects, no juncture streaks are virtually observed.

Also, some deviations arising capriciously or streaks caused by undischarge are covered by other normal three-fold over-recordings.

That is, since according to this embodiment one pixel position is passed four times by the same color head, this pixel position can be covered with the same color up to four dots at maximum. And the operation of over-recording for two dots, drying, and next over-recording will lead to less bleeding. That is, the multi-value representation is allowed in which the dot number takes five values (gradations) of 0, 1, 2, 3, 4, rather than the binary representation of a bit or not with the normal ink jet. Since five color heads except for black are provided in this embodiment, the color representation is enabled in five gradations to the fifth power=3124 colors per pixel. This calculation assumes that 4 dots×5 colors−20 dots per pixel are allowed. However, the actual number of colors may be less than 3125 colors, because the drying process allows for the hitting of only 10 to 16 dots in one pixel without bleeding. However, with an error diffusion method, the complete gradation reproduction is possible further owning to the effects or a reducer.

A further recording unit/drying unit (pre-recording unit/pre-drying unit) may be provided upstream of the first recording unit in the above embodiment. This pre-recording unit applies a pre-treatment agent for coloring of cloths in accordance with a recording pattern, instead of the ink. The heads of the pre-recording unit are supplied with different kinds of treatment agent to adapt to a variety of materials for the cloths. After the pre-treatment agent is fixed in the pre-drying unit, recording is performed on the side treated with treatment agent in the first and second recording units downstream thereof, as in the previous embodiment. Thereby, waste of treatment agent is prevented and the use of washing drug in post-processing can be reduced. Though the ink jet textile printing itself is an ecology art which uses no dyestuff paste which will be almost washed away, further effects can be expected.

This pre-recording unit requires no great resolution. It has a half the resolution of the first/second recording unit, and rather is designed to have no undischarged and higher treatment agent resistance.

Also, another recording unit (post-recording unit) can be provided to enhance the post-processing effects.

The recording method in the first/second recording unit is not necessarily limited to the above-described one (manner of superimposing or number, juncture positions, etc.). It is a point of the present invention that one recording width is fed at plural steps, drying process is at least provided to make the over-recording, and juncture positions never coincide in the first and second recording units, whereby there are possible variations such as a) two recording units for three-fold over-recording/one drying unit, and b) three recording units for two-fold over-recording/two drying units.

The above method of a) can reduce unevenness and streaks. The method of b) can realize higher density.

Also, another method is possible in which the feed pitch is just one scan width, and the relative position in the first/second recording unit is displaced w/2. In this case, the higher recording speed is attained with a lower number of over-recordings, although the ability of covering unevenness and streaks may be decreased.

As above described, according to the present invention, the multi-graduation or multi-value can be realized, with the maximum density raised, whereby the image can be obtained with less bleeding, unevenness, streaks or roughness.

(Third Embodiment)

The third embodiment of the present invention will be described below in detail with reference to the drawings.

Figure 15:
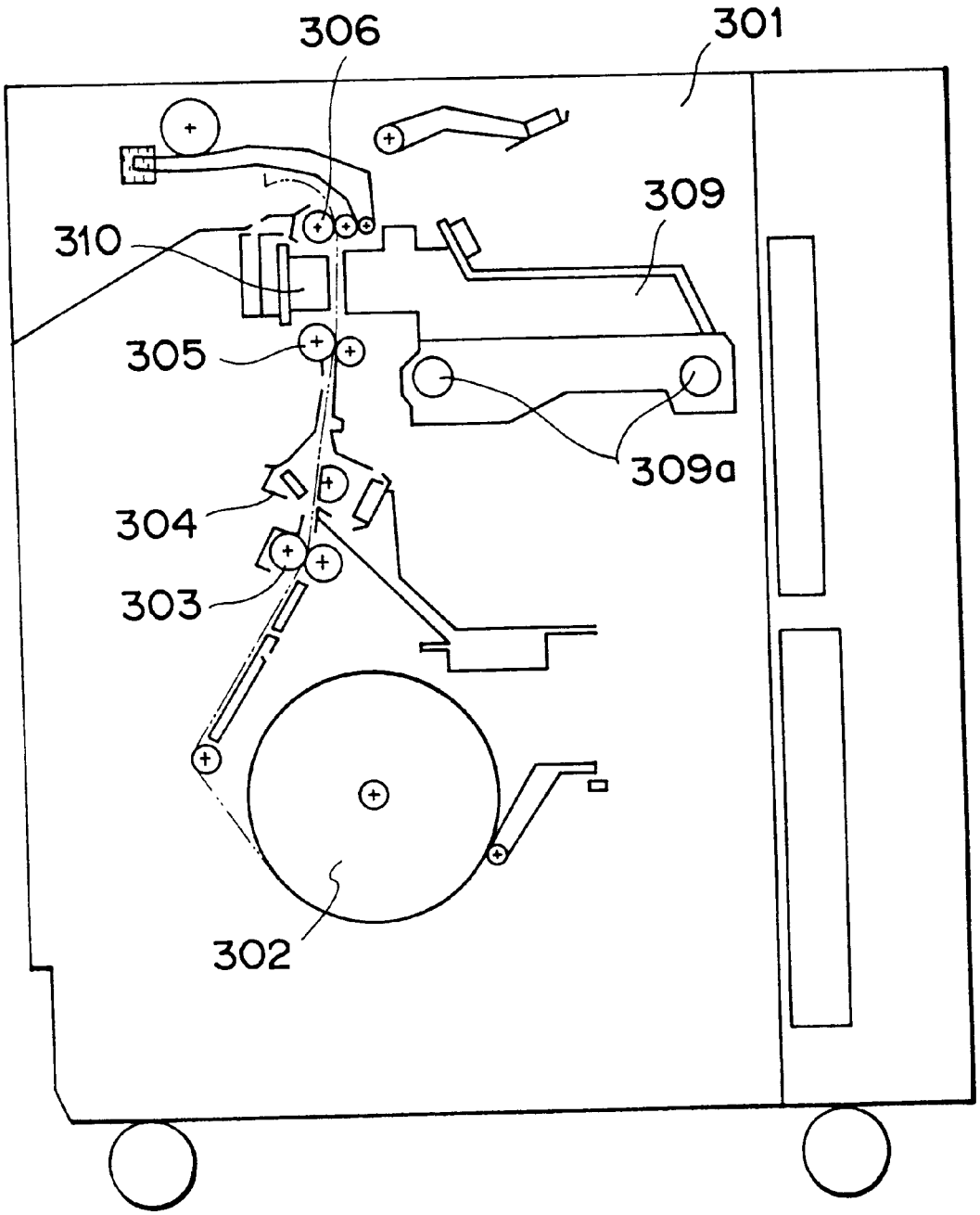
FIG. 15 is a view showing one embodiment of a recording device according to the present invention.

FIG. 15 is a cross-sectional view of a recording apparatus according to the present invention. 301 is a recording apparatus main body, 302 is a long roll as a recording medium, 304 is a cutter for cutting the recording medium a predetermined length, 303, 305 is a pair of conveying rollers for conveying the recording medium in a conveying direction, and 306 is a sub-scan roller for accurately conveying and positioning the recording medium by the amount corresponding to a recording print width of a recording head as hereafter described. With the above constitution, the conveyance passage of a recording medium to be supplied from the roll 302 is formed.

309 is a carriage for carrying a recording head as hereafter described so as to be movable in a vertical direction with respect to the drawing (a horizontal direction in the actual recording apparatus) by means of a pair of main scan rails 309*a*. 310 is a platen placed opposed to the carriage 309, with the recording medium therebetween, and further comprising suction adsorption means such as by air suction or an electrostatic adsorbing plate for preventing the recording medium from coming into contact with the recording head, as well as preventing the floating of the recording medium to be held on the plane during the printing.

Figure 16:
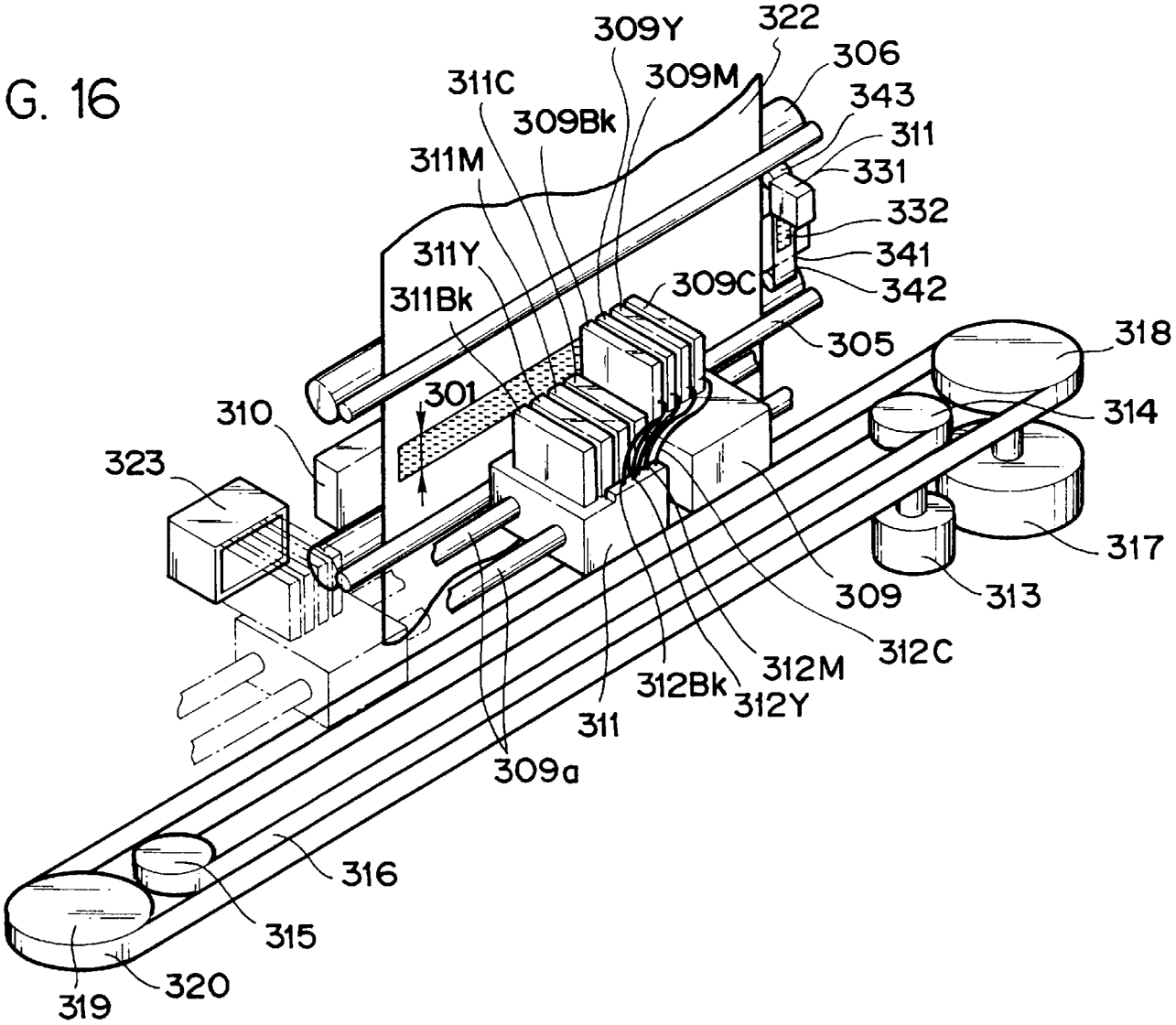
FIG. 16 is a view showing the periphery of a recording head as shown in FIG. 15.

Referring now to FIG. 16, the periphery of the recording head will be described below. The carriage 309 has recording heads 309C, 309M, 309Y, 390Bk corresponding to cyan, magenta, yellow and black. 311 is an ink supply system for supplying the ink to the recording heads 309C, 309M, 309Y, 309Bk which has ink cartridges 311C, 311M, 311Y, 311Bk corresponding to cyan, magenta, yellow and black. The ink is supplied via tubes 312C, 312M, 312Y, 312Bk to the recording heads 309C, 309M, 309Y, 309Bk by a pump, not shown. 313 is a motor for scanning and driving the carriage 309 in the main scan direction (left and right in the figure), wherein the carriage 309 is driven via a pulley 314 secured to the motor 313, a pulley 315 and a belt 316, 317 is a motor for scanning and driving the ink supply system 311 in the main scan direction (left and right in the figure), in synchronism with the carriage 309, wherein the ink supply system 311 is driven via a pulley secured to the motor 317, a pulley 319 and a belt 320.

322 is a roll of the first recording medium as previously described, which is conveyed in the upper direction as shown by the conveying roller 305 and the sub-scan roller 306. 323 is a cap member provided at a position for conducting a processing for removing the factors of decreasing image quality (hereinafter referred to as "discharge recovery processing"). With the nozzle face of recording heads 309C, 309M, 309K, 309Bk covered with the cap member 323, the ink is discharged through recording head nozzles by driving the recording heads or the application of pressure. Further, within the cap member 323, high speed air flow is introduced into recording head nozzle faces to blow off remaining ink, dirt, and fluff accompanied by the ink discharge from the nozzle faces, whereby the nozzle faces are cleaned off to eliminate undischarge and unevenness.

331 is a monitor for monitoring the recording state with the recording head, or a predetermined test pattern 332 (uniform density pattern) of a test image which is recorded at a predetermined interval on a second recording medium 341 dedicated for the monitor provided at one end of the platen 310.

The monitor recording medium 341 as previously described is supplied onto the platen 310 by the supply roll 342, in synchronism with the printing of predetermined pattern 332, and after printing, is wound through the monitor 331 around a winding roll 343. The monitor recording medium 341 uses a recording paper for the ink jet. An example of the recording paper for the ink jet includes a paper in which polyvinyl aqueous solution having silica powders or alumina grains mixed thereinto is applied on the surface of paper and then dried (e.g., see Japanese Laid-Open Patent Application No. 2-43083). Such treated recording paper is less liable to bleed with the ink than the normal untreated recording paper, and is suitable as the second. recording medium for the monitor in this invention.

The interval (recording interval) of the above predetermined pattern is based on the completion of recording a unit pattern or the length in a sub-scan direction (a conveying direction of a recording medium) corresponding to the unit pattern, because if the textile printing is performed, for example, recording is often repetitions of a unit pattern, whereby it is possible to decrease the incidence of defectives in the textile printing due to undischarge. The recording of the above predetermined pattern may be performed every time the recording for a predetermined number of lines is terminated. In this case, the predetermined number of lines as above indicated is appropriately determined depending on the liability to undischarge of a recording head and the surface conditions of cloths. Also, if the calibration is made for every line, abnormality detection is enabled in real time, while it is made for every one of predetermined lines, the recording speed will not decrease in recording.

It should be noted that the interval of predetermined pattern 332 may be increased or decreased as necessary, because there is some difference in the liability to ink undischarge depending on the kind of textile printing ink. It is supposed that the predetermined pattern 332 is a solid pattern in which the recording frequency is set at 50% of the normal frequency, for example.

Figure 17:
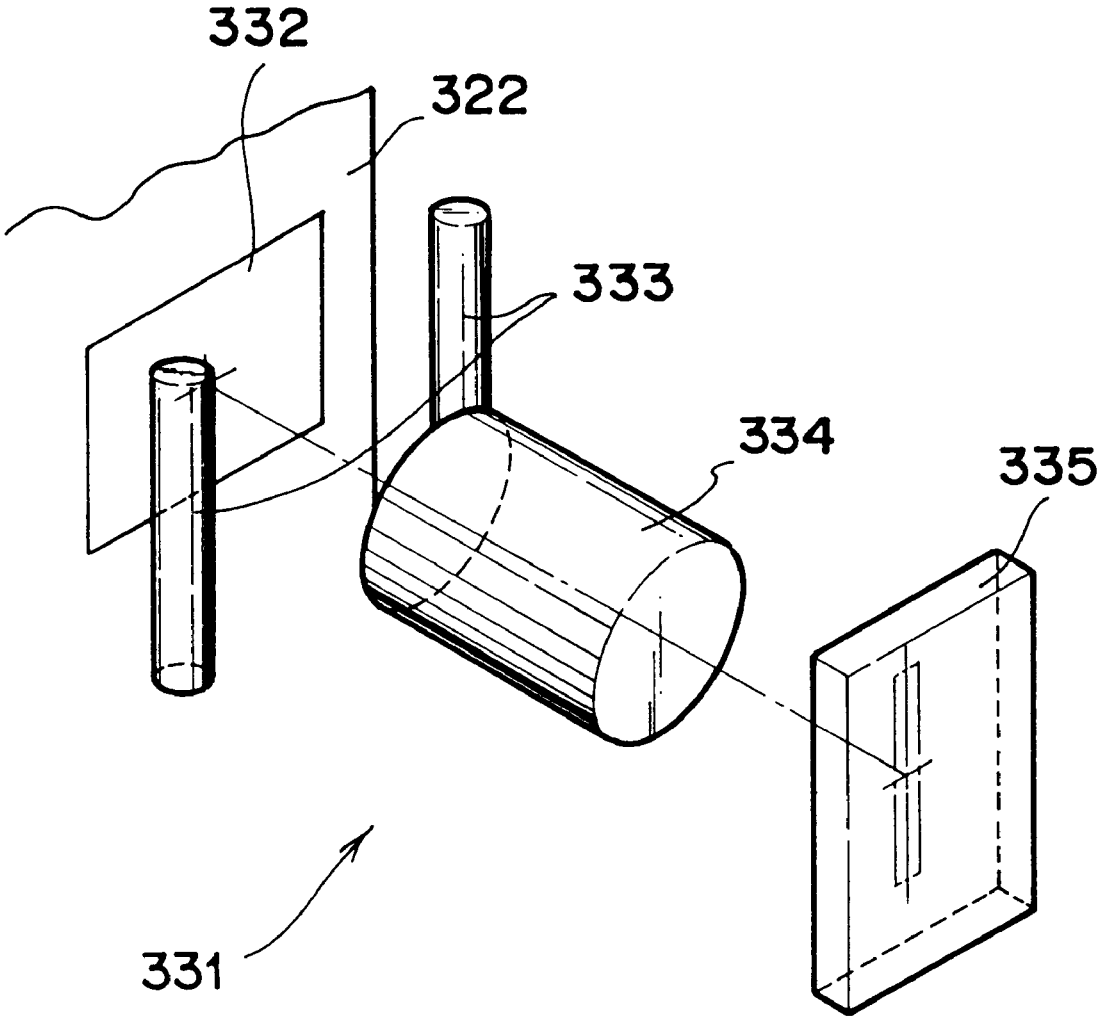
FIG. 17 is a view showing a monitor of FIG. 16.

Referring now to FIG. 17, monitor 331 will be described below in detail. In the same figure, 332 is a calibration pattern recorded on the monitor recording medium at a predetermined interval, which is printed for one scan in each color of cyan, magenta, yellow and black and at uniform density. 333 is a pair of illumination lamps for illuminating the calibration pattern 332, 334 is a projection lens for projecting the calibration pattern 332 illuminated by the illumination lamps, and 335 is a sensor such as a CCD for making the photoelectric conversion of the calibration pattern 332 projected by the projection lens 334. The number of elements is desirably greater than the number of recording elements in the recording head. Based on the output from the sensor 335, undischarge of the recording head, or print unevenness beyond a predetermined amount is detected, and if necessary, the discharge recovery processing as previously described is carried out.

Referring now to FIGS. 15 and 16, a normal recording sequence will be described below. In FIG. 15, if a recording medium conveyed from the roll 302 is detected by a recording medium detection sensor (not shown) located immediately before the conveying roller 305, the conveying roller 305 and the sub-scan roller 306 on the conveyance passage are driven by a predetermined amount, that is, until the leading end of the recording medium reaches the sub-scan roller 306.

In FIG. 16, is the leading end of recording medium 332 is conveyed to the sub-scanning roller 306, the carriage 309 an the ink supply system 311 are driven in a scan direction (to the right in the figure) by the motors 313, 317, respectively. Along with this, the recording heads 309C, 309M, 309Y, 309Bk perform the recording in a print width as indicated by 301 in the figure, based on the image signal.

After the line printing, the carriage 309 and the ink supply system 311 are driven back to the predetermined positions to the left in the figure, the recording medium 322 is conveyed accurately by the print width 301 by a motor 321.

After the above sequence of printing and conveying the recording medium is repeated a predetermined number of cycles, the recording medium 322 is exhausted out of the apparatus.

Figure 18:
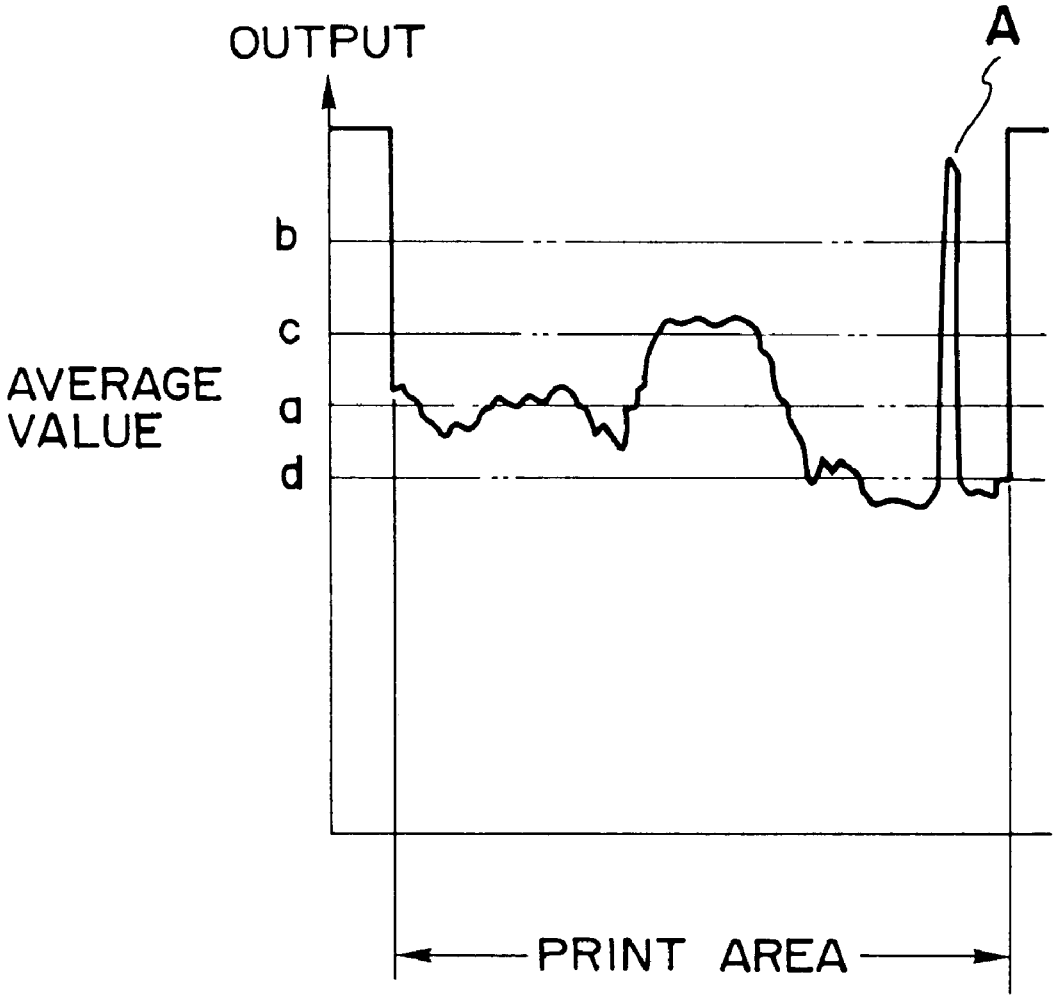
FIG. 18 is a diagram showing a sensor output of the monitor.

Next, motor 331 will be described. FIG. 18 shows an output signal of the sensor 335 in the monitor 331. The axis of abscissa corresponds to each pixel of sensor 335, and the axis of ordinate represents the output corresponding to each pixel. The output of the sensors 335 is corrected or so-called shading corrected, with the recording medium before pattern printing as the white level. The output of each pixel corresponds to each nozzle of the recording head, thereby allowing for the measurement of the discharge amount from each nozzle.

If there is at least one output beyond value b which is a greater a predetermined amount than the average value a over the pixel outputs, undischarge is judged. Also, if there is at least an output beyond value c which is greater a predetermined amount, or below value d which is greater a predetermined amount, or below value d which is smaller a predetermined amount, than the average value a, unevenness is judged. Empirically, the slice level b for undischarge detection is a value about 50% greater than the average value a, an the slice level c, d for unevenness detection is desirably about 5% to 10% greater or smaller than the average value a.

The judgment of unevenness is not limited to the above method, but for example, a method based on whether the slice level is greater or smaller than the standard deviation over each pixel output of the sensor, or the sum of absolute values of the difference between adjacent pixels, i.e., $A=\Sigma|ai-ai+1|$, with each pixel output of the sensor being ai.

The value of unevenness correction corresponding to each nozzle of the recording head may be directly an output value of each pixel of the sensor 335 as above described, but the average value over adjacent pixels, for example, three pixels before and after, of each pixel output from the sensor may be a pixel output to reduce the effects of noise.

Note that the calibration sequence of detection for discharge and unevenness, and discharge recovery processing is executed under the control of a control unit (not shown) for controlling the whole recording apparatus. This control unit is provided with CPU such as a microprocessor, a ROM for the storage of control programs and various data, and a RAM for use as the work area of the CPU.

Figure 19:
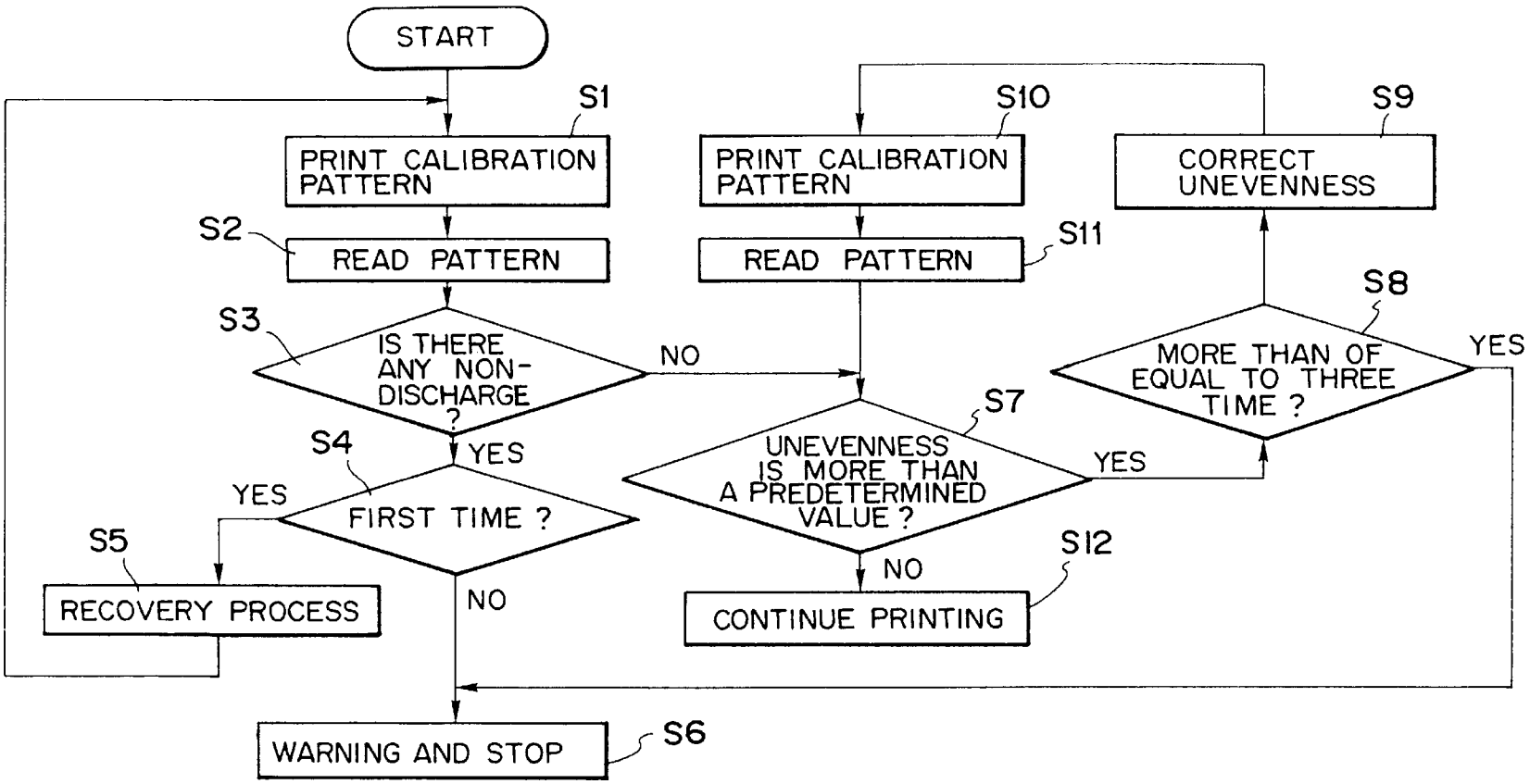
FIG. 19 is a flowchart showing the operation sequence in the embodiment.

FIG. 19 is a flowchart showing a calibration sequence of the detection for undischarge and unevenness and the discharge recovery processing which are performed by the CPU. Control programs for executing these processings are stored in the ROM.

First, in a printing sequence as previously described, a calibration pattern is printed at a predetermined interval (step S1). The calibration pattern is read by motor 31 (step S2), and undischarge is judged with the algorithm as previously cited (step S3).

If undischarge is judged, execution for recovery processing is judged (step S4). The judgment at step S4 is made whether or not recovery processing has been already done in this sequence. This is based on a empirical fact that if the discharge recovery processing is properly performed, almost all discharge phenomena can be eliminated. After the recovery processing is performed (step S5), the procedure returns to step S1, and then conducts printing of the calibration pattern (step S1), reading of the pattern (step S2), and judgment of undischarge (step 3). And if undischarge is judged again at step S4, a warning is displayed as head trouble without recovery processing, and the operation of the apparatus is stopped (step S6).

On the other hand, if undischarge is not judged at step S3, unevenness is judged based on an unevenness determination algorithm as previously described (step S7). If unevenness is not judged, the printing is continued (step S12). If unevenness is judged to be equal to or greater than a predetermined value at step S7, execution for unevenness correction processing is judged (step S8), and if necessary, unevenness correction processing is performed (step S9). The unevenness correction processing at step S9 is to correct for a drive signal (signal width or voltage) of a corresponding recording head, based on an output signal of a pattern read at step S2. The same pattern of uniform density as that printed at step S1 is printed upon the drive signal after correction (step S10), and read by the monitor 331 (step S11).

A sequence of these steps S7, S8, S9, S10, S11 is repeated by predetermined times (three times in this embodiment), and if unevenness is still present, a waving is displayed as recording head trouble, and the operation of the apparatus is stopped (step S6). This is based on an empirical fact that if more unevenness correction sequences are performed, greater effects of unevenness correction can be expected, but by repetition of three times, sufficient effects in practical use condition can be obtained, while if unevenness is still remarkable after such unevenness correction processing by three times, it is considered in most cases that there is trouble with the recording head such as life of the recording head.

If this series of calibration sequences are likewise performed for each color of cyan, magenta, yellow and black, it is possible to retain the discharge condition of each recording head excellent without assistance. Accordingly, it is possible to enhance the availability of the apparatus even by driving without an operator, which is particularly effective to record on a long recording medium such as cloths.

While the above embodiment relies on, but is not limited to, the use of cloths are the first recording medium, it is also applicable to a recording medium susceptible to discharge unevenness with the recording head such as blotty paper or a recording medium having patterns pre-arranged on the surface. Examples of the cloths in this invention include the cloths such as woven or non-woven fabrics made of cotton or silk.

As above described, according to the present invention, because unevenness of a recording head is emphasized or the ink is more liable to bleed due to texture of fibers on the cloths or regenerated papers, a test image is recorded on the recording medium for monitoring and read by a monitor to judge a discharge condition of the recording head, even when the recording is performed on the recording medium making inconspicuous undischarge of the ink from the recording head, whereby correct grasping of discharge conditions is made possible irrespective of the kind or property of recording medium, and unevenness correction and discharge recovery processing are appropriately allowed, so that the recording can be performed in the best discharge conditions at all times.

Further, because the operation can be stopped by judging the unrecoverable state, it is possible to suppress the occurrence of defective recordings to the minimum even by the driving without an operator.

(Fourth Embodiment)

Figure 20:
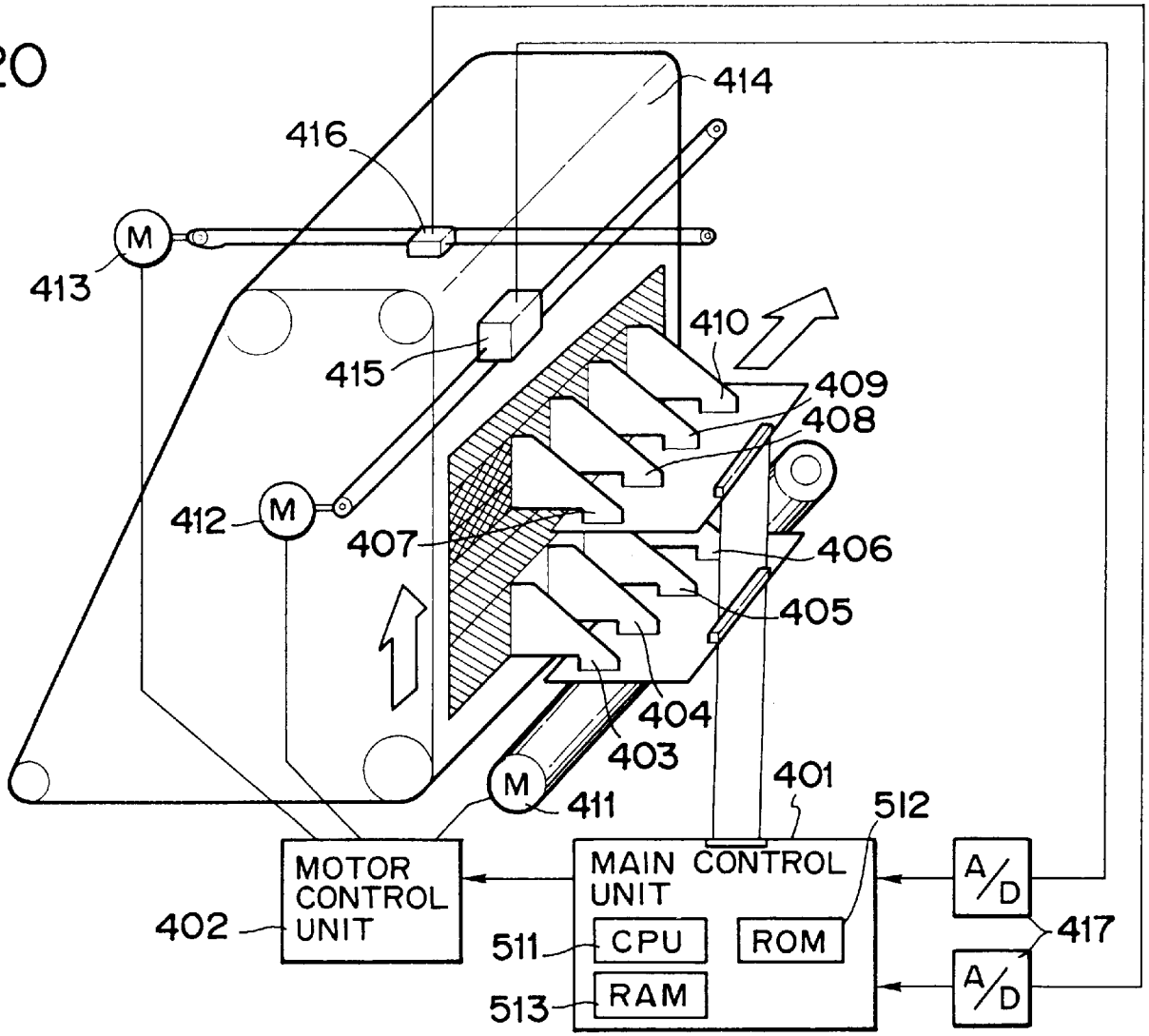
FIG. 20 is a view showing a configuration of a main part of an ink jet printer in one embodiment.

FIG. 20 is a view showing schematically an ink jet printer according to this embodiment.

In FIG. 20, 401 is a main control unit for controlling the whole ink jet printer. This main control unit 401 includes a CPU 511 such as a micro-processor, a ROM 512 for the storage of control programs of the CPU or various data, and a RAM 513 for use as the work area and the temporary storage of various data. 402 is a motor control unit for driving in rotation a carriage motor 411 and motors 415, 416 for the movement of sensors in accordance with an instruction of the main control unit.

Each of 403 to 410 is a multi-nozzle ink jet head (hereinafter simply referred to as an ink jet head) for discharging each color ink, wherein ink jet heads 403 to 406 are located upstream of recording medium 414 (recording paper, cloths) in a conveying direction, and 407 to 410 are located downstream thereof. 403, 404, 405 and 406 are ink jet heads for cyan, magenta, yellow and black, respectively. Also, 407, 408, 409 and 410 are ink jet heads for cyan, magenta, yellow and black, respectively.

411 is a carriage motor for scanning a carriage having the ink jet heads mounted thereon, 412 is a motor for moving a sensor 415, and 413 is a motor for moving a sensor 416. 415 is the sensor for reading an image recorded on the recording medium 414 while moving in parallel to the movement direction of the ink jet head, and 416 is the sensor for reading a recorded image while moving in parallel to the arrangement direction of nozzles for the ink jet head (movement direction of recording medium 414). 417 is an A/D converter for inputting a signal from each sensor 415, 416, and converting it into a digital signal for the output to the main control unit 1.

Figure 21:
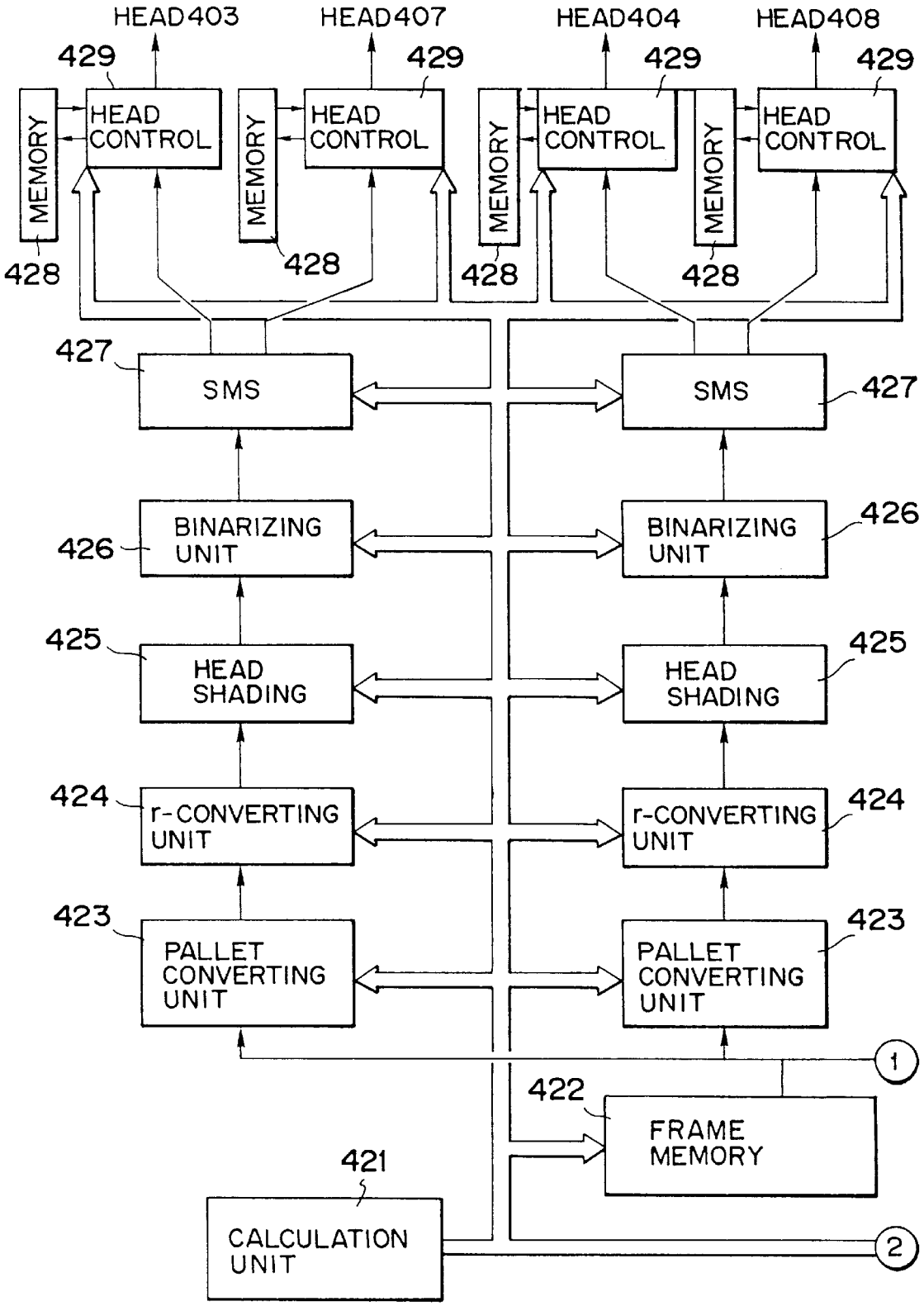
FIG. 21 is a block diagram showing a configuration of a main control unit of the ink jet printer in one embodiment.
Figure 22:
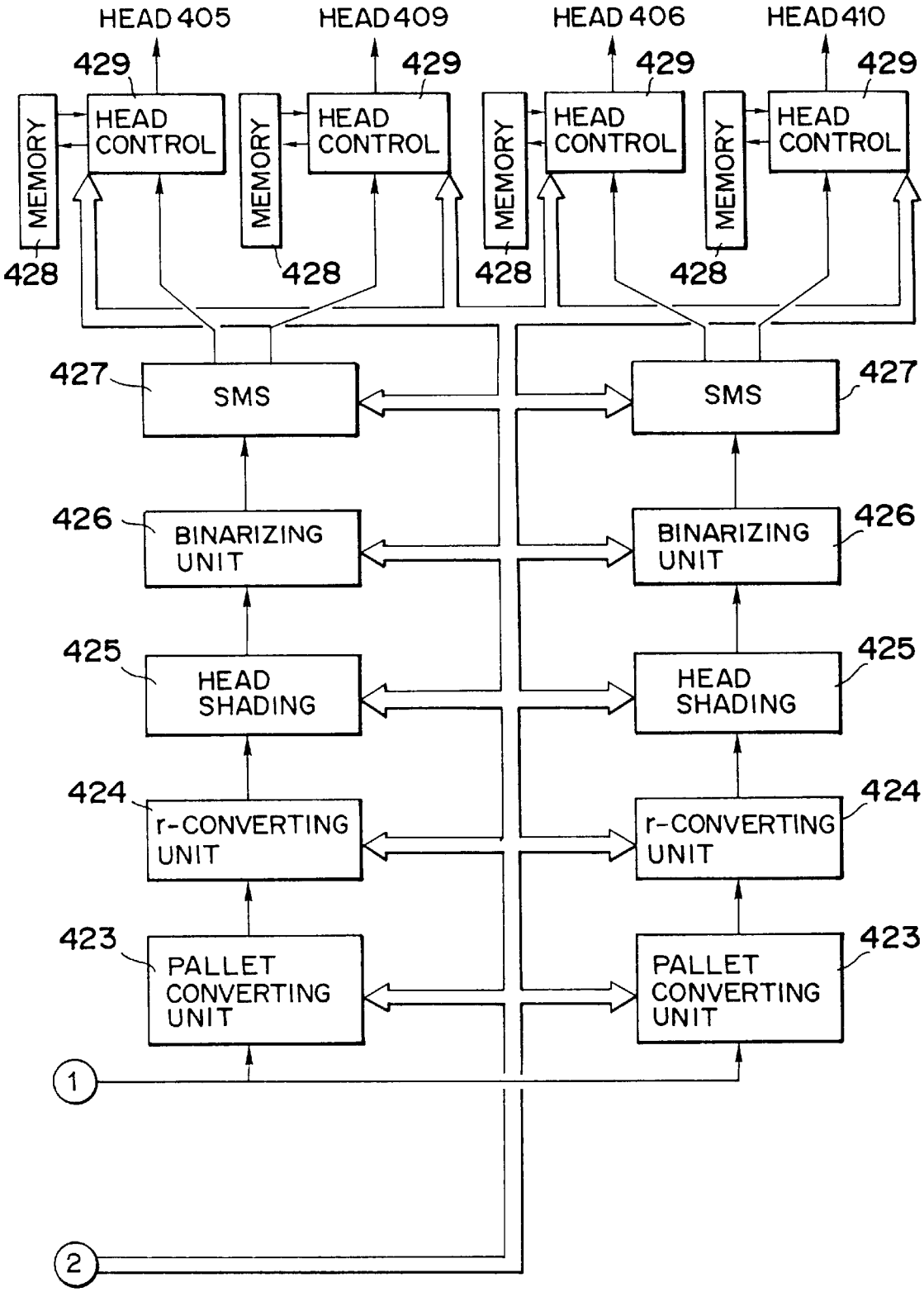
FIG. 22 is a block diagram showing a configuration of a main control unit of the ink jet printer in another embodiment.

FIGS. 21 and 22 are block diagrams each showing a configuration of the main control unit in the ink jet printer according to this embodiment.

In FIGS. 21 and 22, 421 is a calculation unit for calculating a set amount for registry adjustment based on the value read from the sensors 415, 416. 422 is a frame memory for the storage of image data, 423 is a pallet converting unit for separating image data of each color, 424 is a gamma converting unit for making the record correction, 425 is a head shading unit for making a correction for each multi-nozzle, 426 is a binarizing unit for converting multi-valve data for recording into binary data, 427 is an SMS unit for separating recording data into those for upper and lower ink jet heads, 428 is a memory for the storage of binary data to be recorded, and 429 is a head control unit or controlling the recording with each ink jet head by supplying recording data to the ink jet head.

Image data output from the frame memory 422 is separated for each color by the pallet converting unit 423, and image data of each color is passed through the gamma conversion and the head shading. Further, it is converted into ordinary data by the binarizing unit 426, separated for each head by the SMS unit 427, and stored in the memory 428. Recording data stored in the memory 428 is read from the memory 428 by the head control unit 429, and supplied to each ink jet head for the recording. Note that the recording data stored in the memory 428 are recorded for a plurality of recording bands.

Figure 23:
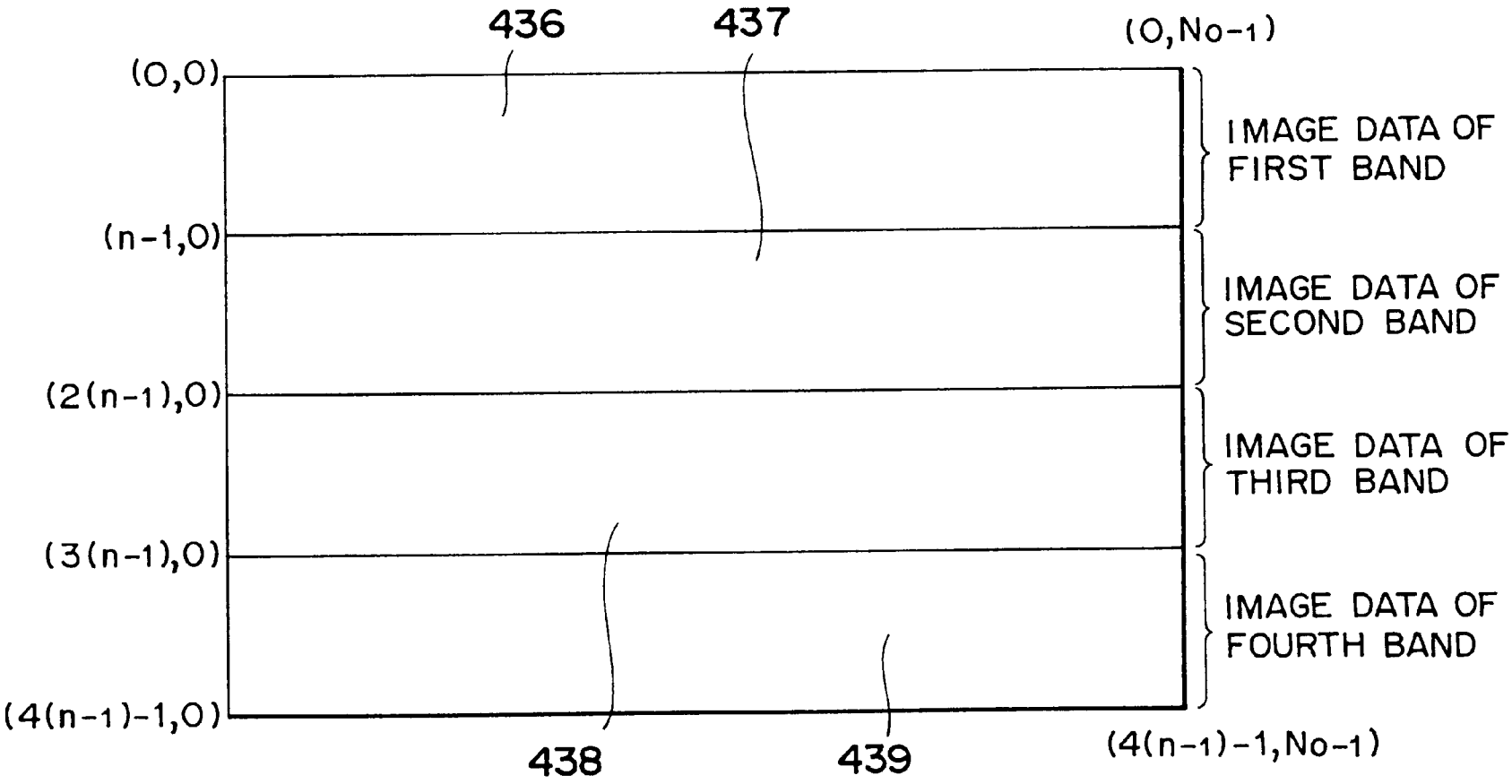
FIG. 23 is a diagram showing a memory map of a frame memory for storage of recording data corresponding to each band.

FIG. 23 is a view for explaining the state of recording data stored in the memory 428. In FIG. 23, n indicates the number of nozzles in each ink jet head, and No indicates the number of recording lines per band. 436 to 439 each indicate a memory area for the storage of each band data.

Figure 24:
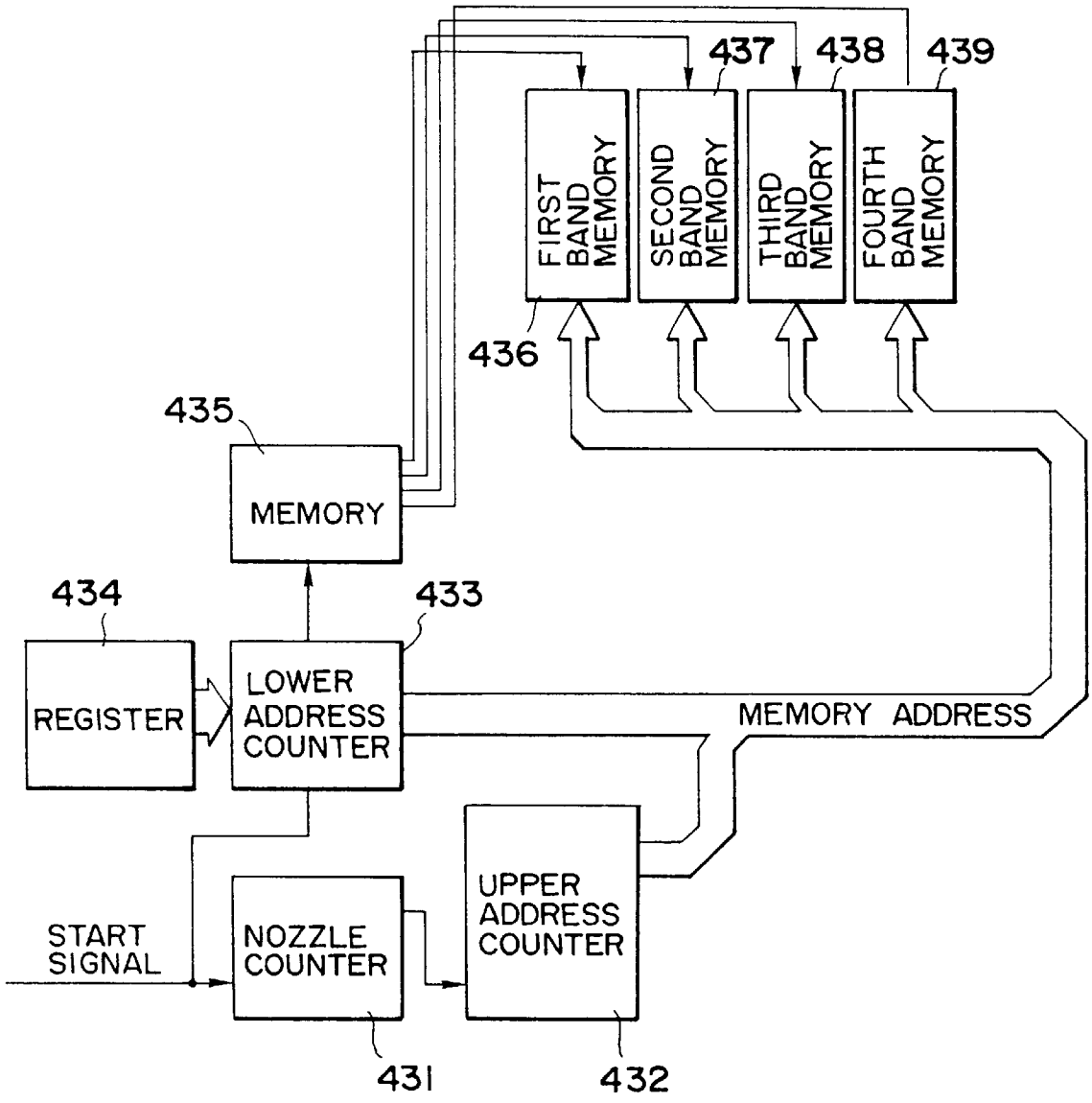
FIG. 24 is a diagram for explaining a circuit configuration for use in controlling the reading start position of recording data from the frame memory.

With this configuration, registration of each ink jet head in the longitudinal direction can be made by designating the position of reading recording data in the memory arrangement as shown in FIG. 23, when read from the memory 428. For example, in FIG. 23, if the reading start is (n−1, 0), next recorded data is image data in the second band. Herein, if the position of the ink jet head is deviated one pixel in the longitudinal direction, the positional deviation in the longitudinal direction is eliminated to record the image by setting its reading position to (n,0). FIG. 24 is a block diagram showing a schematic configuration of a memory reading circuit contained in head control unit 429.

In FIG. 24, 431 is a nozzle number counter for counting the number of nozzles for each ink jet head. 432 is an upper address counter, and 433 is a lower address counter, wherein the upper and lower address counters 432, 433 allow access to each band memory in the memory 428. 434 is reading start position set register, wherein an address set in this register 434 is set to the lower address counter 433 to determine a lower reading address. 435 is a memory selection signal generation circuit for outputting a signal indicating which of band memories 436 to 439 to read. 436 to 439 is a band area in the memory 428. 436, 437, 438 and 439 are memory areas for storing image data for the first, second, third and fourth band, respectively.

With the above configuration, a reading start position is first set to the register 434. The value to be set to this register 434 is a value in accordance with a deviation associated with the positional deviation of upper and lower ink jet heads, which deviation is obtained with a method as will be described later. The start signal is a timing signal indicating the reading start of each band, wherein upon the start signal, the content of register 434 is set to the lower address counter 433, and reading of recording data from each memory is started based on its lower address. Herein, assuming that the nozzle number for each ink jet head is 256, lower 8 bits of the lower address counter 433 are output as the lower address.

On the other hand, the upper address counter 432 is incremented by +1 every time the nozzle counter 431 counts "256", wherein the output of this upper address counter 432 is an address in the X-axis direction in a memory map as shown in FIG. 23. And the lower address output from the lower address counter 433 indicates a read address in the Y-axis direction (longitudinal direction) as shown in FIG. 23, wherein if the number of nozzles (n=256) in the ink jet head is counted, the memory selection signal circuit 435 is activated to select the next band memory area.

In this way, by changing the value to be set to the register 434, the registration in the longitudinal direction can be made.

An automatic judgment method for adjustment value for registration in the longitudinal direction will be described below.

Figure 25A:
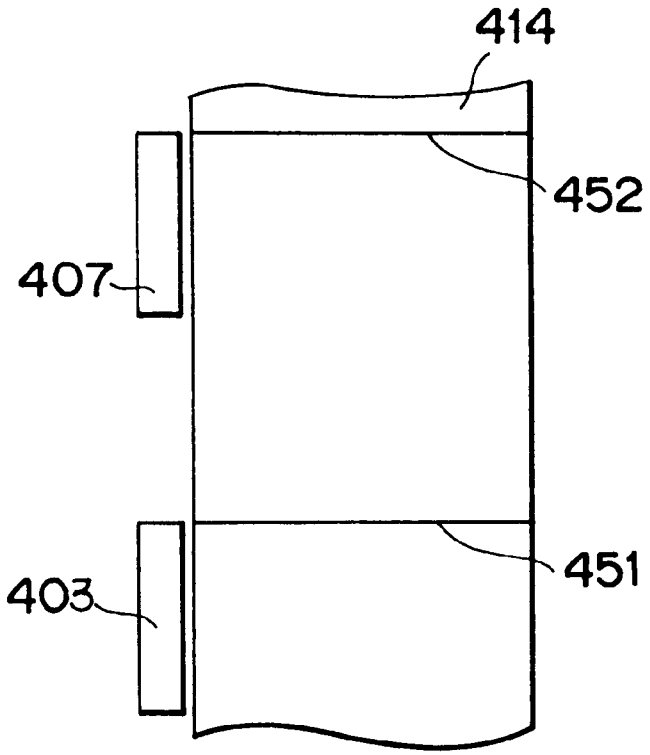
FIGS. 25A and 25B are views showing the print examples of longitudinal registration adjusting patterns in one embodiment of the ink jet printer.
Figure 25B:
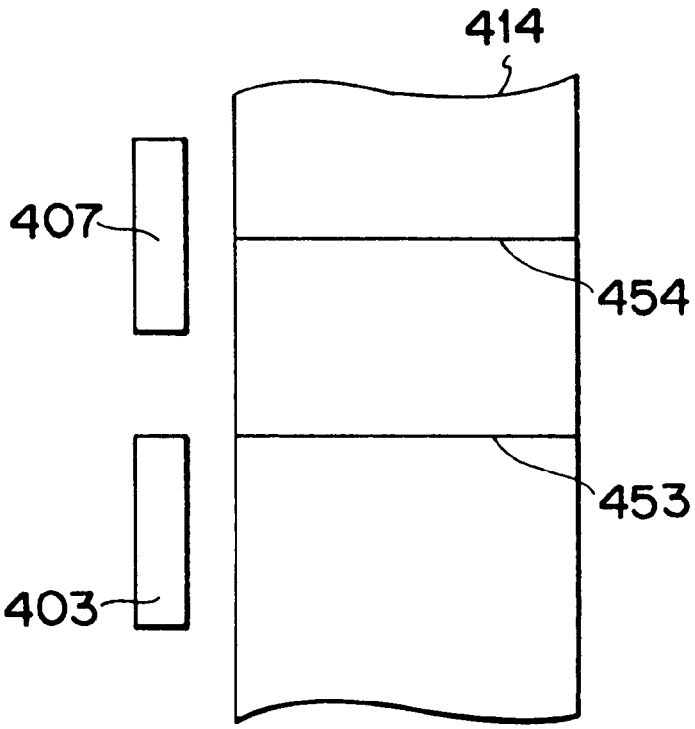
Figure 26:
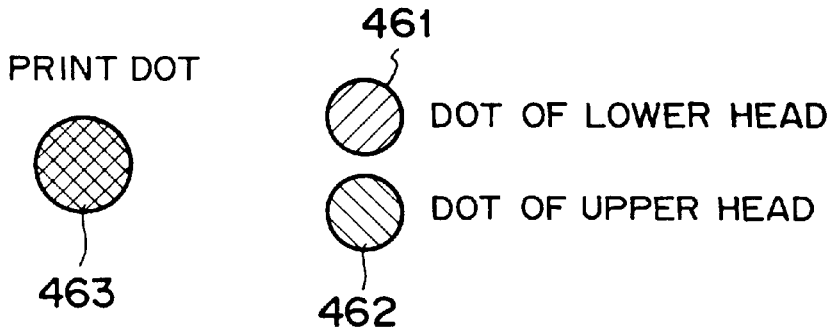
FIG. 26 is a view showing an example in which the recording dot positions by the upper and lower heads coincide.

FIGS. 25A and 25B are views showing examples of recording the pattern for registration in the longitudinal direction.

In FIGS. 25A and 25B, 403 is a lower cyan head and 407 is a upper cyan head. While the ink jet heads for cyan 403, 407 are described herein, it will be understood that the ink jet heads for other colors can be realized in the same way.

In FIG. 25A, there is provided an interval of the recording width of one head (corresponding to n nozzles) between the ink jet heads 403, 407, and in FIG. 25B, there is an interval equal to half the recording width of one head between the upper and lower ink jet heads 403, 407. In FIG. 25A, recording is first performed only by the first nozzle (top nozzle) of the lower ink jet head 403 to record the line as indicated by 451. Next, the recording medium 414 is conveyed by a predetermined amount, and recording is performed only by the first nozzle (top nozzle) of the upper ink jet head 407 to record the line 452.

In FIG. 25B, recording is first performed only by the first nozzle of the lower ink jet head 403 to record the line 453. Next, the recording medium 414 is conveyed by a predetermined amount, and recording is performed only by a central nozzle of the upper ink jet head to record the line 454. This nozzle is the n/2-the nozzle if the number of nozzles in each ink jet head is n. In this way, by recording each line using the upper and lower ink jet heads 403, 407, each line recorded by each ink jet head is overlapped if the registration of these ink jet heads 403, 407 is accurately made.

Figure 27:
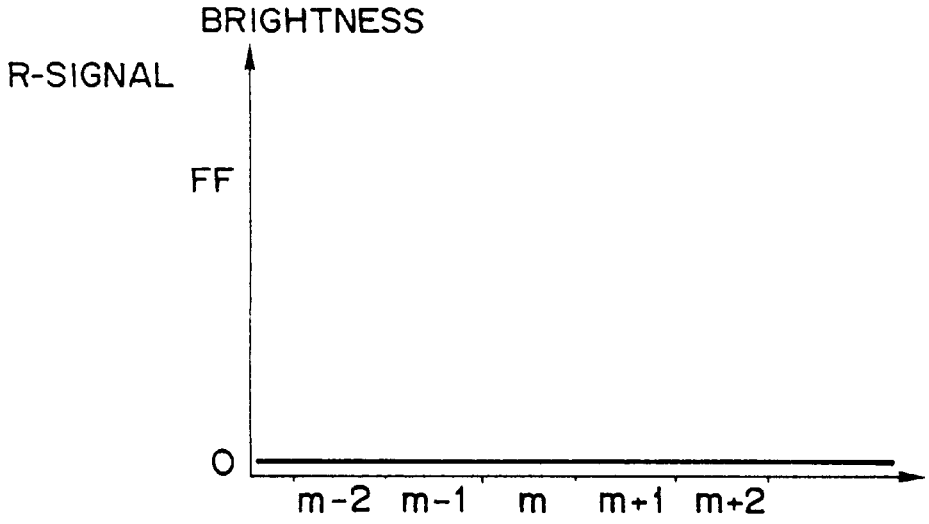
FIG. 27 is a diagram showing an output example (R component) from the sensor, when recording dot positions by the upper and lower cyan heads coincide.
Figure 28:
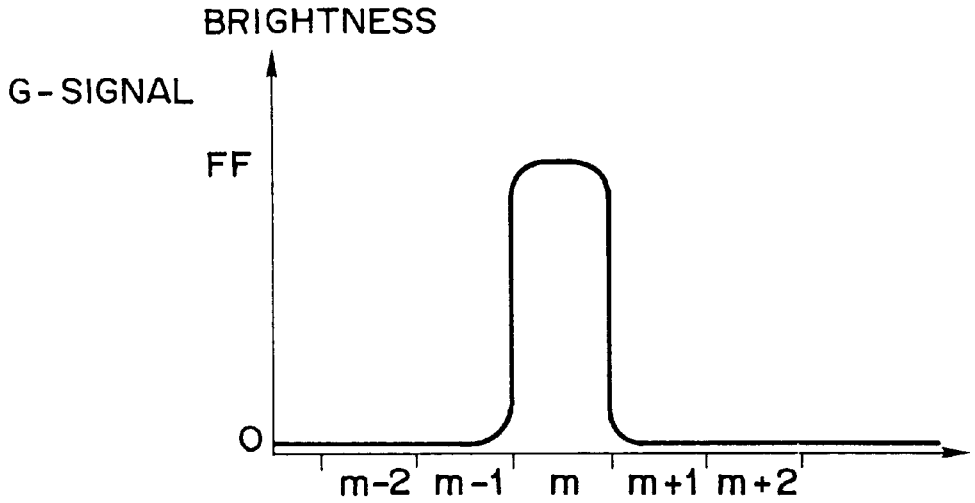
FIG. 28 is a diagram showing an output example (G component) from the sensor, when the recording dot positions by the upper and lower cyan heads coincide.
Figure 29:
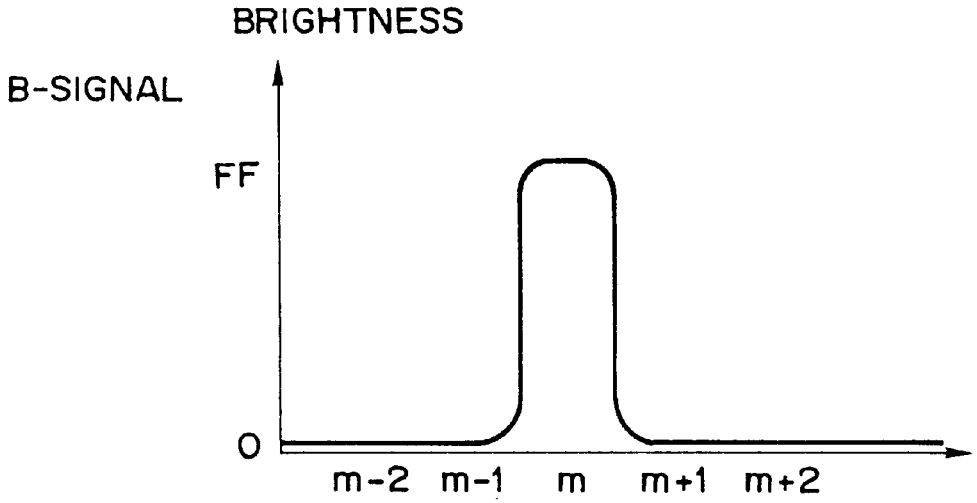
FIG. 29 is a diagram showing an output example (B component) from the sensor, when the recording dot positions by the upper and lower cyan heads coincide.

Thus, the image recorded on the recording medium 414 is read by the sensor 416 (FIG. 20), wherein such read data is an analog signal from the sensor 416, indicating the brightness component of an image. This analog signal is converted into a digital signal by the A/D converter 417, the value of each signal corresponding to each of RGB is obtained in 8 bits (OH to FFH: H indicates hexadecimal). For example, when the above-mentioned line is recorded in cyan, a monochromatic spectral characteristic is (R, G, B)=(O, FF, FF), whereby the dot is as indicated by 463, if the position of a dot 461 recorded by the ink jet head 403 and the position of a dot 462 recorded by the ink jet head 407 coincide, as shown in FIGS. 27 to 29. In this case, data from the sensor 416 as shown in FIGS. 27 to 29 are obtained, where m indicates the recording position, FIG. 27, FIG. 28 and FIG. 29 show R component, G component, and B component, respectively.

Figure 30:
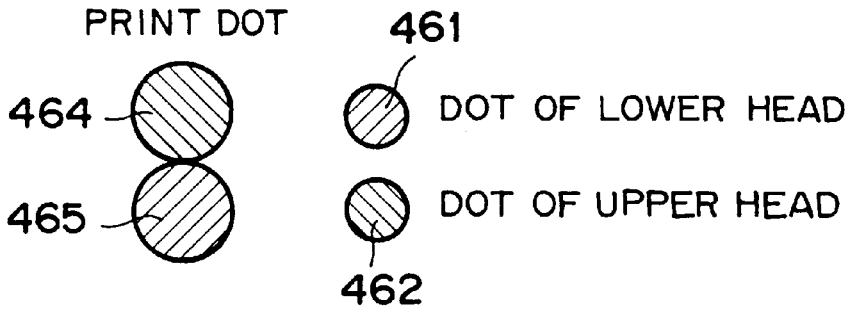
FIG. 30 is a view showing a dot recorded example when a recording dot position by an upper cyan head is deviated one pixel.
Figure 31:
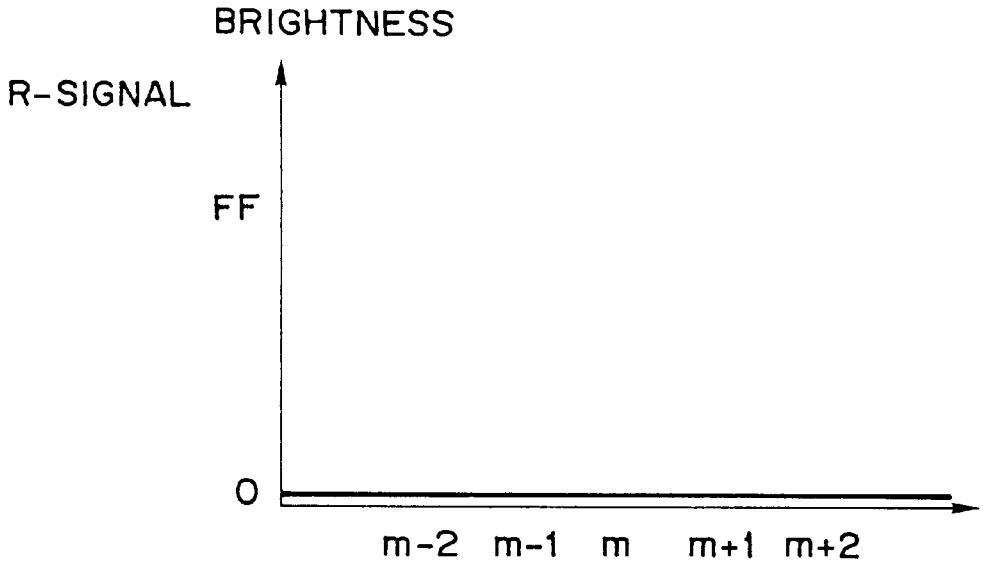
FIG. 31 ia a diagram showing an output example (R component) from the sensor in a state as shown in FIG. 30.
Figure 32:
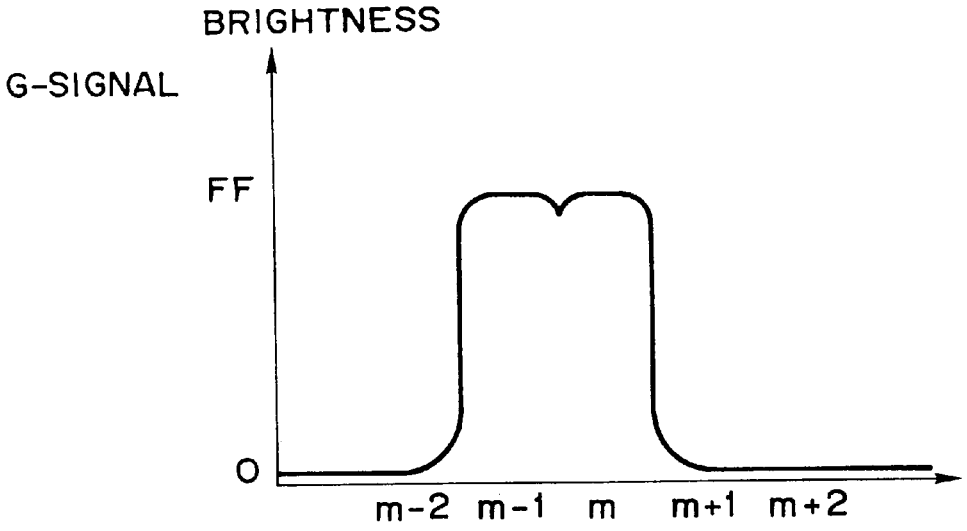
FIG. 32 is a diagram showing an output example (G component) from the sensor in the state as shown in FIG. 30.
Figure 33:
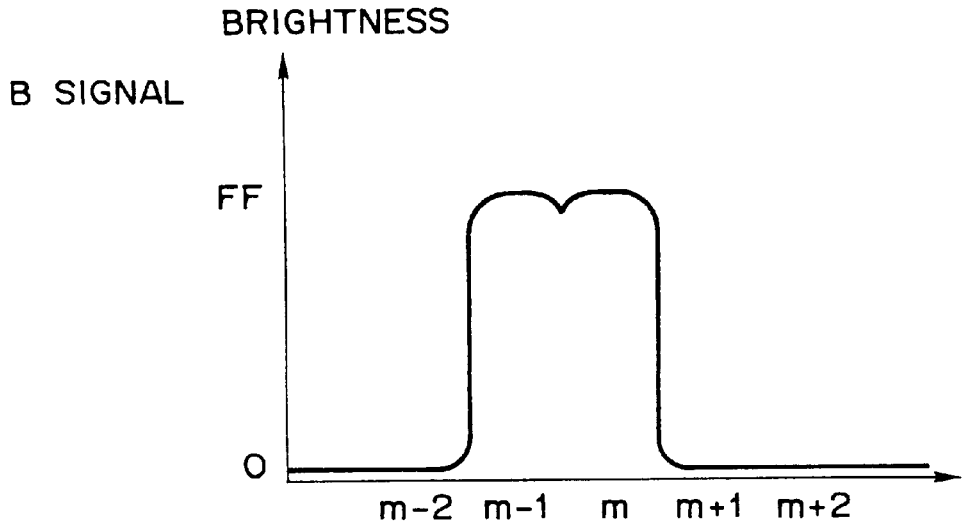
FIG. 33 is a diagram showing an output example (B component) from the sensor in the state as shown in FIG. 30.

Also, when the upper ink jet head 407 is deviated upward one pixel with respect to the lower ink jet head 403, as shown in FIG. 30, two recorded dots 461, 462 are not overlapped, as indicated by 461, 462. And data from the sensor 416 which reads these dots 464, 465 are shown in FIGS. 31 to 33. The sensor 416 reads in an array direction of nozzles as previously described, and if the dot position is deviated as shown in FIG. 30, its deviation appears as two peaks in FIGS. 32 and 33.

Figure 34:
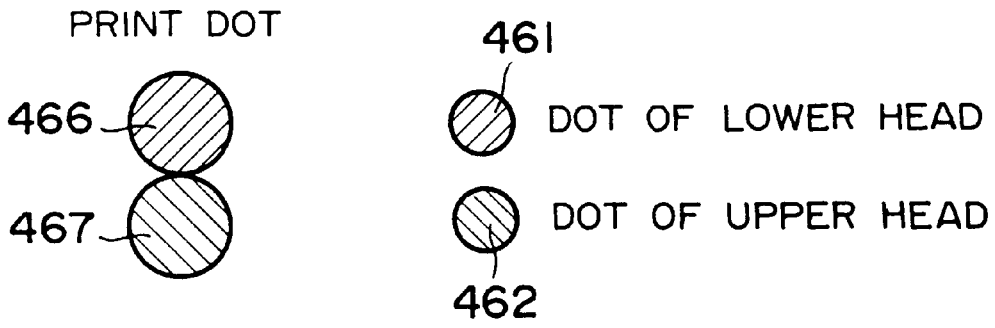
FIG. 34 is a view showing a dot recorded example when a recording dot position by the upper cyan head is deviated downward one pixel.
Figure 35:
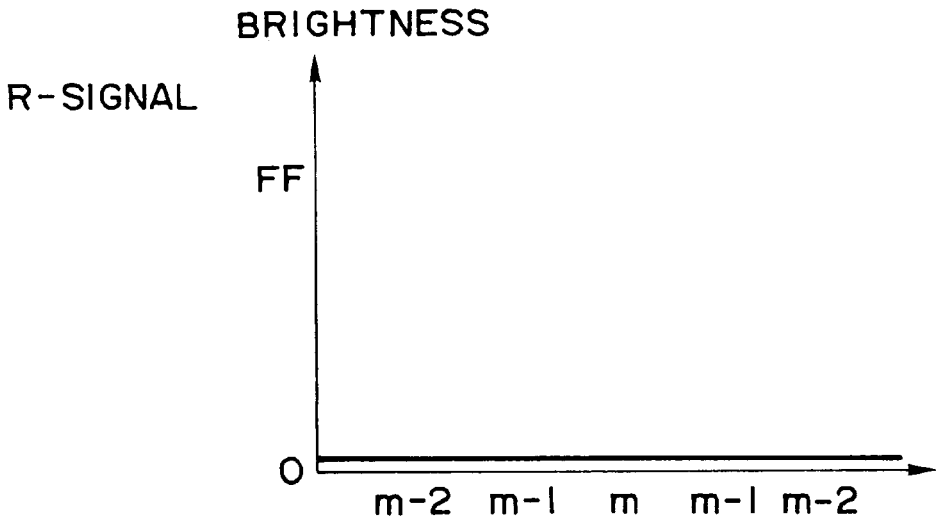
FIG. 35 is a diagram showing an output example (R component) from the sensor in a state as shown in FIG. 34.
Figure 36:
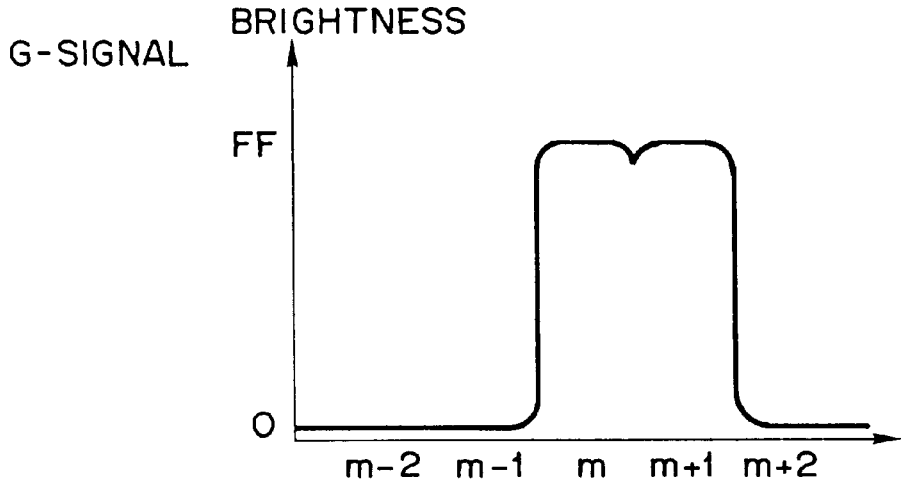
FIG. 36 is a diagram showing an output example (G component) from the sensor in the state as shown in FIG. 34.
Figure 37:
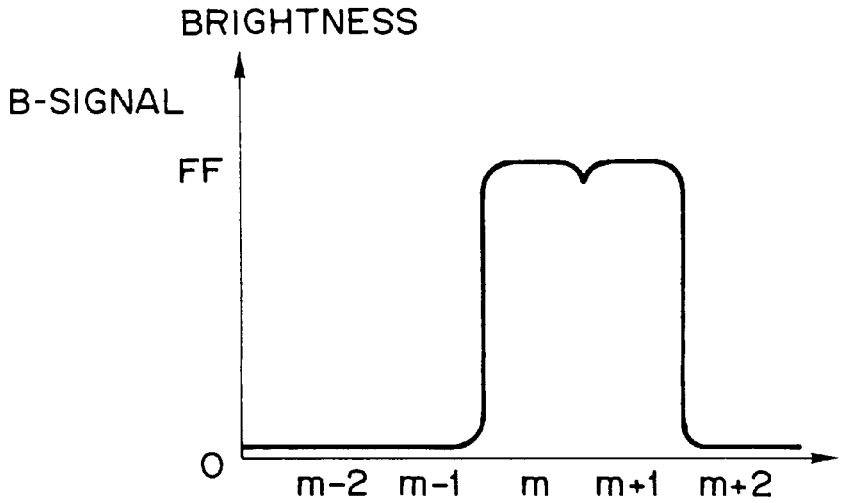
FIG. 37 is a diagram showing an output example (B component) from the sensor in the state as shown in FIG. 34.

Likewise, as shown in FIG. 34, if the ink jet head 407 is deviated downward one pixel with respect to the ink jet head 403, data as shown in FIGS. 35 to 37 are obtained. In the graphs of FIGS. 27 to 37, the spectral characteristic is (FF, O, FF) if the color of a recorded line is magenta, and (FF, FF, O) if the color is yellow, so that in magenta, G signal is considered as R signal of cyan, and R signal is equivalently replaced by G signal of cyan, while in yellow, B signal is equivalent to R signal of cyan, and R signal is equivalent to B signal of cyan. In black, the same output as G signal or B signal appears in R signal of cyan.

With the above result, the pattern of each color is read on the basis of lower ink jet heads 403 to 406, wherein if the recording position of upper ink jet heads 407 to 410 is deviated upward, the reading start position from the memory is incremented by +1, when recorded by the upper ink jet heads, while if the recording position is deviated downward, the start position is decremented.

In the above way, the amount of aligning the recording position with the ink jet heads in a longitudinal direction is obtained, and the read position from the memory is changed based on that amount, whereby the fine adjustment of recording position can be made in a unit of a pixel without need of an operator.

It should be noted that the alignment of recording position with each ink jet head in the movement direction of the carriage is made in such a manner that, as described in the conventional example, a lattice pattern is recorded on the recording medium, and a recorded image is read by the sensor 415 to obtain a deviation, wherein the read position from the memory 428 is changed in accordance with its deviation so that the recording position can be simply adjusted.

Figure 38:
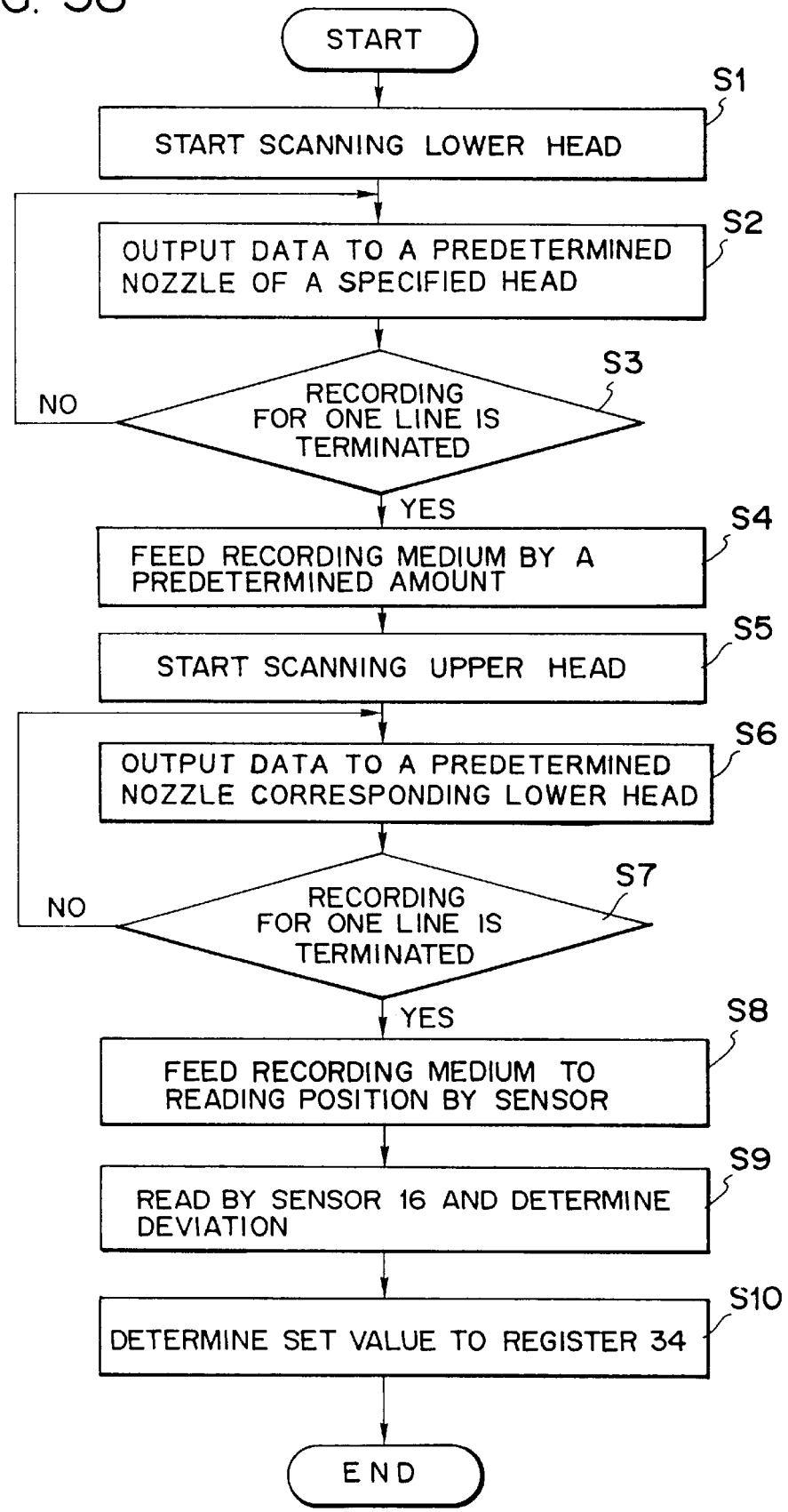
FIG. 38 is a flow chart showing a pattern recording and reading processing for the registration adjustment in one embodiment of the ink jet printer.

FIG. 38 is a flowchart showing a processing for determining the deviation for registry adjustment as previously described, wherein the control program for executing this processing is stored in ROM 512 of the main control unit.

First, at step S1, scanning of the lower ink jet head is started, and at step S2, data for recording, for example, with a specific nozzle of ink jet head 403 for cyan, is output to print one line as indicated by 451 in FIG. 25A, for example. Then, at step S4, recording medium 414 is conveyed by twice the length of recording width of ink jet head in the case of FIG. 25A. At steps S5 to S7, the line 452 is recorded by the upper ink jet head (head 7 in this case) this time.

Next, the recording medium thus recorded is conveyed to a reading position with the sensor 416 (step S8), at which position the lines 451 and 452 are read by the sensor 416. Next, at step S9, based on a result of reading with the sensor, the deviation between upper ink jet head and lower ink jet head is determined. Herein, if the reading result as shown in FIGS. 29 and 30 is obtained, for example, no positional deviation between upper ink jet head and lower ink jet head is judged, but if there is a deviation as shown in FIGS. 32 and 33, a set value to increment the reading start position is determined, when recorded with the upper ink jet head 407 to 410. Also, in the case as shown in FIGS. 36 and 37, a set value to decrement the reading start position is determined, when recorded with the upper ink jet head 407 to 410 (step S10).

In the first embodiment as previously described, when the registry adjustment between upper and lower ink jet heads for each color in a longitudinal direction is made, the lower ink jet head for each color is referenced, it will be appreciated that either one of the lower ink jet heads may be referenced to calculate the adjustment value for registration in the longitudinal direction.

For example, an instance in which cyan is a basis will be described. The calculation of adjustment value for upper ink jet head 407 is made in the same way as that of the previous embodiment. The adjustment value for upper ink jet head for magenta 408 will be discussed.

Figure 39:
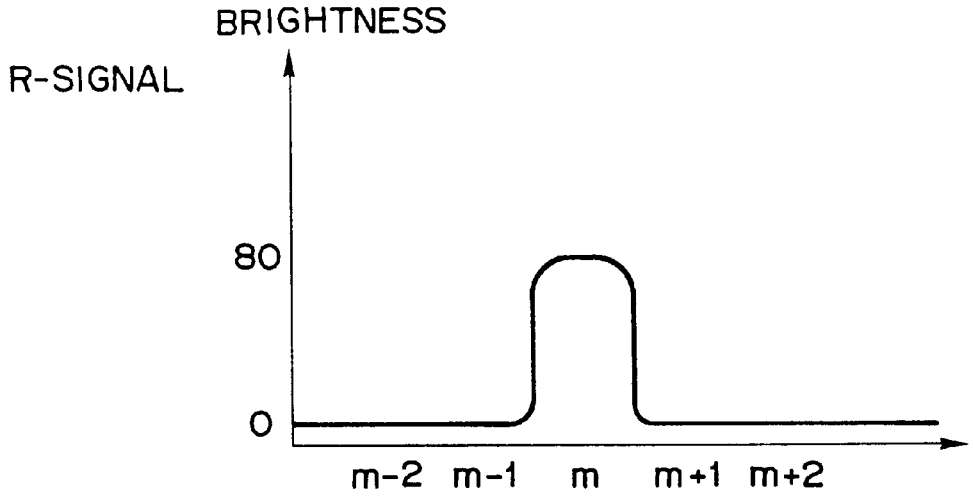
FIG. 39 is a diagram showing a result (R component) of reading a recorded image, when the patterns recorded by a lower cyan head and an upper magenta head coincide.
Figure 40:
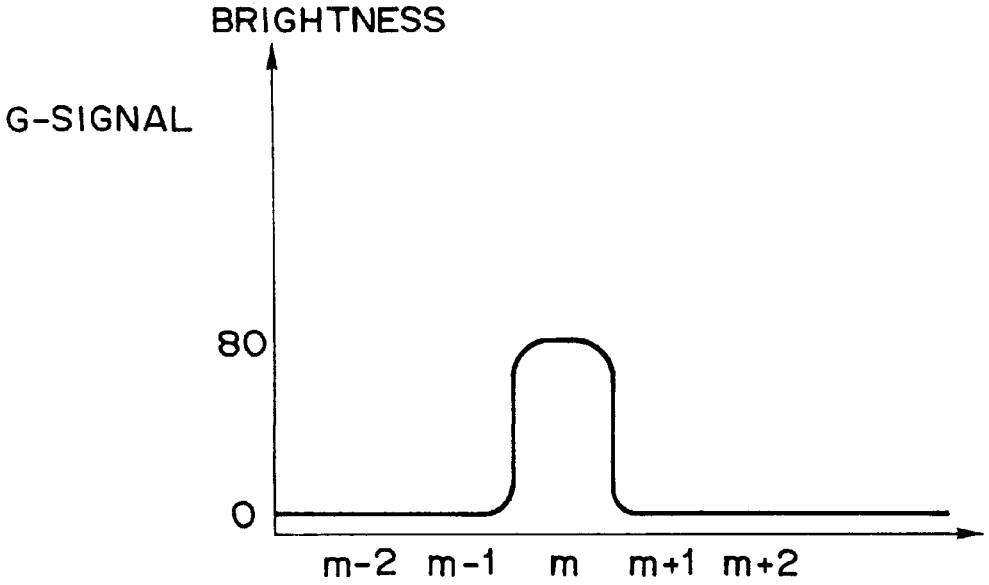
FIG. 40 is a diagram showing a result (G component) of reading a recorded image, when the patterns recorded by the lower cyan head and the upper magenta head coincide.
Figure 41:
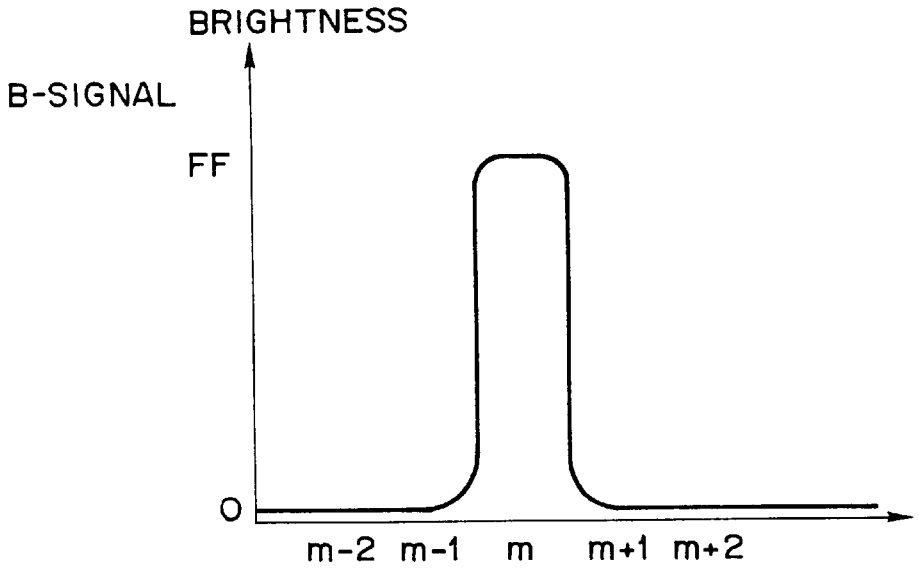
FIG. 41 is a diagram showing a result (B component) of reading a recording image, when the patterns recorded by the lower cyan head and the upper magenta head coincide.

In FIGS. 25A and 25B, the line 451 or the line 453 is recorded by the ink jet head for cyan 403, and the line 452 or the line 454 is recorded by the ink jet head for magenta 408. The spectral characteristic of cyan is (R, G, B)=(O, FF, FF), while the spectral characteristic of magenta is (R, G, B)=(FF, O, FF). If there is no deviation between heads, resulting in the coincidence, the signal detected by the sensor 416 is as shown in FIGS. 39 to 41. That is, the spectral characteristic of dot over-recorded is (R, G, B)=(80, 80, FF).

Figure 42:
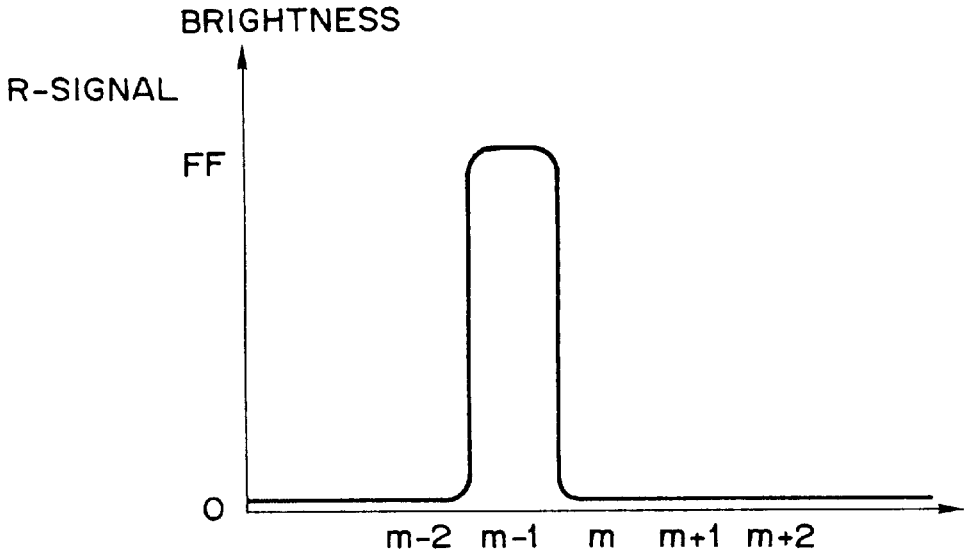
FIG. 42 is a diagram showing a read result (R component) when the dot recorded by a magenata head is deviated upward one pixel in the patterns recorded by a lower cyan head and an upper magenta head.
Figure 43:
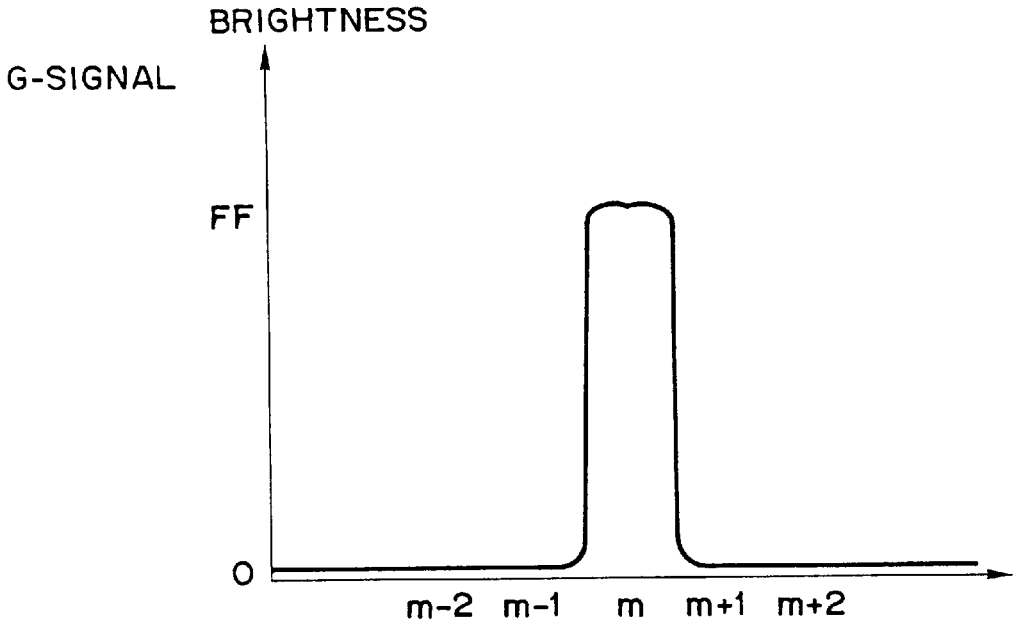
FIG. 43 is a diagram showing a read result (G component) when the dot recorded by the magenta head is deviated upward one pixel in the patterns recorded by the lower cyan head and the upper magenta head.
Figure 44:
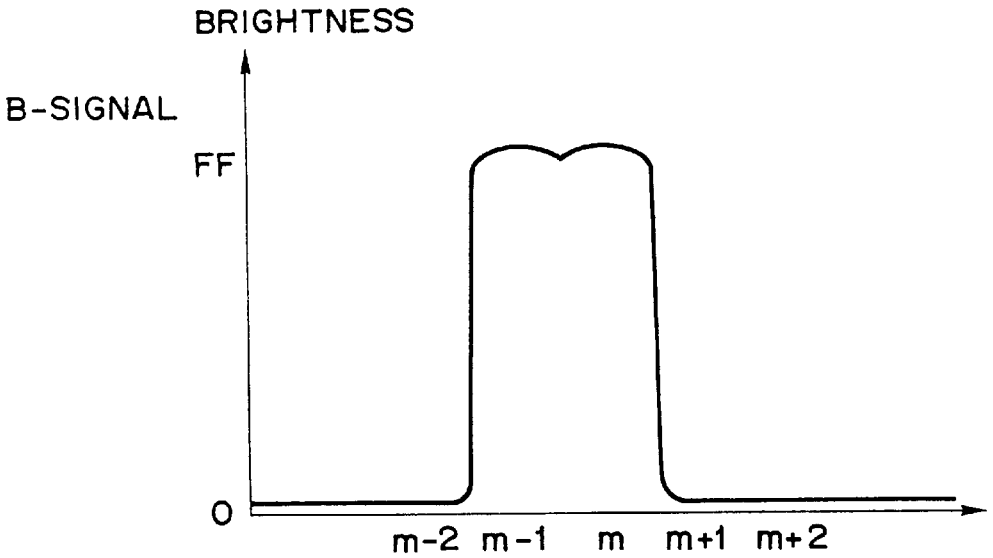
FIG. 44 is a diagram showing a read result (B component) when the dot recorded by the magenta head is deviated upward one pixel in the patterns recorded by the lower cyan head and the upper magenta head.

When the dot recorded by the upper ink jet head for magenta 408 is deviated upward on a pixel, the spectral characteristic of a result that the recorded image is read by the sensor 416 is as shown in FIGS. 42 to 44.

Figure 45:
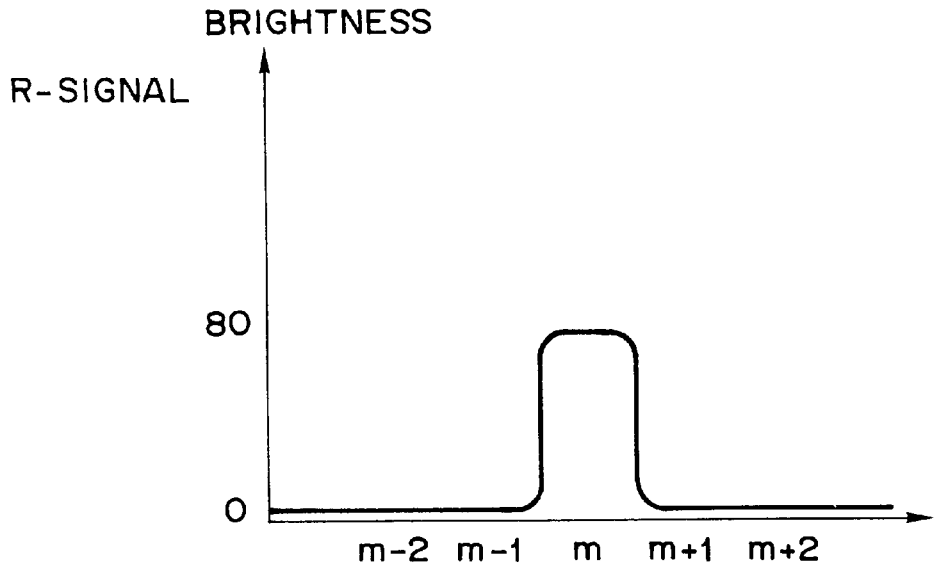
FIG. 45 is a diagram showing a read result (R component) when the dots coincide in the patterns recorded by a lower cyan head and an upper yellow head.
Figure 46:
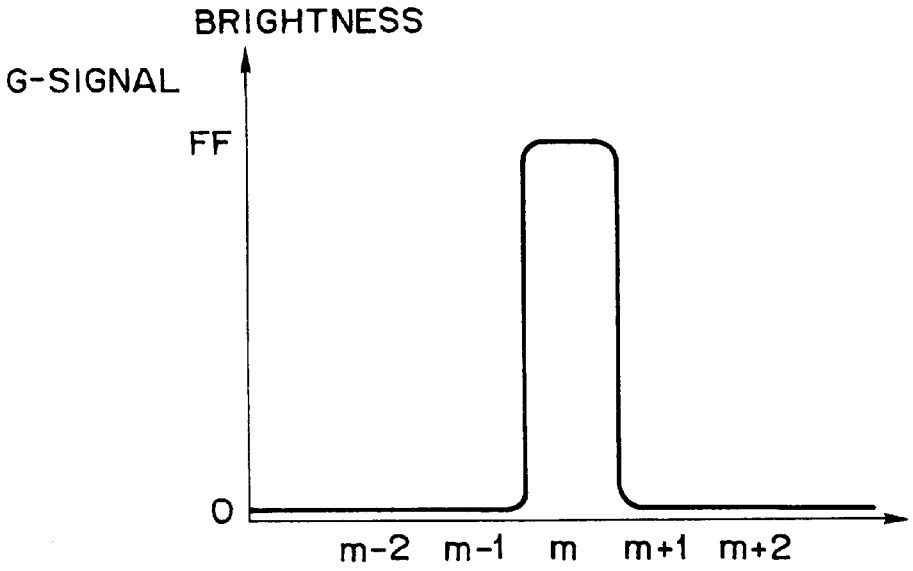
FIG. 46 is a diagram showing a read result (G component) when the dots coincide in the patterns recorded by a lower cyan head and an upper yellow head.
Figure 47:
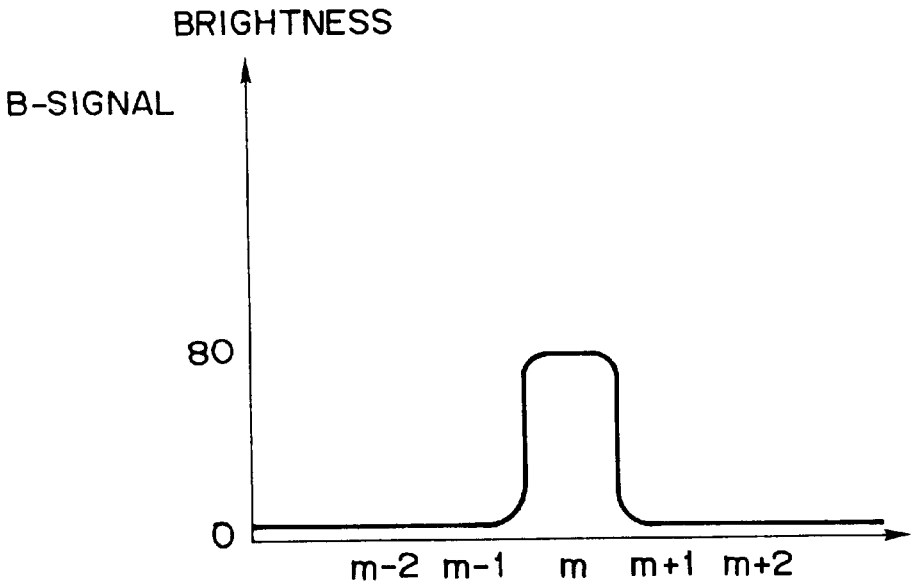
FIG. 47 is a diagram showing a read result (B component) when the dots coincide in the patterns recorded by the lower cyan head and the upper yellow head.
Figure 48:
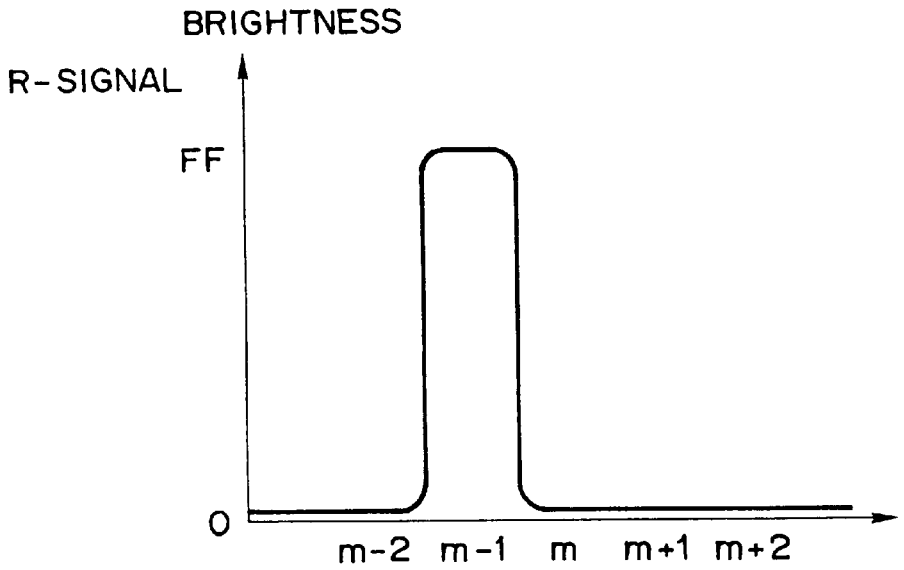
FIG. 48 is a diagram showing a read result (R component) when the recording dot by a yellow head is deviated upward one pixel in the patterns recorded by a lower cyan head and an upper yellow head.
Figure 49:
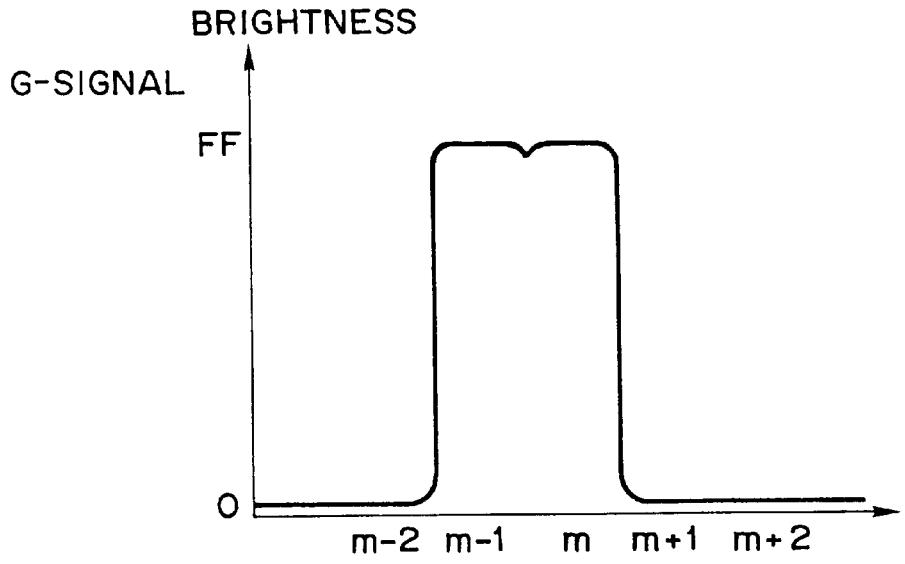
FIG. 49 is a diagram showing a read result (G component) when the recording dot by the yellow head is deviated upward one pixel in the patterns recorded by the lower cyan head and the upper yellow head.
Figure 50:
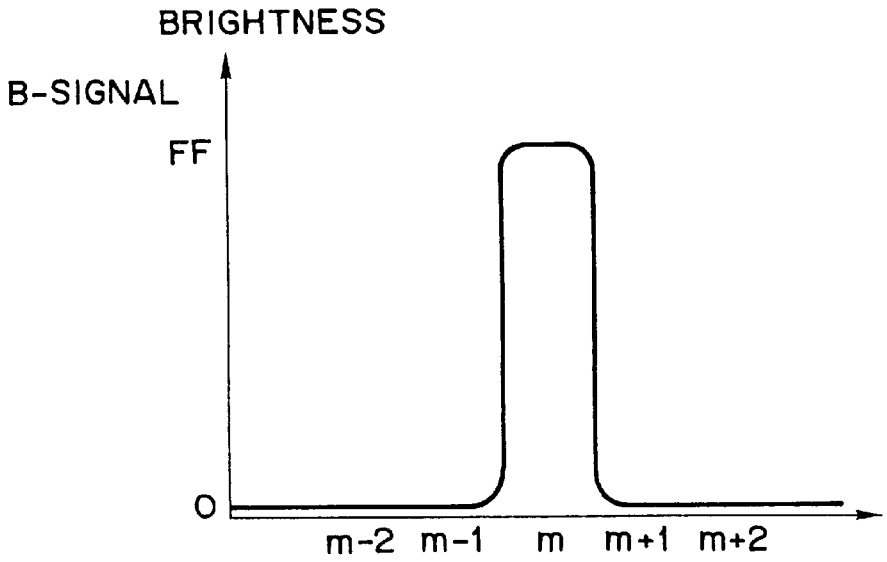
FIG. 50 is a diagram showing a read result (B component) when the recording dot by the yellow head is deviated upward one pixel in the patterns recorded by the lower cyan head and the upper yellow head.

Likewise, when the position of upper ink jet head for yellow 409 and position of lower ink jet head for yellow 406 coincide, the signal is as shown in FIGS. 45 to 47. When the recording position by the upper ink jet head for yellow 409 is deviated upward, the signal is as shown in FIGS. 48 to 50.

Figure 51:
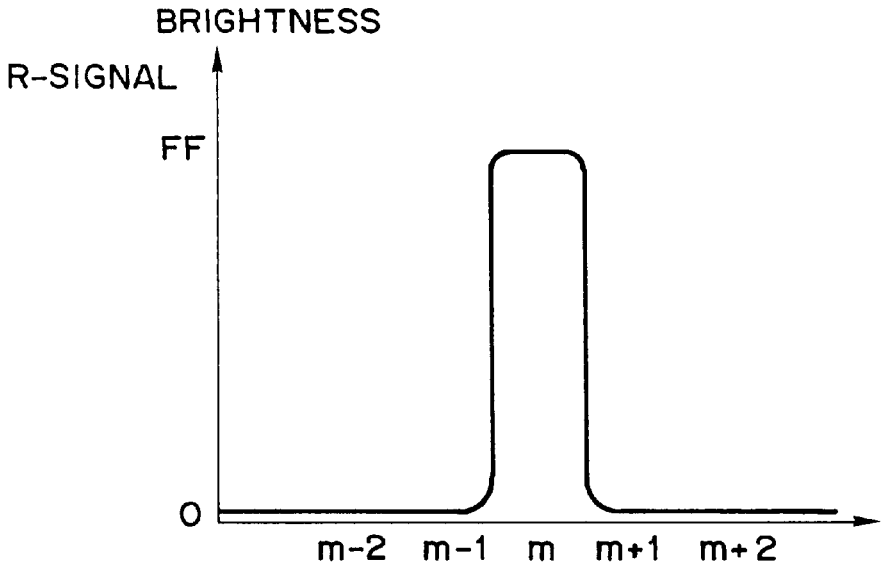
FIG. 51 is a diagram showing a read result (R component) when the dots coincide in the patterns recorded by a lower cyan head and an upper black head.
Figure 52:
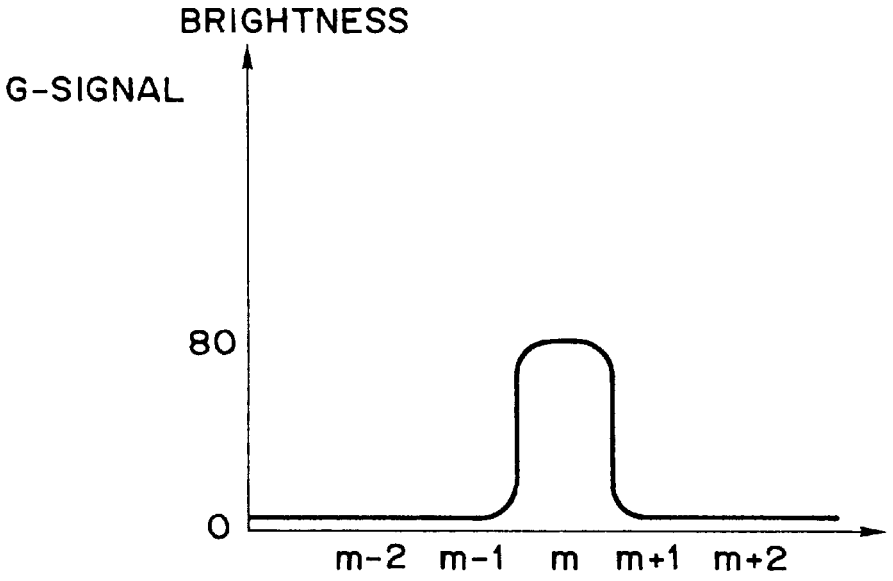
FIG. 52 is a diagram showing are read result (G component) when the dots coincide in the patterns recorded by the lower cyan head and the upper black head.
Figure 53:
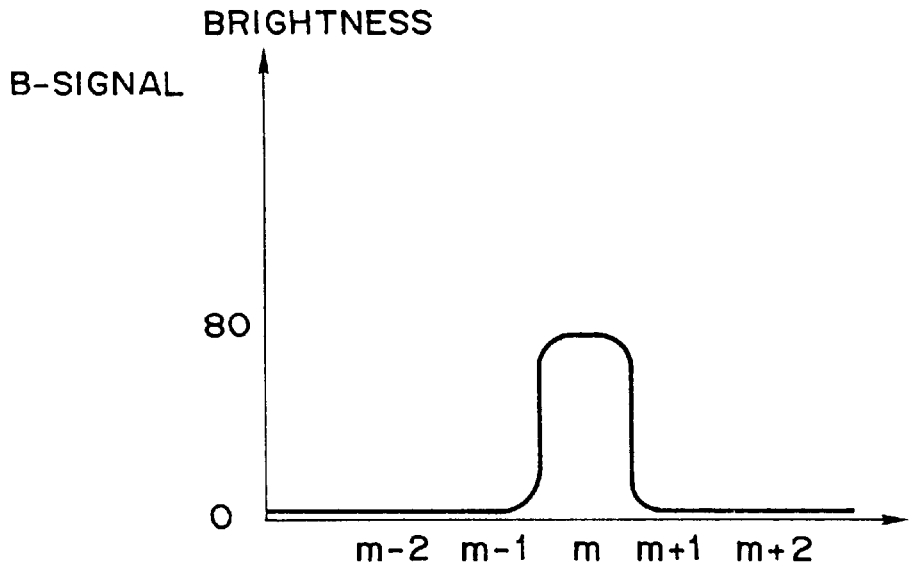
FIG. 53 is a diagram showing a read result (B component) when the dots coincide in the patterns recorded by the lower cyan head and the upper black head.
Figure 54:
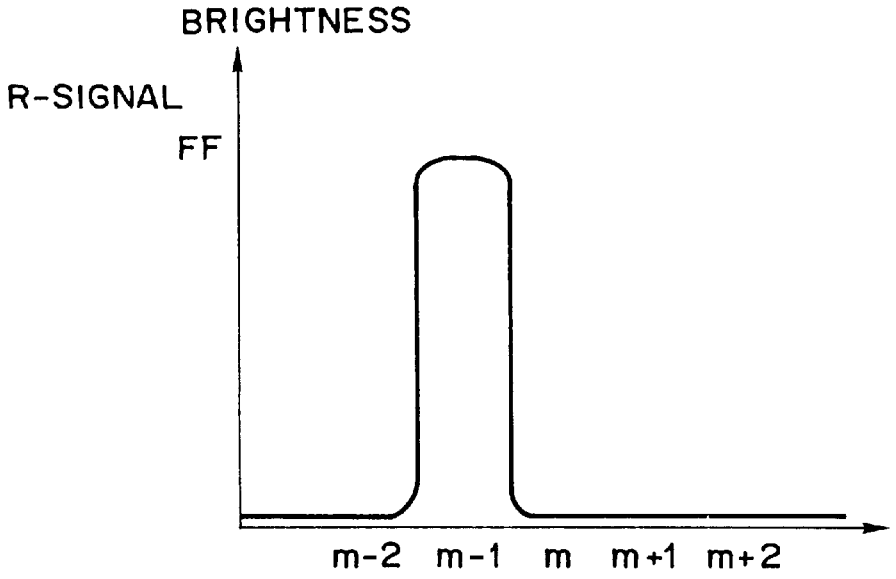
FIG. 54 is a read result (R component) when the recorded dot by the black head is deviated upward one pixel in the patterns recorded by the lower cyan head and the upper black head.
Figure 55:
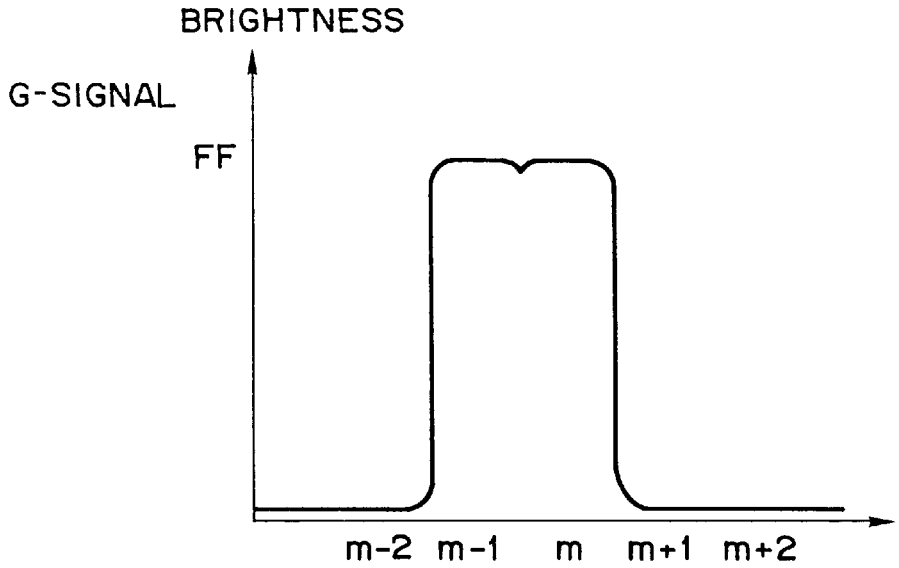
FIG. 55 is a read result (G component) when the recorded dot by the black head is deviated upward one pixel in the patterns recorded by the lower cyan head and the upper black head.
Figure 56:
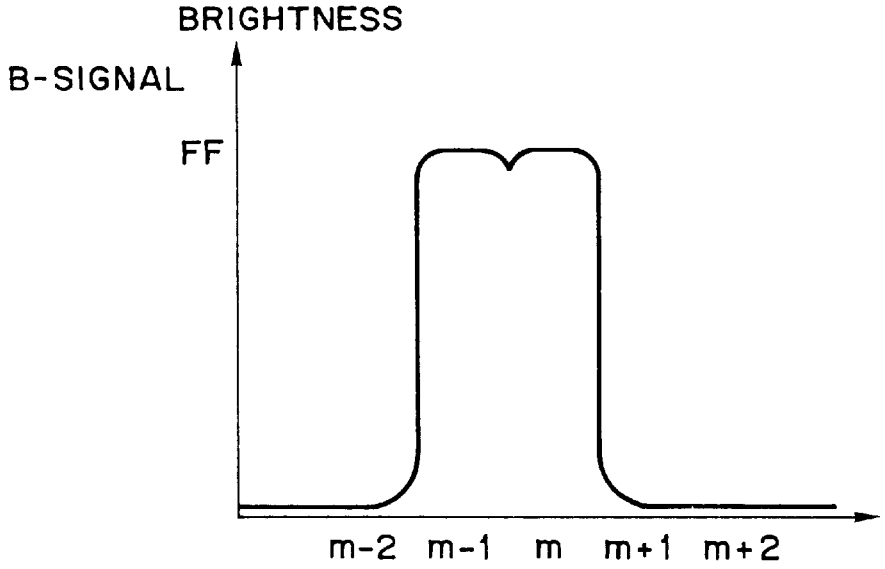
FIG. 56 is a read result (B component) when the recorded dot by the black head is deviated upward one pixel in the patterns recorded by the lower cyan head and the upper black head.

Also, when the position of upper ink jet head for black 410 and the position of lower ink jet head 406 coincide, the signal is as shown in FIGS. 51 to 53. When the recording position by the upper ink jet head for black 410 is deviated upward, the signal is as shown in FIGS. 54 to 56. In this way, using the spectral characteristic for each color component, it is possible to judge the positional deviation of each upper ink jet head on the basis of the lower ink jet head for cyan 403. Thereby, the registry adjustment of each of the upper and lower heads in the longitudinal direction can be made in accordance with the judged value.

While in the previous embodiment the adjustment value of the position of the upper ink jet head with reference to that of the lower ink jet head is determined in the ink jet heads arranged on two stages of upper and lower sides, it will be also appreciated that for each of the lower ink jet heads, the adjustment value for longitudinal registration can be calculated in the same way.

While in the previous embodiment the recording unit is constituted of four color heads of cyan, magenta, yellow and black, it will be appreciated that this invention is not limited to such embodiment, but the use of other color inks allows for the adjustment of longitudinal registration in the same way.

Also, a general-purpose scanner, for example, can be used instead of sensors 415, 416 to measure the deviation.

Also, while in the previous embodiment the signal read by the sensors 415, 416 is processed in the calculation unit 421 to determine a set value corresponding to the deviation, it will be also appreciated that the signal is processed in a calculation unit provided apart from the recording unit, and the adjustment value of longitudinal registration is transmitted to a calculation unit within the recording unit by any of a variety of communication means.

Figure 57:
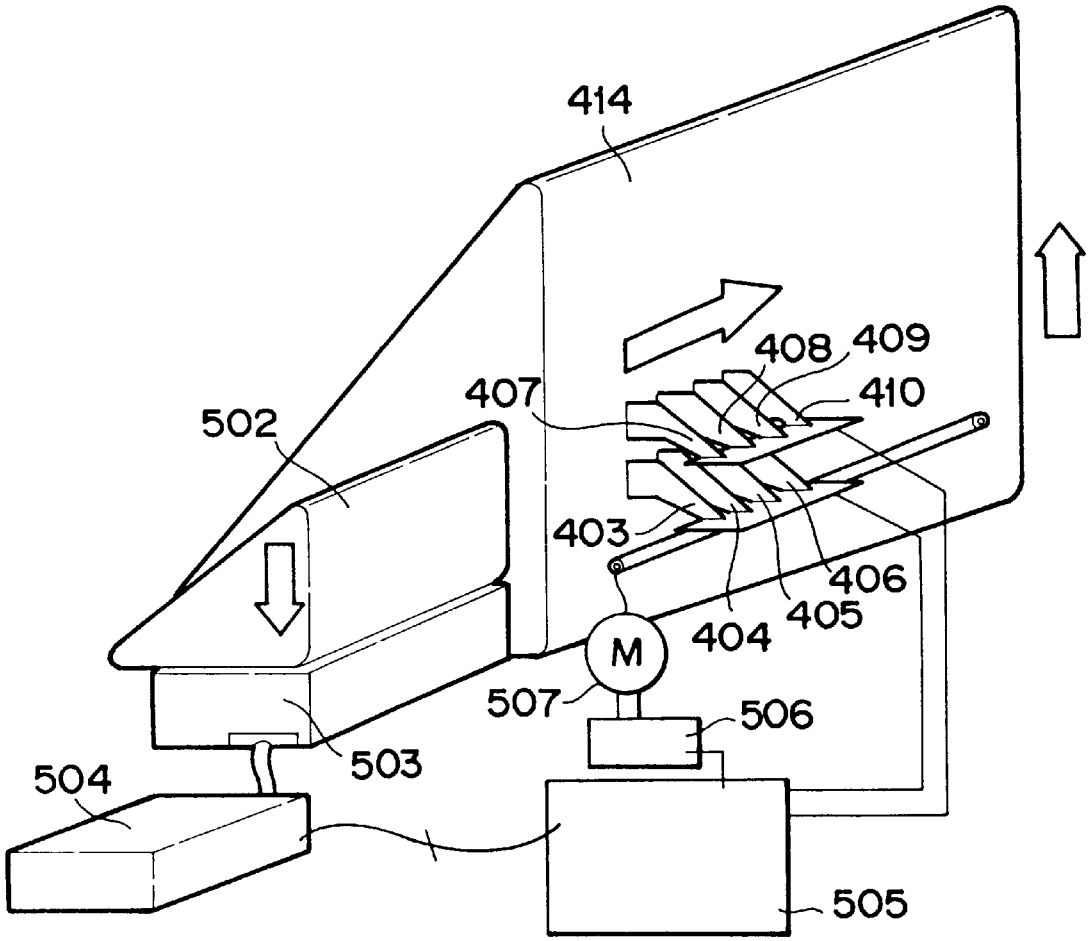
FIG. 57 is a view representing a schematic constitution of an ink jet printer in another embodiment on the present invention.

This configurational example is shown in FIG. 57.

In the same figure, 414 is a recording medium for recording the image, 502 is a recording medium for recording a specific pattern for the calculation of registration adjustment value, and 503 is a scanner for reading the pattern recorded on the recording medium. 504 is a second calculation unit for calculating the adjustment value of longitudinal registration by receiving a result of reading the pattern recorded on the recording medium 502 which is output from the scanner 503. 505 is a main control unit containing a first calculation unit 421 (see FIG. 21) for controlling the whole recording unit. 506 is a motor control unit for controlling a carriage motor 507 to drive the scanning of the recording head. 507 is the carriage motor for driving the scanning of the recording heads. 403 to 406 are ink jet heads for respective colors provided on the lower side, and 407 to 410 are ink jet heads for respective colors provided on the upper side, which are the same as in FIG. 20 previously described.

Using the ink jet heads 403 to 410, a pattern for calculating the adjustment value for longitudinal registration is recorded on the recording medium 502. And this pattern is read by the scanner 503, and calculated in the second calculation unit 504 to determine the adjustment value for longitudinal registration. The adjustment value thus calculated is transmitted via a communication cable for the connection between the main control unit 505 and the second calculation unit 504 to the first calculation unit 421 of the main control unit 505. By adjusting the longitudinal registration based on the transmitted adjustment value for longitudinal registration, the image recording can be performed in a state in which the longitudinal registrations of upper and lower ink jet heads coincide.

It should be noted that the feed amount may be changed depending on the recording medium, for example, the material of cloths, and the type of image. In this case, the changed feed amount is transmitted to the main control unit of the recording unit by transmission means (input from control unit or input via communication from cloths feeding unit), and the main control unit can control the reading position to adjust the longitudinal registration in accordance with the changed amount of feeding the cloths. With this means, the recording with the variable feed amount can be performed, without producing overlap or gap between recording images.

It should be noted that the present invention may be applicable to either of a system comprised of EL plurality of devices, and a unit consisting of one device. Also, it is needless to say that the present invention is applicable to the cases in which a program for carrying out the invention is supplied to the system or unit.

As above described, according to this embodiment, a pattern for detecting the deviation of longitudinal registration is recorded and read electrically to calculate the adjustment value, and the reading position of recorded data stored in the memory is changed in accordance with the calculated adjustment value, whereby the longitudinal registration can be automatically made. Thereby, it is possible to record a high-quality image without producing false colors caused by the deviation of mounting position for each ink jet head.

As above described, according to the present invention, it is possible to adjust accurately and simply the recording position at which a plurality of recording heads are involved in recording.

The above-described embodiments bring about excellent effects particularly in an ink jet recording head or recording device of the recording system relying on forming of fine ink droplets with the heat energy among the various ink jet recording systems.

As to its representative constitution and principle, for example one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets, or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of the U.S. Pat. No. 4,558,333 or 4,459,600 disclosing the constitution having the heat acting portion arranged in the flexed region is also included in the present invention. In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing a pressure wave of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specifications or the constitution as one recording head integrally formed may be used.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform modes which perform discharging separate from recording.

Further, as the recording mode of the recording device, the present invention is extremely effective for not only the recording mode only for a primary color such as black etc., but also a device equipped with at least one of a plurality of different colors or full color by color mixing, whether the recording head may be either integrally constituted or combined in plural number.

In addition, though the ink is considered as the liquid in the embodiments as above described, the ink may be placed in solid state below room temperature as long as the ink will soften or liquefy at or above room temperature, or liquefy when a recording enable signal is issued as it is common with the ink jet device to control the viscosity of ink to be maintained within a certain range of the stable discharge by adjusting the temperature of ink in a range from 30 to 70° C.

In addition, in order to avoid the temperature elevation due to heat energy by positively utilizing the heat energy as the energy for the change of state from solid to liquid, or to prevent the evaporation of ink by using the ink stiff in the shelf state, the use of the ink having a property of liquefying only with the application of heat energy, such as liquefying with the application of heat energy in accordance with a recording signal so that liquid ink is discharged, or may be solidifying prior to reaching a recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56846 or No. 60-71260. The most effective method for the ink as above described in the present invention is based on the film boiling.

Further, a recording apparatus according to the present invention may be used integrally or separately as an image output terminal in information processing equipment such as a word processor or a computer, as above described, a copying machine in combination with a reader, or a facsimile terminal equipment having the transmission and reception feature.

In the above embodiments, when the cloths are used as the recording medium, the pre-treatment or post-treatment for the cloths can be made as necessary, whereby an embodiment including these proceedings is also covered within the scope of the invention. The pre-treatment and the post-treatment will be described below.

First of all, the ink jet textile printing cloths are required to have the properties of:

(1) coloring the ink at sufficient density (2) high dyeing rate of ink (3) drying the ink on the cloths (4) less irregular bleeding of ink on the cloths (5) excellent conveyance capability within the apparatus.

To meet these requirements, the cloths may be pre-treated as necessary in this invention. For example, in Japanese Laid-Open Patent Application No. 62-53492, several kinds of cloths having the ink receiving layer have been disclosed, and in Japanese Patent Publication No. 3-46589, cloths containing reduction inhibitor or alkaline substances have been proposed. An example of such pre-treatment includes treating the cloths to contain a substance selected from alkaline substance, water soluble polymer, synthetic polymer, water soluble metallic salt, urea, and thiourea.

Examples of alkaline substances include alkaline metal hydroxide such as sodium hydroxide and potassium hydroxide, amines such as mono-, di-, or triethanolamine, and a carbonic acid or alkaline metal bicarbonate such as sodium carbonate, potassium carbonate and sodium bicarbonate. Further, they include organic acid metallic salt such as calcium acetate and barium acetate, ammonia and ammonium compounds. Also, sodium trichloroacetate which becomes an alkaline substance under the teaming and heating may be used. Particularly preferable alkaline substance may be sodium carbonate and sodium bicarbonate for use in coloring of reactive dye.

Examples of water soluble polymer include starch substances such as corn and wheat flour, cellulose substances such as carboxymethyl cellulose, methyl cellulose and hydroxyethyl cellulose, polysaccharides such as sodium alginate, gum arabic, locust bean gum, tragacanth gum, guar gum, and tamarind seeds, protein substances such as gelatine and casein, and natural water soluble substances such as tannin and lignin. Also, examples of synthetic polymer include polyvinyl alcohol compounds, polyethylene oxide compounds, acrylic acid type water soluble polymer, and maleic anhydride type water soluble polymer. Among them, polysaccharide polymer and cellulose polymer are preferable.

Examples of water soluble metallic salt include compounds having a pH of 4 to 10 and making typical ionic crystals such as halides of alkaline metal and alkaline earth metal. Typical examples of such compound include alkaline metals such as NaCl, $Na_2$, $SO_4$, KCL and $CH_3COONa$, and alkaline earth metals such as $CaCl_2$ and $MgCl_2$. Among them, salts of Na, K and Ca are preferable.

The method of pre-treating the cloths to contain any of the above-cited substances is not specifically limited, but may be normally any one of dipping, pad, coating, and spray methods.

Further, because the textile printing ink applied to the cloths for ink jet textile printing may only adhere to the surface of cloths in the jetted state, it is preferable to subsequently perform, as the post-treatment, a reaction fixing process (dyeing process) of dye to fibers. Such a reaction fixing process may be any one of conventionally well-known methods; for example, a steaming method, an HT steaming method, or a thermofix method, and when not using the cloths treated with alkali, an alkali pad steam method, an alkali blotch steam method, an alkali shock method, and an alkali cold fix method.

Further, the removal of unreacted dye and substances used in pre-treatment can be made by washing in accordance with a conventionally well-known method after the reactive fixing process. Note that it is preferable to use a conventional fix process jointly in washing.

In the present invention, examples of recording medium include cloths, wall paper, papers, OHP recording media and the like.

Note that the cloths in this invention include all woven and non-woven fabrics and other webs, irrespective of material, weaving, and knitting.

Also, the wall paper in this invention includes papers, cloths, and wall sized sheet made of synthetic resin such as polyvinyl chloride.

The recorded matter applied with additional treatments as mentioned above is then divided into pieces each having a desired size. The divided pieces are treated with a final process, such as sewing, adhesion and solvent welding to obtain final products, for example clothes such as one-piece or two piece dresses, ties and swimming suits or pants, bedspreads, covers for sofas, handkerchiefs and curtains. Cloths made of materials such as cotton or silk and others is treated by, for example sewing and made into clothes and other commodity as disclosed in MODERN KNITTING AND SEWING MANUAL published by Seni Journal (Fiber Journal), SOEN by Bunka Shuppan and many others.

It should be noted that the drying section may be a predetermined space for drying ink at room temperature while the recording medium is conveying from said ink jet recording unit to said ink jet recording unit, other than a fan for forcibly drying ink.

What is claimed is:

1. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging an amount of ink of the predetermined color smaller than an amount of ink of the predetermined color to be discharged to a print area of the print medium in accordance with image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging remaining ink of the predetermined color necessary to complete printing of the image data;

a drying space for promoting drying of the ink in the print area including a print portion printed on the print medium by said first ink jet printing nozzle portion, said drying space provided between said first ink jet printing nozzle portion and said second ink jet printing nozzle portion; and recording control means for controlling said first and second ink jet printing nozzle portions, said control means controlling said second ink jet printing nozzle portion to perform further printing on the print area where drying is promoted by said drying space, wherein the print medium has a printing surface and said drying space comprises fan means provided proximate the printing surface of the print medium for causing airflow across the printing surface.

2. An ink jet printing apparatus according to claim 1, wherein the print medium comprises a textile print medium.

3. An ink jet printing apparatus according to claim 1, wherein each of said first ink jet printing nozzle portion and said second ink jet printing nozzle portion comprises a printing head for discharging ink, said printing head being an ink jet printing head which has a thermal energy converting element for generating thermal energy to be applied to ink so that ink is discharged by utilizing the thermal energy.

4. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging an amount of ink of the predetermined color smaller than an amount of ink of the predetermined color to be discharged to a print area of the print medium in accordance with image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging remaining ink of the predetermined color necessary to complete printing of the image data;

a drying space for promoting drying of the ink in the print area including a print portion printed on the print medium by said first ink jet printing nozzle portion, said drying space provided between said first ink jet printing nozzle portion and said second ink jet printing nozzle portion;

recording control means for controlling said first and second ink jet printing nozzle portions, said control means controlling said second ink jet printing nozzle portion to perform further printing on the print area where drying is promoted by said drying space; and drying means for promoting drying of ink in the print area, said drying means being provided on a back side of the print medium.

5. An ink jet printing apparatus according to claim 4, wherein the print medium comprises a textile print medium.

6. An ink jet printing apparatus according to claim 4, therein each of said first ink jet printing nozzle portion and said second ink jet printing nozzle portion comprises a printing head for discharging ink, said printing head being an ink jet printing head which has a thermal energy converting element for generating thermal energy to be applied to ink so that ink is discharged by utilizing the thermal energy.

7. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging an amount of ink of the predetermined color smaller than an amount of ink of the predetermined color to be discharged to a print area of the print medium in accordance with image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging remaining ink of the predetermined color necessary to complete printing of the image data;

a drying space for promoting drying of the ink in the print area including a print portion printed on the print medium by said first ink jet printing nozzle portion, said drying space provided between said first ink jet printing nozzle portion and said second ink jet printing nozzle portion; and recording control means for controlling said second ink jet printing nozzle portion to perform further printing on the print area where drying is promoted by said drying space, wherein said recording control means controls said first ink jet printing nozzle portion to print a portion of image data and said second ink jet printing nozzle portion to print any remaining image data, which is not printed by said first ink jet printing nozzle portion, on the print area where drying is promoted by said drying space, to supplement printing.

8. An ink jet printing apparatus according to claim 7, further comprising pre-treating means for applying a pre-treatment agent onto the print medium, said pre-treating means provided upstream of the printing position of said first ink jet printing nozzle portion.

9. An ink jet printing apparatus according to claim 7, wherein said recording control means controls said first ink jet printing nozzle portion and said second ink jet printing nozzle portion to cause multi-value printing to be performed on the print area.

10. An ink jet printing apparatus according to claim 7, wherein at least one of the printing nozzle portions discharges a lighter color ink than ink discharged from any other one of the printing nozzle portions.

11. An ink jet printing apparatus according to claim 7, wherein each of said first ink jet printing nozzle portion and said second ink jet printing nozzle portion comprises a printing head for discharging ink, said printing head being an ink jet printing head which has a thermal energy converting element for generating thermal energy to be applied to ink so that ink is discharged by utilizing the thermal energy.

12. An ink jet printing apparatus according to claim 7, wherein consecutive print areas are printed by the first and second printing nozzle portions in consecutive scans of the first and second printing nozzle portions and borders between print areas printed by said first ink jet printing nozzle portion in two consecutive scans do not coincide with borders between print areas printed by said second ink jet printing nozzle portion in two consecutive scans.

13. An ink jet printing apparatus according to claim 7, wherein the print medium comprises a textile print medium.

14. An ink jet printing apparatus for printing at a printing area on a print medium by sub-scanning the print medium relative to printing nozzle portions, which discharge ink by repeating a scanning of the printing nozzle portions transverse to a moving direction of the print medium, the ink being discharged for printing during each scanning, said apparatus comprising:

a first ink jet printing nozzle portion;

a second ink jet printing nozzle portion provided downstream of said first ink jet printing nozzle portion relative to the moving direction of the print medium;

a drying space for promoting drying of ink at a print area including a printed portion on the print medium printed by the first ink jet printing nozzle portion, said drying space being provided between the first ink jet printing nozzle portion and the second ink jet printing nozzle portion; and print control means for causing the second ink jet printing nozzle portion to print on the print area printed by the first ink jet printing nozzle portion in a scanning operation different from that of said first ink jet printing nozzle portion, wherein said control means controls consecutive print areas to be printed by the first and second printing nozzle portions in consecutive scans of the first and second printing nozzle portions and borders between print areas printed by said first ink jet printing nozzle portion in two consecutive scans to not coincide with borders between print areas printed by said second ink jet printing nozzle portion in two consecutive scans, and wherein said print control means controls said first ink jet printing nozzle portion to print a portion of image data and said second ink jet printing nozzle portion to print any remaining images data, which is not printed by said first ink jet printing nozzle portion, on the print area where drying is promoted by said drying space, to supplement printing.

15. An ink jet printing apparatus according to claim 14, wherein each of said first ink jet printing nozzle portion and said second ink jet printing nozzle portion prints with ink of a predetermined color.

16. An ink jet printing apparatus according to claim 14, wherein said first ink jet printing nozzle portion discharges an amount of ink smaller than an amount of ink to be discharged to a print area of the print medium in accordance with image data regarding ink of a predetermined color and said second ink jet printing nozzle portion discharges remaining ink necessary to complete printing of the image data.

17. An ink jet printing method for printing on a print medium at a printing area by sub-scanning the print medium relative to printing nozzle portions, which discharge ink by repeating a scanning of the printing nozzle portions transverse to a moving direction of the print medium, the ink being discharged for printing during each scanning, said method comprising the steps of:

providing a first ink jet printing nozzle portion;

providing a second ink jet printing nozzle portion downstream of the first ink jet printing nozzle portion relative to the moving direction of the print medium;

providing a drying space for promoting drying of ink at a print area including a printed portion on the print medium printed by the first ink jet print nozzle portion, the drying space being provided between the first ink jet printing nozzle portion and the second ink jet printing nozzle portion; and causing the second ink jet printing nozzle portion to print on the print area printed by the first ink jet printing nozzle portion in a scanning operation different from that of said first ink jet printing nozzle portion, wherein consecutive print areas are printed by the first and second printing nozzle portions in consecutive scans of the first and second printing nozzle portions and borders between print areas printed by the first ink jet printing nozzle portion in two consecutive scans do not coincide with borders between print areas printed by the second ink jet print nozzle portion in two consecutive scans, and wherein the first ink jet printing nozzle portion is controlled to print a portion of image data and the second ink jet printing nozzle portion is controlled to print any remaining image data, which is not printed by the first ink jet printing nozzle portion, on the print area where drying is promoted by the drying space, to supplement printing.

18. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging an amount of ink of the predetermined color smaller than an amount of ink of the predetermined color to be discharged to a print area of the print medium in accordance with image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging remaining ink of the predetermined color necessary to complete printing of the image data;

a drying space for promoting drying of the ink in the print area including a print portion printed on the print medium by said first ink jet printing nozzle portion, said drying space provided between said first ink jet printing nozzle portion and said second ink jet printing nozzle portion;

recording control means for controlling said first and second ink jet printing nozzle portions, said control means controlling said second ink jet printing nozzle portion to perform further printing on the print area where drying is promoted by said drying space;

fixing means for fixing the ink of the print area onto the print medium, after said second ink jet printing nozzle portion performs further printing on the print area; and washing means for washing the print medium, which is printed, subsequent to fixing by said fixing means.

19. An ink jet printing apparatus according to claim 18, wherein the print medium comprises a textile print medium.

20. An ink jet printing apparatus according to claim 18, wherein each of said first ink jet printing nozzle portion and said second ink jet printing nozzle portion comprises a printing head for discharging ink, said printing head being an ink jet printing head which has a thermal energy converting element for generating thermal energy to be applied to ink so that ink is discharged by utilizing the thermal energy.

21. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging ink of the predetermined color at a print density smaller than a final print density of ink of the predetermined color to be discharged to a print area of the print medium in accordance with image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging ink of the predetermined color at the print area to complete printing of the image data at the final print density;

a drying space for promoting drying of the ink of the predetermined color in the print area including a print portion printed on the print medium by said first ink jet printing nozzle portion, said drying space provided between said first ink jet printing nozzle portion and said second ink jet printing nozzle portion; and recording control means for controlling said second ink jet printing nozzle portion to perform further printing on the print area where drying is promoted by said drying space, wherein said recording control means controls said first ink jet printing nozzle portion to print a portion of image data and said second ink jet printing nozzle portion to print any remaining image data, which is not printed by said first ink jet printing nozzle portion, on the print area where drying is promoted by said drying space, to supplement printing.

22. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging ink of the predetermined color to a print area of the print medium in accordance with a portion of image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging onto the print area remaining ink of the predetermined color necessary to complete printing of the image data;

a drying space for promoting drying of the ink of the predetermined color in the print area including a print portion printed on the print medium by said first ink jet printing nozzle portion, said drying space provided between said first ink jet printing nozzle portion and said second ink jet printing nozzle portion; and recording control means for controlling said second ink jet printing nozzle portion to perform further printing on the print area where drying is promoted by said drying space, wherein said recording control means controls said first ink jet printing nozzle portion to print a portion of image data and said second ink jet printing nozzle portion to print any remaining image data, which is not printed by said first ink jet printing nozzle portion, on the print area where drying is promoted by said drying space, to supplement printing.

23. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each of the scannings, said apparatus comprising:

a first ink jet printing nozzle portion for discharging ink of a predetermined color during a first scanning operation, said first ink jet printing nozzle portion discharging ink of the predetermined color to a print area of the print medium in accordance with a portion of image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging onto the print area remaining ink droplets of the predetermined color necessary to complete printing of the image data;

a drying space for promoting drying of the ink of the predetermined color in the print area including a print portion printed on the print medium by said first ink jet printing nozzle portion, said drying space provided between said first ink jet printing nozzle portion and said second ink jet printing nozzle portion; and recording control means for controlling said second ink jet printing nozzle portion to perform further printing on the print area where drying is promoted by said drying space, wherein said recording control means controls said first ink jet printing nozzle portion to print a portion of image data and said second ink jet printing nozzle portion to print any remaining image data.

24. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging ink of the predetermined color at a print density smaller than final print density of ink of the predetermined color to be discharged to a print area of the print medium in accordance with image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging ink of the predetermined color at the print area to complete printing of the image data at the final print density; and recording control means for controlling said first and second ink jet printing nozzle portions to perform printing on the print area, wherein said recording control means controls said first ink jet printing nozzle portion to print a portion of image data and said second ink jet printing nozzle portion to print any remaining image data, which is not printed by said first ink jet printing nozzle portion, on the print area to supplement printing, wherein a drying space is defined between said first ink jet printing nozzle portion and said second ink jet printing nozzle portion, and drying of the ink of the predetermined color in the print area including the print portion printed on the print medium by said first ink jet printing nozzle portion is promoted by the drying space.

25. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color duting a first scanning operation, said first ink jet printing nozzle portion discharging ink of the predetermined color at a print density smaller than a final print density of ink of the predetermined color to be discharged to a print area of the print medium in accordance with image data regarding ink of the predetermined color;

a second ink jet printing nozzle portion located downstream of said first ink jet printing nozzle portion relative to the moving direction of the print medium for discharging ink of the predetermined color during a second scanning operation different from the first scanning operation, said second ink jet printing nozzle portion discharging ink of the predetermined color at the print area to complete printing of the image data at the final print density; and recording control means for controlling said first and second ink jet printing nozzle portions to perform printing on the print area, wherein said recording control means controls said first ink jet printing nozzle portion to print a portion of image data and said second ink jet printing nozzle portion to print any remaining image data, wherein a drying space is defined between said first ink jet printing nozzle portion and said second ink jet printing nozzle portion, and drying of the ink of the predetermined color in the print area including the print portion printed on the print medium by said first ink jet printing nozzle portion is promoted by the drying space.

26. An ink jet printing apparatus for performing printing at a printing area on a print medium with printing nozzle portions for discharging ink onto the print medium by repeating a scanning of the printing nozzle portions transverse to a moving direction of the print medium, the ink being discharged for printing during each scanning, said apparatus comprising:

a first ink jet printing nozzle portion for discharging ink of a predetermined color during a first scanning operation, said first ink jet printing nozzle portion discharging ink of the predetermined color to a portion of a print area of the print medium;

a second ink jet printing nozzle portion located downstream of said first ink jet printing nozzle portion relative to the moving direction of the print medium for discharging ink of the predetermined color during a second scanning operation different from the first scan ning operation, said second ink jet printing nozzle portion discharging ink onto the print area to perform complementary printing of the predetermined color necessary to complete printing; and recording control means for controlling said first and second ink jet printing nozzle portions to perform printing on the print area, wherein said recording control means controls said first ink jet printing nozzle portion to print a portion of the print area of the print medium and said second ink jet printing nozzle portion to perform the complementary printing of the predetermined color necessary to complete printing, wherein a drying space is defined between said first ink jet printing nozzle portion and said second ink jet printing nozzle portion, and drying of the ink of the predetermined color in the print area including the print portion printed on the print medium by said first ink jet printing nozzle portion is promoted by the drying space.

* * * * *

UNITED STATES PATENT AND TRADEMARK OFFICE

CERTIFICATE OF CORRECTION

PATENT NO. : 6,116,728

DATED : September 12, 2000

INVENTOR(S) : MIYAKE ET AL.

It is certified that error appears in the above-identified patent and that said Letters Patent is hereby corrected as shown below:

After [73] Assignee:
The following should be inserted:

--[*] Notice: This patent issued on a continued prosecution application filed under 37 CFR 1.53(d), and is subject to the twenty year patent term provisions of 35 U.S.C. 1.54(a)(2).--.

References Cited:
U.S. PATENT DOCUMENTS, the following should be inserted:

| | | |
|---|---|---|
| --5,708,463 | 01/1998 | Hirabayashi et al. |
| 5,745,135 | 04/1998 | Hirabayashi et al.--. |

COLUMN 1:
Line 27, "ha" should read --has--.
Line 53, "tired" should read --tried--.
Line 66, "such" should read --such a--.

COLUMN 3:
Line 35, "locate" should read --located--.
Line 58, "mens" should read --means--.

COLUMN 4:
Line 31, "bock" should read --block--.

COLUMN 5:
Line 38, "ia" should read --is--.

COLUMN 6:
Line 37, "are" should read --a--.

UNITED STATES PATENT AND TRADEMARK OFFICE

CERTIFICATE OF CORRECTION

PATENT NO. : 6,116,728

DATED : September 12, 2000

INVENTOR(S) : MIYAKE ET AL.

It is certified that error appears in the above-identified patent and that said Letters Patent is hereby corrected as shown below:

COLUMN 8:
Line 14, "discharge" should read --discharged--.

COLUMN 9:
Line 40, "place" should read --placed--.

COLUMN 12:
Line 63, "in increase for decreased)" should read -- is increased (or decreased)--.

COLUMN 13:
Line 32, "253" should read --258--.

COLUMN 14:
Line 58, "form" should read --from--.

COLUMN 16:
Line 19, "an" should read --and--.
Line 50, "base" should read --based--.

COLUMN 17:
Line 50, "a." should read --a--.

COLUMN 18:
Line 29, "thee" should read --there--.

COLUMN 19:
Line 24, "owning" should read --owing--.
Line 35, "first." should read --first--.

UNITED STATES PATENT AND TRADEMARK OFFICE

CERTIFICATE OF CORRECTION

PATENT NO. : 6,116,728

DATED : September 12, 2000

INVENTOR(S) : MIYAKE ET AL.

It is certified that error appears in the above-identified patent and that said Letters Patent is hereby corrected as shown below:

COLUMN 20:
Line 9, "owning" should read --owing--.

COLUMN 23:
Line 16, "an" should read --and--.

COLUMN 25:
Line 33, "or" should read --for--.

COLUMN 26:
Line 62, "n/2-the" should read --n/2-th--.

COLUMN 29:
Line 61, "EL" should read --a--.

COLUMN 34:
Line 46, "therein" should read --wherein--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*